US006721520B2

(12) United States Patent
Higeta et al.

(10) Patent No.: US 6,721,520 B2
(45) Date of Patent: Apr. 13, 2004

(54) REMANUFACTURING METHOD FOR PROCESS CARTRIDGE

(75) Inventors: Akira Higeta, Shizuoka-ken (JP); Satoshi Yasuda, Tokyo (JP); Yoshiyuki Kakumi, Tuchiura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/020,981

(22) Filed: Dec. 19, 2001

(65) Prior Publication Data

US 2002/0106213 A1 Aug. 8, 2002

(30) Foreign Application Priority Data

Dec. 20, 2000 (JP) ..... 2000-387807

(51) Int. Cl.[7] ..... G03G 15/00

(52) U.S. Cl. ..... 399/109; 399/103; 399/104; 399/113

(58) Field of Search ..... 399/109, 111, 399/113, 102, 103, 104, 105, 106

(56) References Cited

U.S. PATENT DOCUMENTS

| | | | | |
|---|---|---|---|---|
| 4,851,960 A | | 7/1989 | Nakamura et al. | 361/225 |
| 5,331,373 A | | 7/1994 | Nomura et al. | 399/111 |
| 5,452,056 A | | 9/1995 | Nomura et al. | 399/111 |
| 5,485,249 A | | 1/1996 | Higeta et al. | 399/105 |
| 5,585,889 A | | 12/1996 | Shishido et al. | 399/113 |
| 5,592,268 A | | 1/1997 | Uehara et al. | 399/276 |
| RE35,581 E | | 8/1997 | Nakamura et al. | 361/225 |
| 5,740,499 A | | 4/1998 | Higeta et al. | 399/105 |
| 5,809,374 A | | 9/1998 | Tsuda et al. | 399/111 |
| 5,987,278 A | * | 11/1999 | Nomura et al. | 399/109 |
| 6,101,348 A | | 8/2000 | Nonaka et al. | 399/103 |
| 6,185,390 B1 | | 2/2001 | Higeta et al. | 399/90 |
| 6,272,300 B1 | * | 8/2001 | Fujiwara et al. | 399/113 |
| 6,311,026 B1 | | 10/2001 | Higeta et al. | 399/13 |
| 6,336,015 B1 | * | 1/2002 | Numagami | 399/104 |
| 6,473,577 B1 | * | 10/2002 | Higeta et al. | 399/109 |

FOREIGN PATENT DOCUMENTS

| | | |
|---|---|---|
| JP | 63-149669 | 6/1988 |
| JP | 6-019241 | 1/1994 |
| JP | 6-130740 | 5/1994 |
| JP | 7-261550 | 10/1995 |
| JP | 7-295376 | 11/1995 |
| JP | 8-036305 | 2/1996 |
| JP | 8-137275 | 5/1996 |
| JP | 8-305258 | 11/1996 |
| JP | 9-171293 | 6/1997 |
| JP | 11-126008 | 5/1999 |
| JP | 2001-042649 | * 2/2001 |

* cited by examiner

*Primary Examiner*—Sophia S. Chen
(74) *Attorney, Agent, or Firm*—Fitzpatrick, Cella, Harper & Scinto

(57) ABSTRACT

A remanufacturing method for a process cartridge includes (a) separating a process cartridge into a lower frame member and an upper frame, (b) dismounting the photosensitive drum from the lower frame member, (c) dismounting the developing roller from the lower frame member, (d) sticking magnetic seals on the lower frame member, (e) sticking a blade elastic member at each of one and the other longitudinal ends of the developing blade, (f) mounting the developing roller onto the lower frame member, (g) mounting the photosensitive drum to the lower frame member, (h) refilling the developer into the developer accommodating portion in the upper frame, and (i) connecting an upper frame into which the developer has been refilled with a lower frame member.

29 Claims, 40 Drawing Sheets

(a)

(b)

REMANUFACTURING METHOD FOR PROCESS CARTRIDGE

FIELD OF THE INVENTION AND RELATED ART

The present invention relates to a remanufacturing method for a process cartridge. Here, the process cartridge is a cartridge containing as a unit an electrophotographic photosensitive member and charging means, developing means or cleaning means, the cartridge being detachably mountable to a main assembly of the image forming apparatus. Or, the process cartridge may contain an image bearing member at least one of charging means, developing means and cleaning means, the process cartridge being detachably mountable to the main assembly of the image forming apparatus. Furthermore, the process cartridge may contain at least the electrophotographic photosensitive drum and the developing means.

The image forming apparatus may be an electrophotographic copying machine, an electrophotographic printer (LED printer, a laser beam printer or the like), an electrophotographic facsimile machine, an electrophotographic word processor or the like.

In the field of an image forming apparatus using an electrophotographic image forming process, a process cartridge is used which contains as a unit an electrophotographic photosensitive member and process means actable on said electrophotographic photosensitive member, the cartridge being detachably mountable to the main assembly of the apparatus. Such a process cartridge can be maintained in effect by the user without a serviceman, and therefore, the operativity is remarkably improved. Therefore, the process cartridge type machines are widely used in the field of the image forming apparatus.

The process cartridge forms an image on the recording material using a developer. With the image forming operations, the developer is consumed. When the developer has been consumed to such an extent that image of a quality satisfactory to the user of the process cartridge cannot be formed, the commercial value as the process cartridge is lost.

An easy remanufacturing method for process cartridges is desired by which the process cartridge having lost its commercial value due to consumption of the developer regain the commercial value.

SUMMARY OF THE INVENTION

Accordingly, it is a principal object of the present invention to provide an easy remanufacturing method for a process cartridge.

It is another object of the present invention to provide a remanufacturing method for a process cartridge to refresh a process cartridge having lost its commercial value due to consumption of the developer therein to such an extent that images of the quality satisfactory to the user cannot be formed, back to an extent of sufficient commercial value.

According to an aspect of the present invention, there is provided a remanufacturing method for a process cartridge detachably mountable to a main assembly of an electrophotographic image forming apparatus, comprising (a) a frame separating step of separating a process cartridge into a lower frame member having an electrophotographic photosensitive drum, a developing roller for developing an electrostatic latent image formed on the photosensitive drum and a cleaning blade for removing a developer remaining on the photosensitive drum, and an upper frame having a charging roller for electrically charging the photosensitive drum and a developer accommodating portion for accommodating a developer to be used for developing the electrostatic latent image; (b) a photosensitive drum dismounting step of dismounting the photosensitive drum from the lower frame member by removing from the lower frame member a supporting member provided at one and the other longitudinal ends of the photosensitive drum; (c) a developing roller dismounting step of dismounting the developing roller from the lower frame member; (d) a magnetic seal sticking step of sticking magnetic seals on the lower frame member along a direction crossing with a longitudinal direction of the developing roller such that they are opposed to parts of a peripheral surface of the developing roller, and are disposed at one and the other longitudinal end of the developing roller, respectively, when the developing roller is mounted to the lower frame member; (e) an elastic member sticking step of sticking a blade elastic member at each of one and the other longitudinal ends of a developing blade on its backside which is opposite from a side opposed to the developing roller, the developing blade being effective to regulate the amount of the developer deposited on the peripheral surface of the developing roller; (f) a developing roller mounting step of mounting the developing roller onto the lower frame member; (g) a photosensitive drum mounting step of mounting the photosensitive drum to the lower frame member by inserting the photosensitive drum into the lower frame member and mounting the supporting member to an outside of the lower frame member at the one and other longitudinal end; (h) a developer filling step of refilling the developer into the developer accommodating portion in the upper frame; and (i) a frame coupling process of connecting an upper frame into which the developer has been refilled with a lower frame member having the blade elastic member on the backside of the developing blade, the magnetic seal, the developing roller and the photosensitive drum which have been remounted.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Next, the preferable embodiment of the present invention will be described. In the following descriptions, the short length direction (which will be referred to as "widthwise direction) of the process cartridge B is the direction in which the process cartridge B is mounted into, or dismounted from, the image forming apparatus main assembly A, and coincides with the direction in which recording medium is conveyed. The lengthwise direction of the process cartridge B is a direction which intersects (virtually perpendicularly) with the direction in which the process cartridge B is mounted into, or removed from, the image forming apparatus A, is parallel to the surface of the recording medium, and also, intersects (virtually perpendicularly) with the direction in which the recording medium is conveyed. Further, the left or right of the process cartridge B means the left or right of the process cartridge B as the process cartridge B is seen from above, and upstream in terms of the recording medium conveyance direction.

Figure 1:
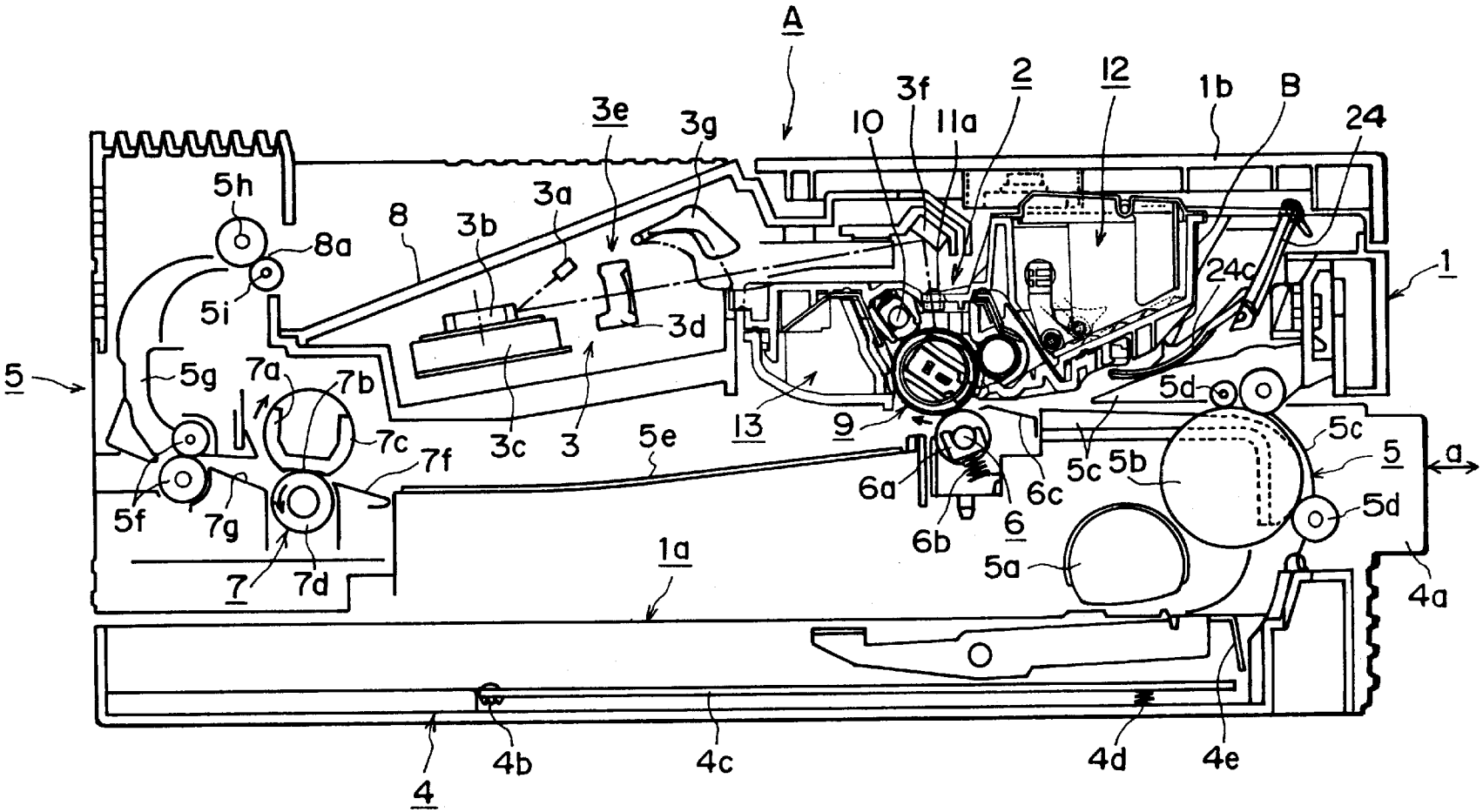
FIG. 1 is a longitudinal sectional view of a laser beam printer to which a process cartridge according to an embodiment of the present invention is mounted.
Figure 2:
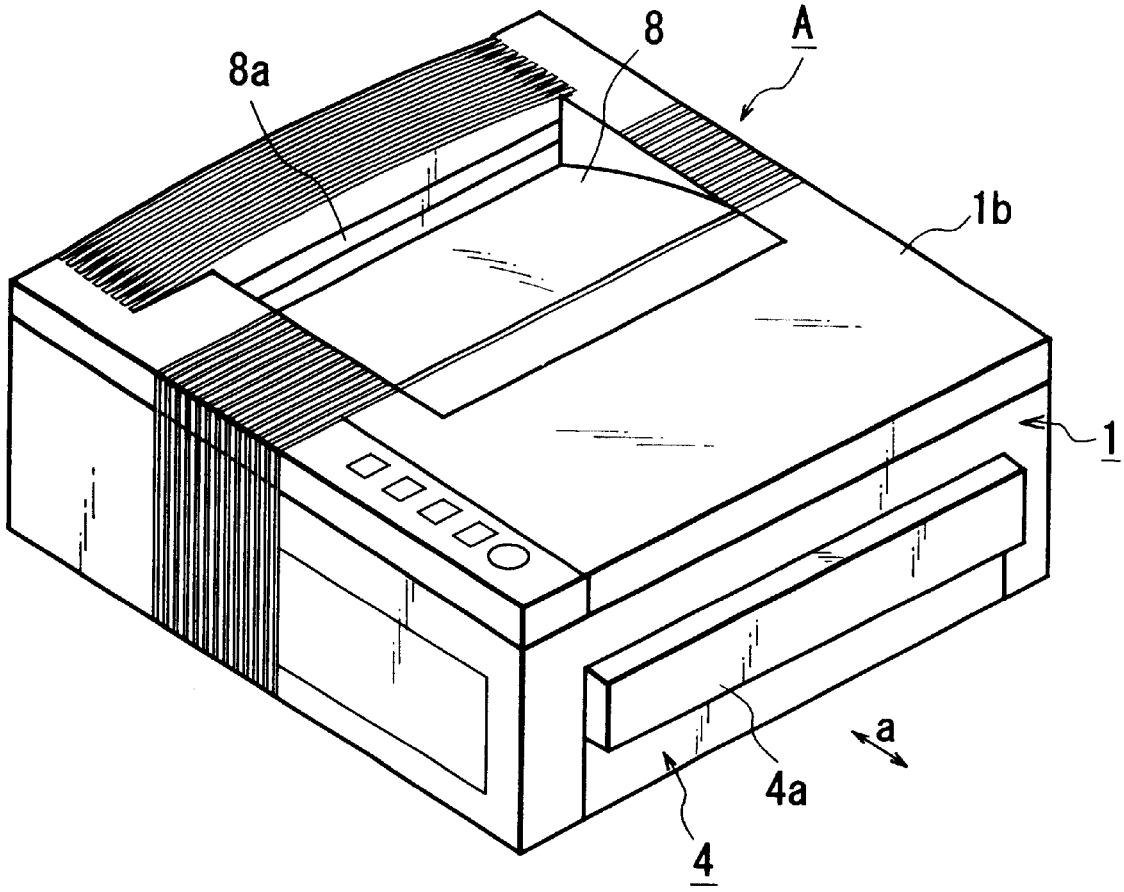
FIG. 2 is a perspective view of an outer appearance of the laser beam printer.

General Descriptions of Process Cartridge and Image Forming Apparatus Containing Process Cartridge First, the general structure of an image forming apparatus will be roughly described. FIG. 1 is a sectional view of a laser printer, or one of various types of image forming apparatuses, in which a process cartridge has been mounted, and FIG. 2 is an external perspective view of the laser printer.

Referring to FIG. 1, in the case of this image forming apparatus A, a process cartridge B having an image bearing member and a minimum of one processing means has been removably mounted in the cartridge mounting portion 2 of the main assembly 1 of the apparatus A. In the top portion of the internal space of the apparatus main assembly 1, an optical system 3 is disposed, which projects an optical image in accordance with the image formation data given from an external device or the like, upon the image bearing member in the process cartridge B. In the cassette mounting portion in the bottom portion of the internal space of the apparatus main assembly 1, a cassette 4 has been mounted, in which a single or a plurality of recording media are stored in layers. The recording media in the cassette 4 are conveyed, one by one, by a recording medium conveying means 5. Further, the apparatus main assembly 1 is provided with a transfer roller 6, which is for transferring a developer (which hereinafter will be referred to as toner) image formed on the image bearing member, onto recording medium, and is on the location at which its peripheral surface opposes the peripheral surface of the image bearing member of the process cartridge B. On the downstream side in terms of the recording medium conveyance direction with respect to the transfer roller 6, a fixing means 7 is disposed for fixing the transferred unfixed toner image on the recording medium to the recording medium. After the fixing of the toner image to the recording medium, the recording medium is discharged by the aforementioned conveying means 5 into a delivery portion 8 located on top of the apparatus main assembly 1.

Image Forming Apparatus

Next, the structures of the various portions of the image forming apparatus A will be described in the following order: the optical system 3, recording medium conveying means 5, transfer roller 6, and fixing means 7.

Optical System

The optical system 3 is a system which projects an optical image in accordance with the image formation data obtained from an external device or the like, onto an image bearing member. Referring to FIG. 1, it comprises a scanner unit 3*e* and a reflection mirror 3*f*, which are disposed within the apparatus main assembly 1. The scanner unit 3*e* comprises: a laser diode 3*a*, a polygon mirror 3*b*, a scanner motor 3*c*, and a focusing lens 3*d*. As an image formation signal is given to the optical system 3 from an external device, for example, a computer or a word processor, the laser diode 3*a* emits light in response to the given image formation signals, and this light is projected as image formation light onto the polygon mirror 3*b*, which is being rotated at a high speed by a scanner motor 3*c*. The image formation light is reflected by the mirror 3*b*, toward the focusing lens 3*d*. Then, it is projected through the focusing lens 3*d*, is deflected by the reflection mirror 3*f*, and is focused upon a photoconductive drum 9 as an image bearing member, selectively exposing the peripheral surface of the photoconductive drum 9. As a result, a latent image in accordance with the image formation data is formed on the photoconductive drum 9. Incidentally, in this embodiment, the scanner unit is inclined diagonally upward so that the image formation light is directed diagonally upward toward the reflection mirror 3*f* after passing through the focusing lens 3*d*. The scanner unit 3*e* as a laser light emitting means is provided with a laser shutter 3*g*, which is enabled to assume the closed position (contoured by double-dot chain line in FIG. 1) in which it blocks the path of the laser beam to prevent the laser beam from accidentally leaking, and a position (contoured by solid line in FIG. 1) into which it retreats from the closed position to unblock the path of the laser beam when a latent image is formed.

Recording Means Conveying Means

The recording medium conveying means 5 is a means which conveys, one by one, the recording media stored in layers in the cassette 4, to the image formation station, and also conveys the recording media to the delivery portion 8, through the fixing means 7. The cassette 4 is large enough to occupy the entirety of the bottom portion of the apparatus main assembly 1. It is enabled to be removably mounted into the cassette mounting portion la in the bottom portion of the apparatus main assembly 1, in the direction indicated by an arrow mark a, from the front side of the apparatus main assembly 1, by being held by the hand hold portion 4*a*. The cassette 4 is provided with a recording medium supporting plate 4*c*, which is disposed within the cassette 4, being rendered rotatable about a shaft 4*b*, and also being kept pressed upward by a spring 4*d*. As recording media are placed in layers on the recording medium supporting plate 4*c*, the leading ends of the recording media, in terms of the recording medium conveyance direction, are engaged with a separation claw 4*e*. As the recording medium conveyance begins after the mounting of the cassette 4 into the apparatus main assembly 1, a pickup roller 5*a* rotates, and the recording media in the cassette 4 are fed out of the cassette 4, one by one, from the top, into the apparatus main assembly 1, by the rotation of the pickup roller 5*a*. After being fed into the apparatus main assembly 1, each recording medium is conveyed to the image formation station, through the first reversing path, which comprises a reversing roller 5*b*, a guide 5*c*, a conveying roller 5*d*, and the like, and by which the recording medium is placed upside down. In the image formation station, the recording medium is conveyed to the compression nip between the photoconductive drum 9 and transfer roller 6, in which the toner image on the image bearing member is transferred onto the recording medium. After receiving the toner image, the recording medium is conveyed, while being guided by a cover guide 5*e*, to the fixing means 7, in which the toner image is fixed to the recording medium. After being passed through the fixing means 7, the recording medium is sent to the second reversing path 5*g* having a bow-like curvature, past the intermediary conveyance or discharge roller 5*f*. As the recording medium is sent through this second reversing path 5*g*, it is placed upside down for the second time, and then, it is discharged from the apparatus main assembly 1 through the discharge opening 8*a* by a pair of discharge rollers 5*h* and 5*i*, accumulating in the delivery portion 8 located above the scanner unit 3*e* and the process cartridge B. In this embodiment, the recording medium conveyance path, which is made up of essentially the first end second reversing paths, is structured so that its vertical section appears like a letter "S." This structural arrangement makes it possible to reduce the apparatus main assembly 1 in size, while making it possible for the recording media to accumulate in the delivery portion 8, with their image bearing surfaces facing downward, after image formation.

Transferring Means

The transferring means is a means which transfers the toner image having formed on the image bearing member in the image formation station, onto the recording medium. Referring to FIG. 1, the transferring means in this embodiment comprises the transfer roller 6. In operation, the toner image on the image bearing member is transferred onto the recording medium, by applying to the transfer roller 6, voltage opposite in polarity to the toner image on the image bearing member, while keeping the recording medium pressed by the transfer roller 6, upon the image bearing member of the process cartridge B having been mounted in the apparatus main assembly 1. The transfer roller 6 is supported by the apparatus main assembly 1, with the interposition of a pair of bearings 6*a*, which are kept pressured toward the axial line of the photoconductive drum 9, by a pair of springs 6*b*, in such a manner that the transfer roller 6 is pressed upon the image bearing member, being allowed to move toward, or away from, the axial line of the photoconductive drum 9. On the upstream side of the transfer roller 6, in terms of the recording medium conveyance direction, a guiding member 6*c* is provided, which smoothly guides the recording medium into the nip between the image bearing member and transfer roller 6, and also covers the peripheral surface of the transfer roller 6, preventing the toner particles from scattering. After passing through the nip between the image bearing member and transfer roller 6, the recording medium is conveyed diagonally downward at approximately 200 relative to the horizontal direction, to assure that the recording medium separates from the image bearing member.

Fixing Means

The fixing means 7 is a means which fixes to the recording medium, the toner image having been transferred onto the recording medium by the application of voltage to the transfer roller 6. It is structured as shown in FIG. 1. That is, in the fixing means 7, a referential code 7*a* designates a heat resistant film guiding member, which is in the form of a semicylindrical trough. The guiding member 7*a* is provided with a flat ceramic heater 17*b* with a small thermal capacity, which is in the downwardly facing surface, extending in the lengthwise direction. The fixing means 7 is also provided with a cylindrical (endless) thin film 7*c*, which is formed of heat resistant resin, and is loosely fitted around the guiding member 7*a*. This film 7*c* has a laminar structure, having three layers: approximately 50 pm thick base layer formed of polyimide; approximately 4 pm thick primer layer; and approximately 10 pm thick fluorine coat layer. The base layer is formed of strong and pliable material, and is given a sufficient thickness to withstand the various stresses and frictions to which the film is subjected. The primer layer is formed of a combination of PTFE and PFA, in which carbon has been mixed. Therefore, it is electrically conductive. Below the guiding member 7*a*, a pressure roller 7*d* is disposed, which is kept pressed upward by a pair of springs (unshown), upon the ceramic heater 7*b*, with the interposition of the film 7*c*. In other words, the ceramic heater 7*b* and pressure roller 7*d* form the fixing nip, with the film 7*c* pinched between the ceramic heater 7*b* and pressure roller 7*d*. The pressure roller 7*d* comprises a metallic core and a layer of soft silicon rubber. The peripheral surface of the silicon rubber layer is coated with fluorine. The ceramic heater 7*b* generates heat as electricity is flowed through it. Its temperature is kept at a predetermined fixing temperature, by the temperature controlling system of the control system. The pressure roller 7*d* is rotationally driven at a predetermined peripheral velocity in the counterclockwise direction indicated by an arrow mark in FIG. 1. As the pressure roller 7*d* is rotationally driven, the cylindrical film 7*c* is rotationally driven through the fixing nip, by the friction between the pressure roller 7*d* and film 7*c*, at a predetermined peripheral velocity, around the film guiding member 7*a*, in the clockwise direction indicated by an arrow mark in FIG. 1, sliding on the downwardly facing heating surface of the ceramic heater 7*b*. The recording medium, which has been conveyed to the fixing means 7 after the image transfer, is guided by the entrance guide 7*f* into the fixing nip between the ceramic heater 7*b*, the temperature of which is being controlled, and the pressure roller 7*d*, more specifically, between the cylindrical film 7*c*, which is being rotationally driven, and the pressure roller 7*d*. Then, the recording medium is advanced through the nip, along with the film 7*c*, indirectly sliding on the downwardly facing surface of the ceramic heater 7*b*, with the presence of the film 7*c* between the recording medium and the ceramic heater 7*b*. While the recording medium is passed through the fixing nip, the unfixed toner image on the recording medium is subjected to the heat from the ceramic heater 7*b* through the film 7*c*, being heated thereby. As a result, the unfixed image is permanently fixed to the recording medium. After being passed through the fixing nip, the recording medium is separated from the peripheral surface of the rotationally driven film 7*c*, is guided by an exit guide 7*g* to the intermediary conveyance roller 5*f*, and then, is discharged into the delivery portion 8 by the pair of discharge rollers 5*h* and 5*i* through the second reversing path 5*g*.

Figure 3:
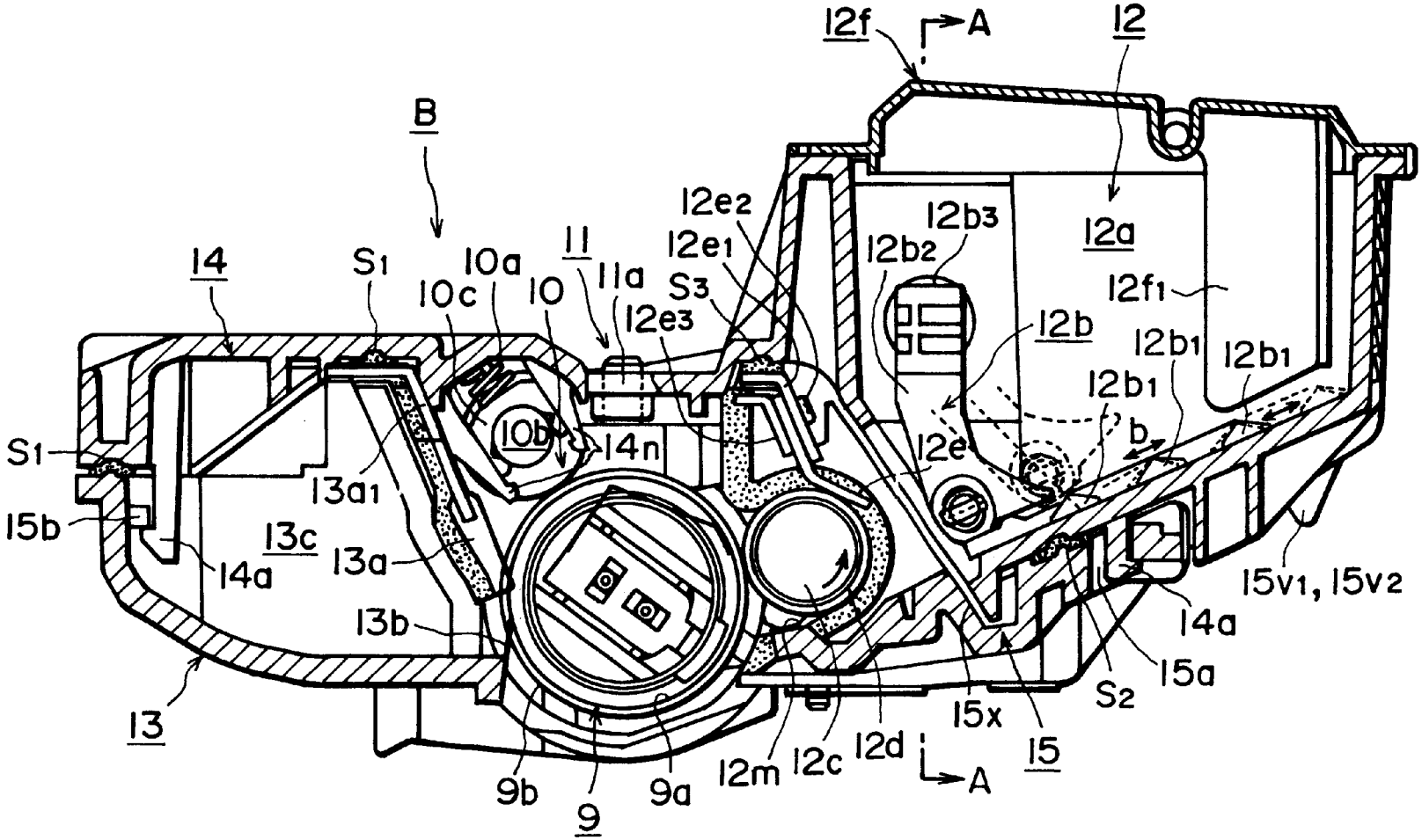
FIG. 3 is a sectional view of the process cartridge.
Figure 4:
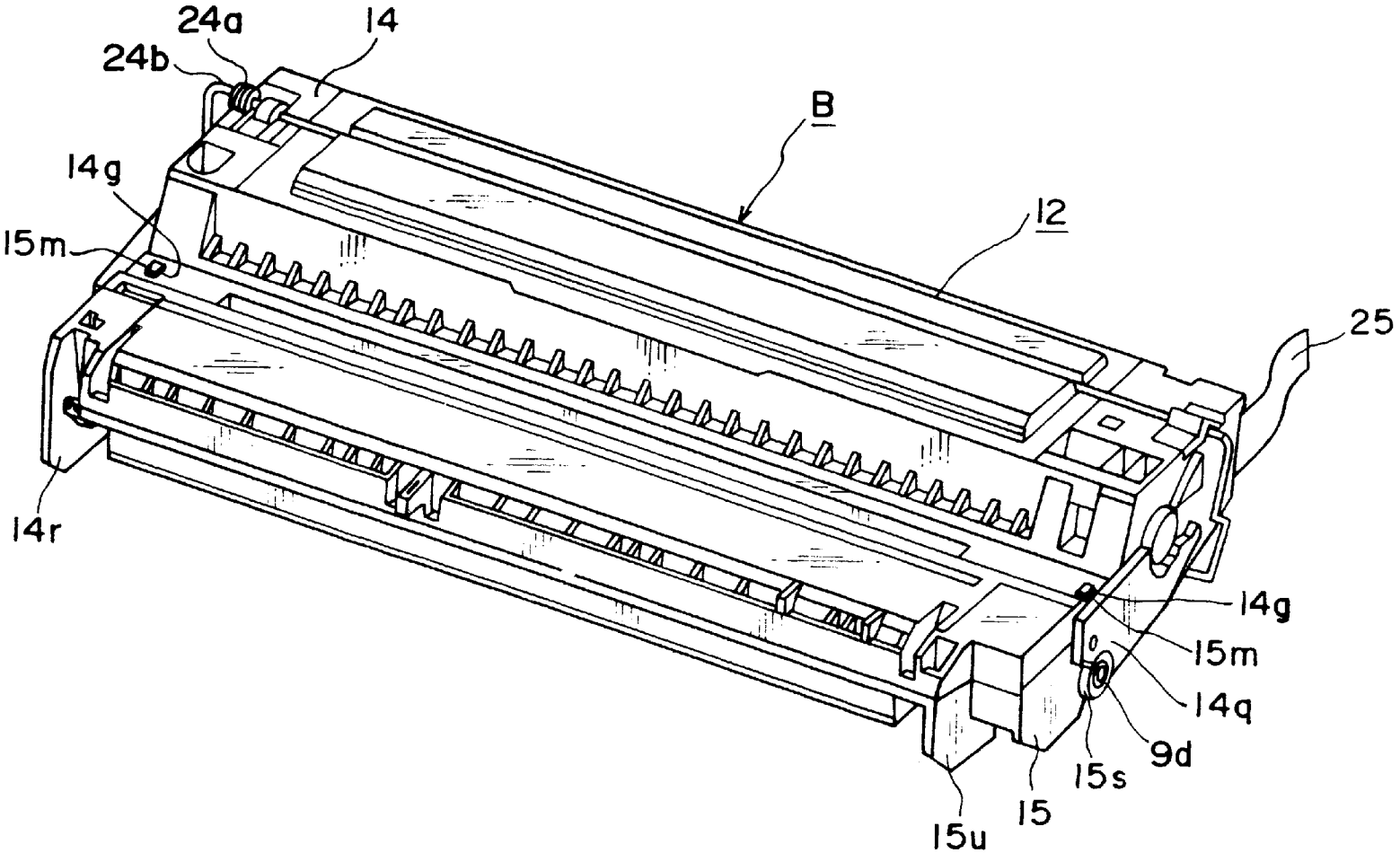
FIG. 4 is a perspective view of an outer appearance of the process cartridge.
Figure 5:
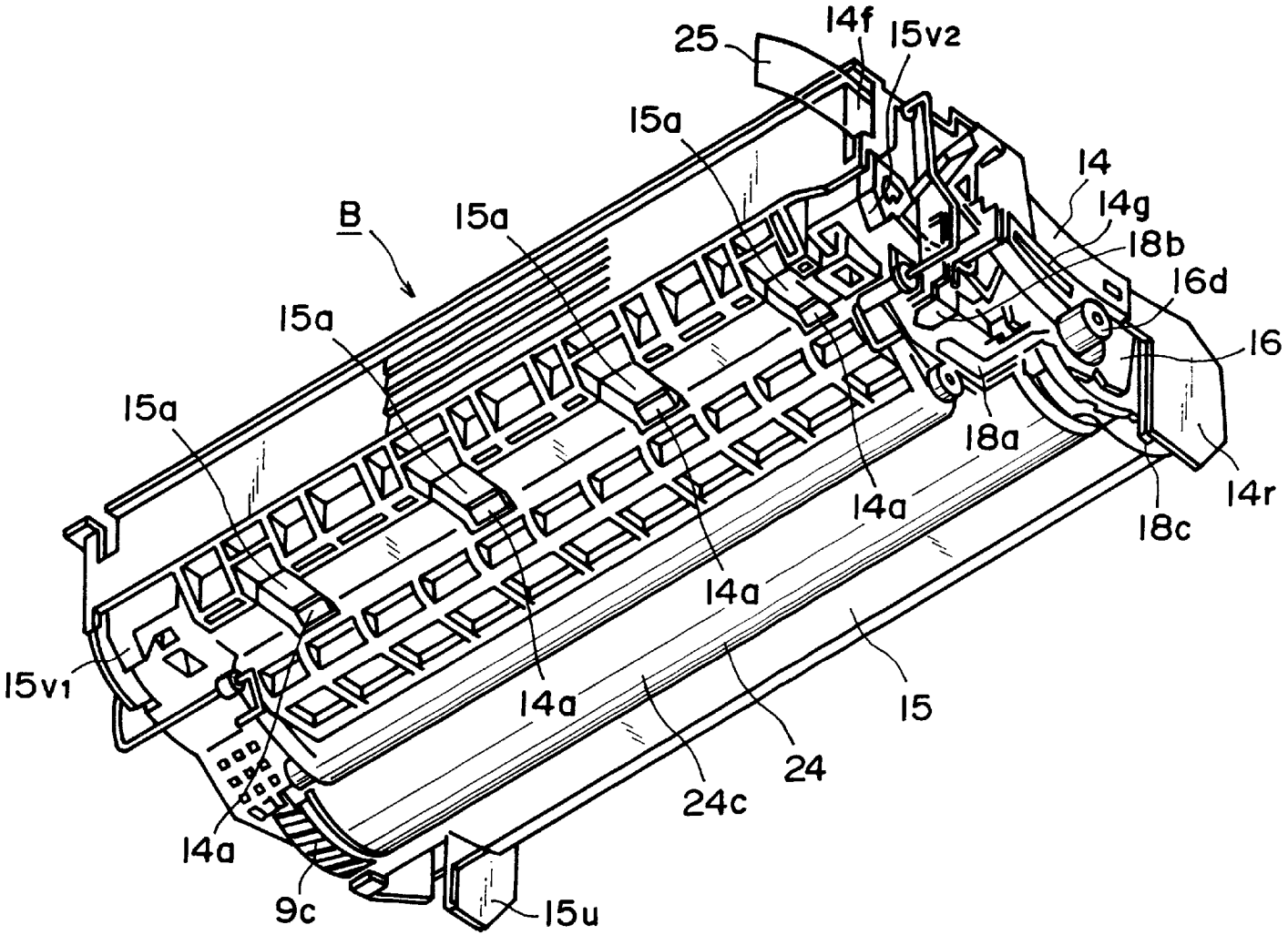
FIG. 5 is a perspective view of an outer appearance of the process cartridge upside down.
Figure 6:
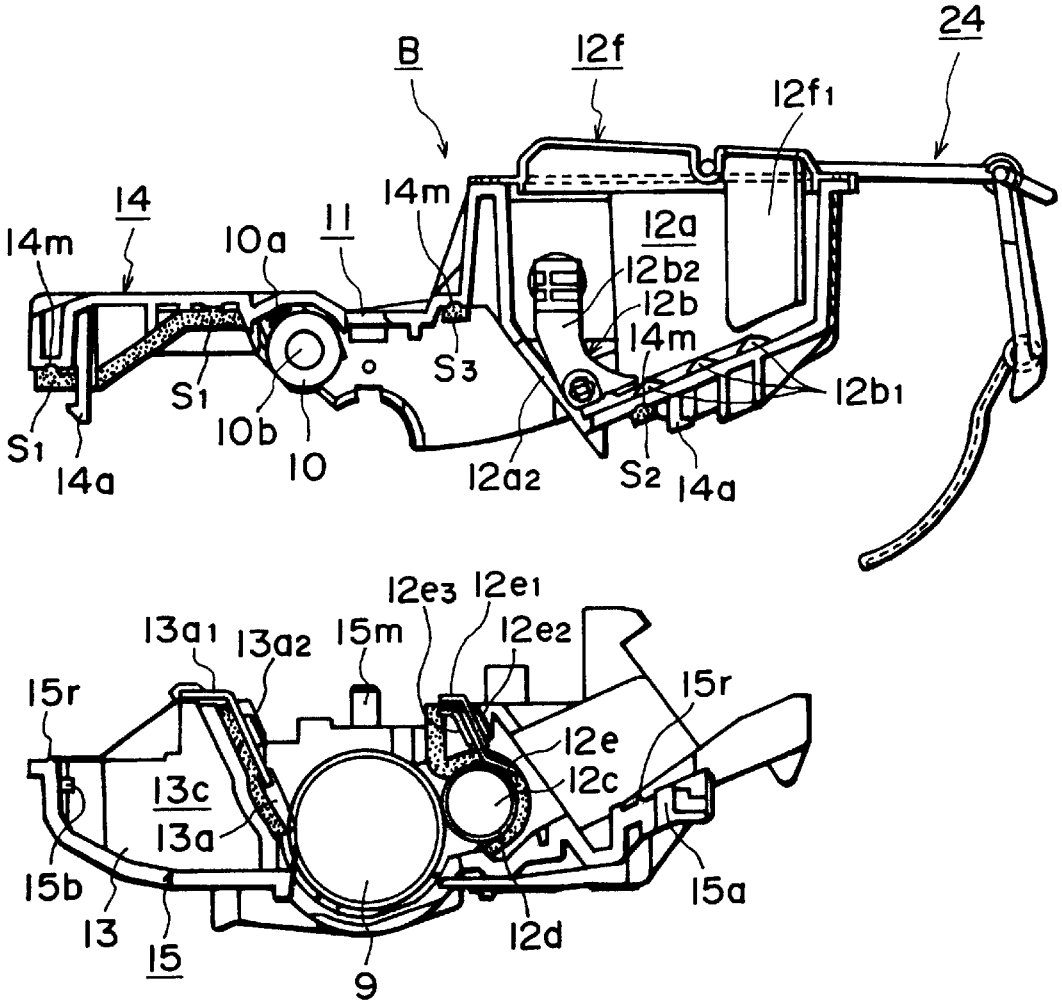
FIG. 6 is a longitudinal sectional view of the process cartridge which is divided into upper and lower frame members.
Figure 7:
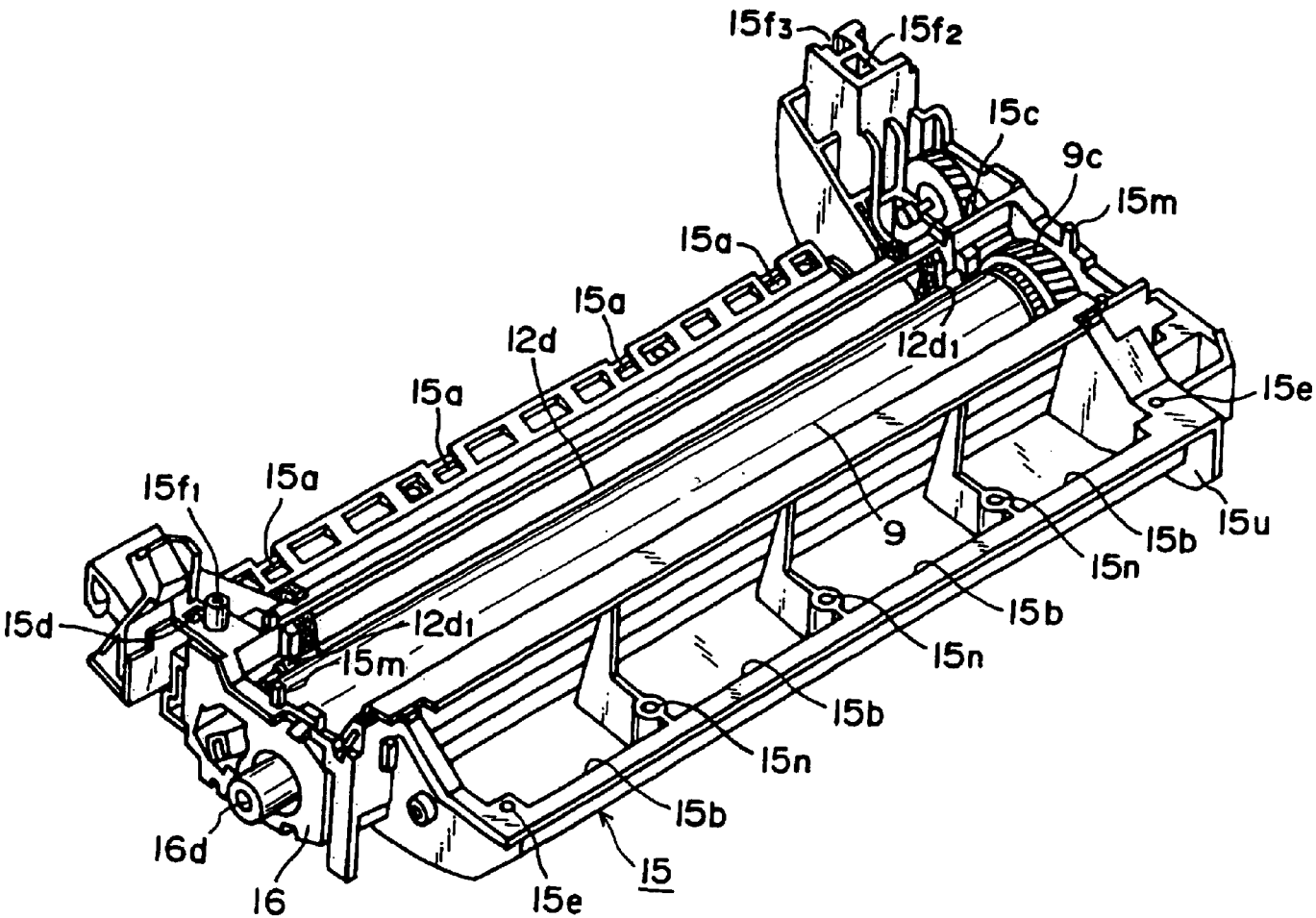
FIG. 7 is a perspective view of the inside of the lower frame member.
Figure 8:
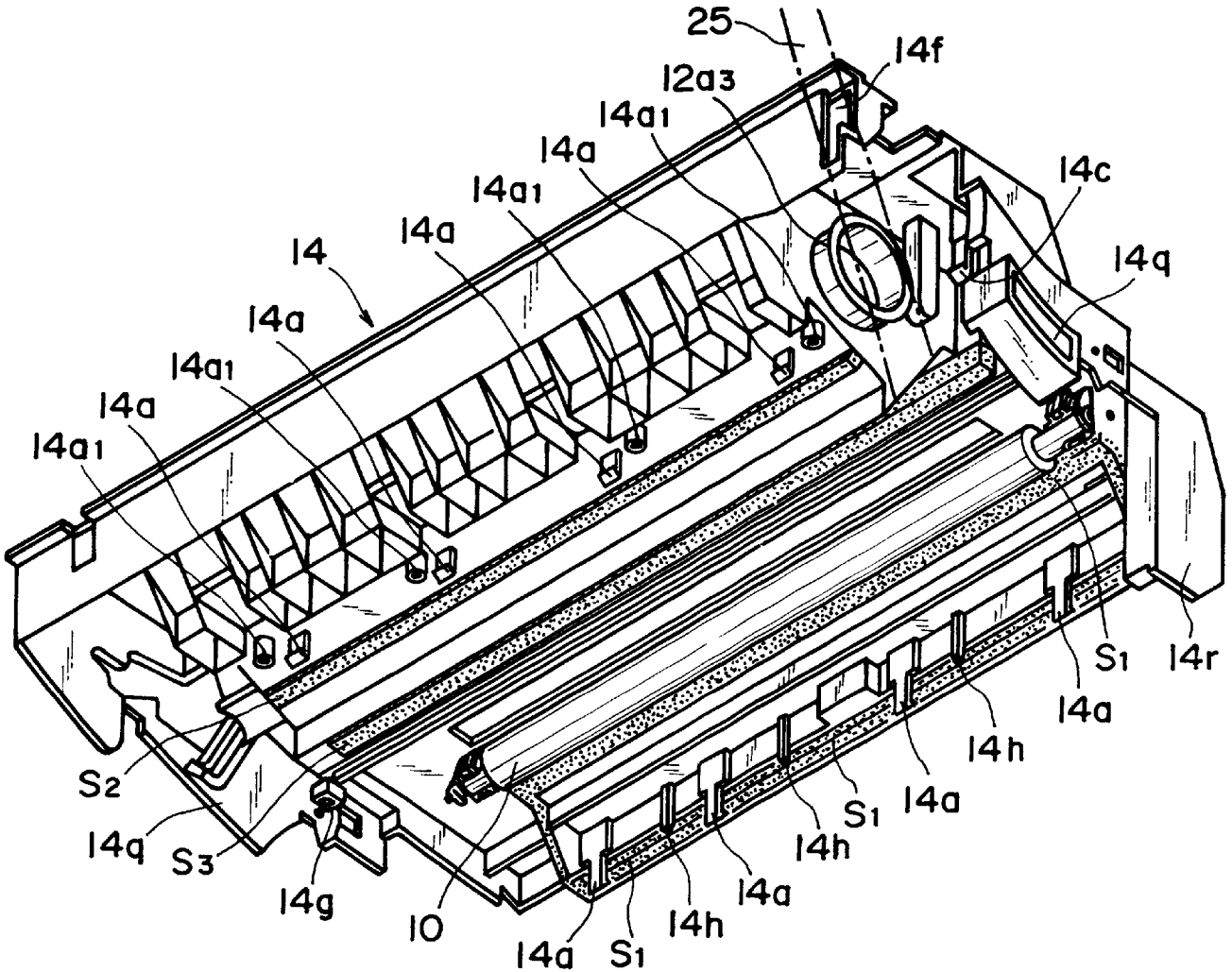
FIG. 8 is a perspective view of the inside of the upper frame.

Next, the structures of the various portions of the process cartridge B which is mounted into the image forming apparatus A will be described. FIG. 3 is a sectional view of the process cartridge, for showing the structure thereof, and FIG. 4 is an external perspective view of the process cartridge. FIG. 5 is an external perspective view of the same process cartridge as the one in FIG. 4, which has been placed upside down. FIG. 6 is sectional view of the process cartridge, which has been disassembled into the top and bottom halves. FIG. 7 is a perspective view of the inward side of the bottom half of the process cartridge. FIG. 8 is a perspective view of the inward side of the top half of the process cartridge.

This process cartridge B is provided with an image bearing member, and a minimum of one processing means. As for processing means, there are a charging means for charging the peripheral surface of an image bearing member, a developing means for forming a toner image on the peripheral surface of an image bearing member, a cleaning means for removing the toner particles remaining on the peripheral surface of an image bearing member, and the like. Referring to FIGS. 1 and 3, in the case of the process cartridge B in this embodiment, a charge roller 10 as a charging means, a developing means 12 containing toner (developer), and a cleaning means 13, are disposed in a manner to surround the peripheral surface of the electrophotographic photoconductive drum 9 as an example of an image bearing member, and the preceding components are covered by a housing consisting of the top and bottom frames 14 and 15, being formed into a process cartridge which can be removably mountable into the apparatus main assembly 1. The top frame 14 is structured to hold the charging means 10 and exposing means 11, and is provided with a toner bin for the developing means 12, as shown in FIGS. 6 and 8, whereas the bottom frame 15 is structured to hold the photoconductive drum 9, the development roller 12*d* of the developing means 12, and the cleaning means 13, as shown in FIGS. 6 and 7. Next, the structures of the various portions of the process cartridge B will be described in detail, in the following order: the photoconductive drum 9, charging means IO, exposing means 11, developing means 12, and cleaning means 13.

(Photoconductive Drum) <Structure of Photoconductive Drum>

Figure 9:
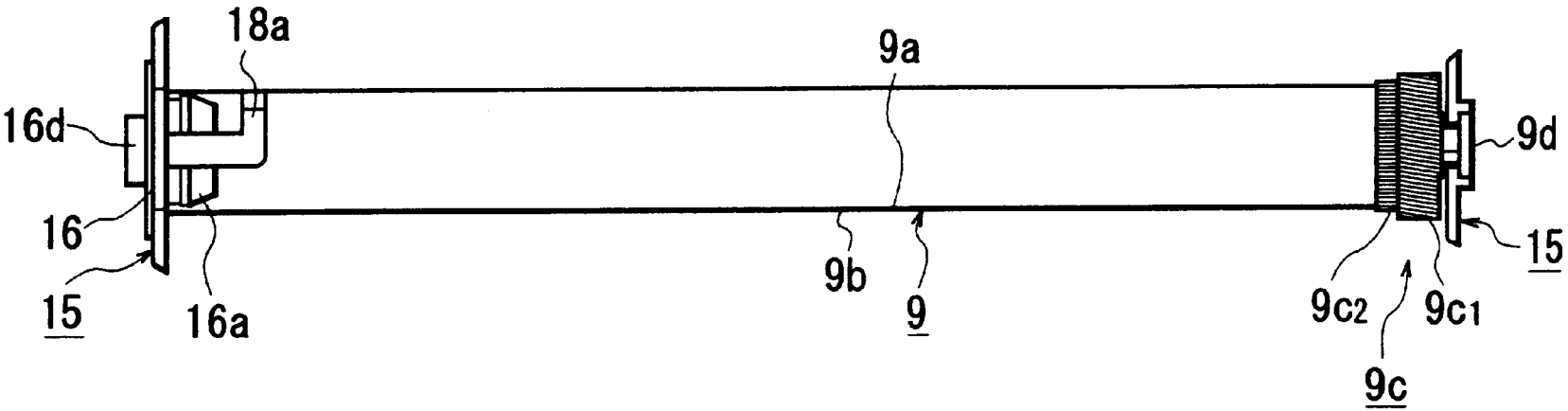
FIG. 9 is a longitudinal sectional view of a photosensitive drum.

Referring to FIG. 9, the photoconductive drum 9 in this embodiment comprises an electrically conductive base member 9*a*, which is an aluminum cylinder having a wall thickness of approximately 0.8 mm, and a layer 9*b* of organic semiconductor (OpC), as a photoconductive layer, coated on the peripheral surface of the base member 9*a*. The external diameter of the photoconductive drum 9 is 24 mm. The photoconductive drum 9 is structured so that the photoconductive drum 9 can be rotated in response to the progress of an image forming operation, by transmitting driving force from an unshown motor to a flange gear 9*c* fixed to one of the lengthwise ends of the photoconductive drum 9. The other lengthwise end of the photoconductive drum 9 is open. This open end of the photoconductive drum 9 is supported by a bearing portion 16*a* of a bearing member 16, which will be described later.

The flange gear 9*c*, which is solidly fixed to the left end (driven side) of the photoconductive drum 9, as seen from the upstream side with reference to the recording medium conveyance direction, has two gears: helical gear 9*c*1 on the outward side, and spur gear 9*c*2 on the inward side, which are disposed side by side. Incidentally, the two gears of the flange gear 9*c* are integrally formed of plastic by injection molding. As for the material for the flange gear 9*c*, in this embodiment, a slippery type of polyacetal is used. However, an ordinary type of polyacetal, or fluorinated polycarbonate, are also usable in addition to a slippery type of polycarbonate. The helical gear 9c1, or the outward gear, and the spur gear 9c2, or the inward gear, of the flange bear 9c, are different in diameter. In this embodiment, the diameter of the helical gear 9c1 on the outward side is greater than that of the spur gear 9c2 on the inward side. Further, the helical gear 9c1 is wider in width than the spur gear 9c2, and also, is greater in the number of teeth than the spur gear 9c2. Therefore, it is assured that even when the load to which the flange gear 9c is subjected is relatively large, the flange 9c satisfactorily rotates the photoconductive drum 9, while transmitting the driving force to the other gears meshed with the gear 9c, as driving force is transmitted to the flange gear 9c from the apparatus main assembly.

Referring to FIG. 9, in this embodiment, the photoconductive drum 9 is grounded by placing an electrically conductive ground contact 18*a* in contact with the internal surface of the photoconductive drum 9; the ground contact 18*a* is disposed so that it contacts the internal surface of the photoconductive drum 9 at the top, on the opposite end with respect to the end to which the flange gear 9*c* is solidly fixed. The ground contact 18*a* is formed of electrically conductive substance such as phosphor bronze, and is attached to the bearing member 16 which rotationally supports the non-driven end of the photoconductive drum 9.

Figure 10:
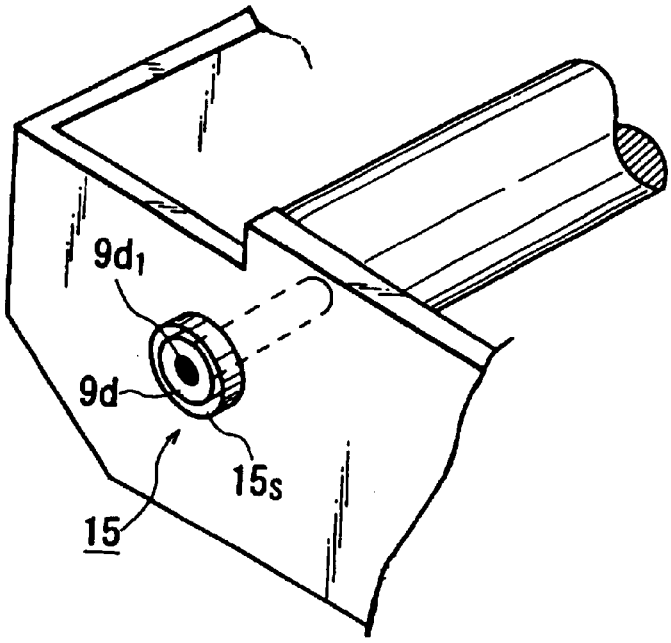
FIG. 10 is an enlarged perspective view of a major part in the neighborhood of a drum shaft.

Referring to FIG. 9, the driven end of the photoconductive drum 9 is rotationally supported by the drum supporting shaft 9*d*. The non-driven end of the photoconductive drum 9 is supported by the bearing portion 16*a* of the bearing member 16. Referring to FIG. 10, the drum supporting shaft 9*d* is first inserted, by a distance as long as 47 pm, through the shaft hole in hollow cylindrical portion or projection 15*s* of the bottom frame 15, in which the photoconductive drum 9 is disposed, and then, is inserted into the shaft hole of the flange gear 9*c* solidly affixed to the lengthwise end of the photoconductive drum 9, rotationally supporting the photoconductive drum 9. Since the drum supporting shaft 9*d* which rotationally supports the photoconductive drum 9 is pressed into the shaft hole in cylindrical portion or projection 15*s* of the bottom frame 15, the photoconductive drum 9 can be supported without screwing the drum shaft 9*d* to the bottom frame 15. Therefore, no screw hole is necessary for attaching the drum supporting shaft 9*d* to the bottom frame 15, eliminating the problem that when recycling the used process cartridges recovered from the users, the screw holes for attaching the drum supporting shaft 9*d* becomes too large to recycle the bottom frame 15. Further, the above described photoconductive drum supporting method offers benefits other than the above described one; for example, it reduces the play of the drum supporting shaft 9*d*, enabling the photoconductive drum 9 to be more smoothly rotated to produce an image of higher quality in terms of preciseness. The end surface (exposed from the process cartridge B) of one end of the drum supporting shaft 9*d* is provided with a female type screw hole 9*d*1, which makes it easier for the drum supporting shaft 9*d*, which had been attached by pressing to the bottom frame 15, to be removed from the bottom frame 15 when disassembling the process cartridge B for recycling. In this embodiment, the diameter of the drum supporting shaft 9*d* is 6 mm, and the diameter of the female type screw hole 9*d*1 is 3 mm. The material for the drum supporting shaft 9*d* may be metallic material or plastic. The female type screw hole 9*d*1 is parallel to the direction in which the drum supporting shaft 9*d* is inserted, and is located approximately at the center of the end surface of the drum supporting shaft 9*d*.

(Charging Means) <Structure of Charging Means;>

The charging means is for charging the peripheral surface of the photoconductive drum 9. In this embodiment, it employs the so-called contact charging method disclosed in Laid-open Japanese patent Application 63-149669. In other words, the charge roller 10 is rotationally supported by the internal surface of the top frame 14, with the interposition of a pair of plain bearings 10*c*, as shown in FIG. 3. This charge roller 10 comprises: a metallic roller shaft 10*b* (electrically conductive metallic core formed of steel, SUS, or the like); an elastic rubber layer formed of EPDM, NBR, or the like, which is coated on the peripheral surface of the metallic shaft 10*b*; and a layer of urethane rubber, in which carbon particles have been dispersed, and which is coated on the peripheral surface of the elastic rubber layer. The aforementioned plain bearings 10*c*, which rotationally support the charge roller 10 by the roller shaft 10*b*, are held to the top frame 14 by a pair of bearing slide guides 14*n* so that the bearings 10*c* do not disengage from the top frame 14 (FIG. 11(*a*)), while being allowed to slightly slide in the direction perpendicular to the axial line of the photoconductive drum 9 (FIG. 11(*b*)). Further, each plain bearing 10*c*, which rotationally supports the roller shaft 10*b*, is kept pressured toward the axial line of the photoconductive drum 9, by a spring 10*a*, so that the peripheral surface of the charge roller 10 is kept in contact with the peripheral surface of the photoconductive drum 9.

When forming an image, the peripheral surface of the photoconductive drum 9 is uniformly charged by applying an oscillating voltage, which is a combination of DC and AC voltages, to the charge roller 10 which is being rotated by the rotation of the photoconductive drum 9.

Figure 12:
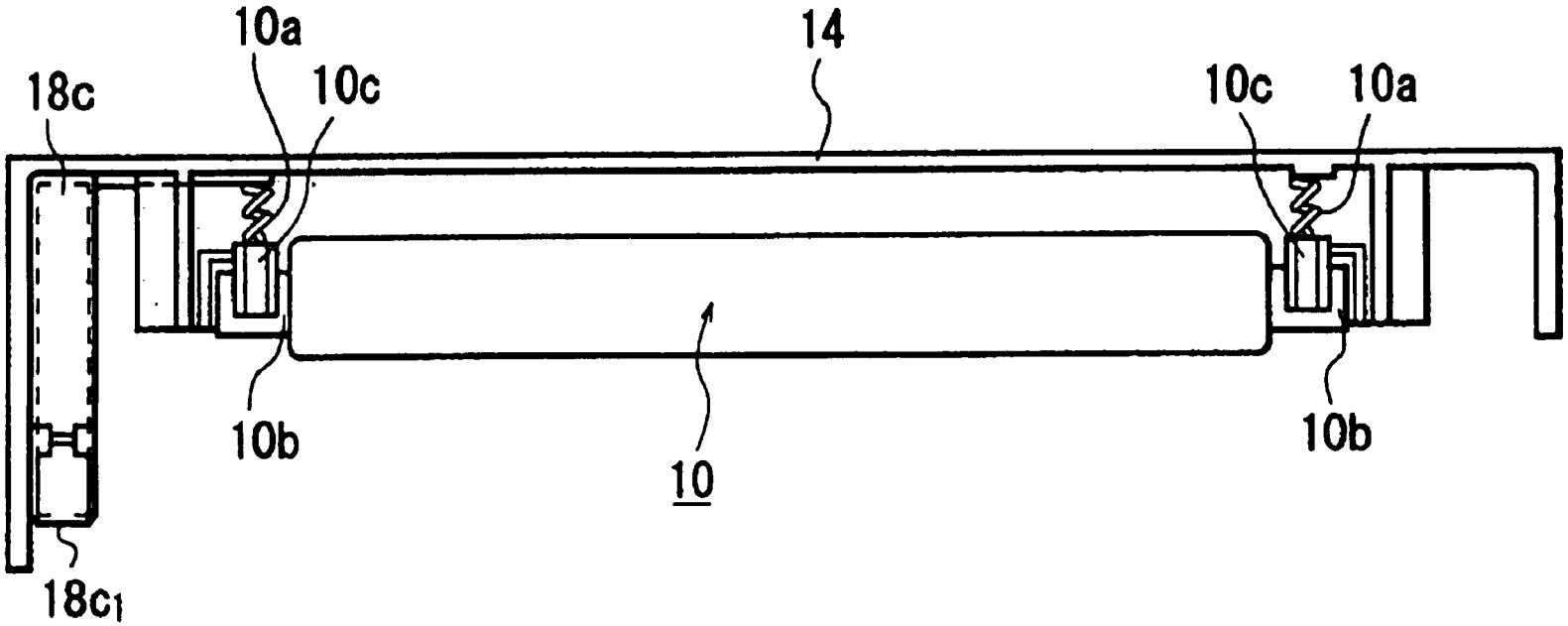
FIG. 12 is an enlarged side view of a major part of the charging roller.

Next, the path through which electrical power is supplied to the charge roller 10 will be described. Referring to FIG. 12, one end 18*c*1 of the electrically conductive charge bias contact 18*c* is kept pressed upon the electrically conductive charge bias contact pin on the apparatus main assembly side, and the other end of the charge bias contact 18*c* is placed in contact with the spring 10*a*, which is in contact with the plain bearing 10*c* which rotationally supports one end (power reception side) of the roller shaft 10*b*. The electrical power is supplied to the charge roller 10 from a power source on the apparatus main assembly side through the above described path. The plain bearing 10*c* which supports the power receiving end of the charge roller 10 is formed of the aforementioned material which contains a large amount of carbon filler, as described before, ensuring that charge bias is reliably applied to the charge roller 10 through the above described power supply path.

(Exposing Means)

The exposing means 11 is a means for exposing the peripheral surface of the photoconductive drum 9, which has been uniformly charged by the charge roller 10, to an optical image from the optical system 3. The top frame 14 is provided with an opening 11*a*, through which the laser light is reflected onto the photoconductive drum 9, as shown in FIGS. 1 and 3.

(Developing Means) <Structure of Developing Means>

Referring to FIG. 3, the developing means 12 for forming a toner image with the use of magnetic toner has the developer storage portion 12*a* as a toner bin for storing toner. It also has a toner conveying mechanism or member 12*b*, which is disposed within the developer storage portion 12*a* to send the toner out of the developer storage portion 12*a*. As the development roller 12*d* is rotated in the direction indicated by an arrow mark in the drawing, the portion of the toner, which has been sent out of the developer storage portion 12*a*, is coated on the peripheral surface of the development roller 12*d*, by a magnetic roll 12*c*, which is disposed within the hollow of the developer roller 12*d* and has a plurality of magnetic poles. As the development roller 12*d* is further rotated, the toner on the peripheral surface of the development roller 12*d* is formed into a thin layer of the toner. While the thin layer of the toner is formed on the peripheral surface of the development roller 12*d*, the toner particles are given a sufficient amount of electrical charge for developing the electrostatic latent image on the photoconductive drum 9, by the friction between the toner particles and developer roller 12*d*, and the friction between the toner particles and a development blade 12*e*. The development blade 12*e* is attached to the bottom frame 15, being kept pressed upon the peripheral surface of the development roller 12*d* with the application of a predetermined force, so that it rubs the toner particles which come between the development blade 12*e* and the peripheral surface of the development roller 12*d*.

The development blade 12*e* comprises a supporting member 12*e*1, and an actual blade portion pasted to the supporting member 12*e*1. The actual blade portion is formed by cutting a plate of flexible substance such as polyurethane rubber or silicon rubber. In order to ensure that the actual blade portion of the development blade 12*e* rubs the development roller 12*d* while generating a predetermined contact pressure, the supporting member 12*e*1 of the development blade 12*e* is fixed to the development blade seat of the bottom frame 15, with the use of screws 12*e*2, being accurately positioned relative to the development blade seat. Further, in order to prevent the development blade 12*e* from peeling from the supporting member 12*e*1 due to the passage of time, a reinforcing member 12*e*3 formed of metallic plate or the like is attached in a manner to sandwich the actual blade portion between itself and the supporting member 12*a*1.

Referring to FIG. 3, the toner conveying mechanism 12*b* comprises a shaft 12*b*3, an arm portion 12*b*2 enabled to be oscillated about the shaft 12*b*3, and a conveying member 12*b*1 connected to the arm portion 12*b*2. The toner is conveyed by reciprocally moving the conveying member 12*b*1 in the direction indicated by an arrow mark b along the bottom surface of the developer storage portion 12*a*. The arm portion 12*b*2 and shaft 12*b*3 are integrally formed of substance such as polypropylene (pp), acrylonitrile butadione styrene (ABS), high impact polystyrene (HIPS), or the like. In order to scrape the entirety of the bottom surface of the developer storage portion 12*a*, the conveying member 12*b*1 comprises a plurality of rod-like members, which are approximately triangular in cross section, and extend in parallel to the rotational axis of the photoconductive drum 9. These rod-like members are attached to each other by several points, forming a single conveying member.

The top opening of the developer storage portion 12*a* is covered with a lid 12*f*, which is welded to the edge of the opening. Referring to FIG. 3, the developer storage portion 12*a* is provided with a plurality of hanging plates or members 12*f*1, which hang from the inward surface of the lid 12*f*, leaving a gap between their bottom ends and the bottom surface of the toner bin. This gap is slightly greater than the height of the toner conveying member 12*b*1 from the bottom surface of the toner bin. The hanging plates 12*f*1 are approximately parallel to the plane of the surface of the FIG. 3. Therefore, the toner conveying member 12*b*1 is reciprocally moved through the gaps between the bottom surface of the developer storage portion 12*a* and the bottom ends of the hanging members 12*f*1, being prevented from lifting from the bottom surface of the developer storage portion 12*a*; the hanging members 12*f*1 prevent the floating of the toner conveying member 12*b*1.

<Driving Force Transmitting Means>

Figure 13:
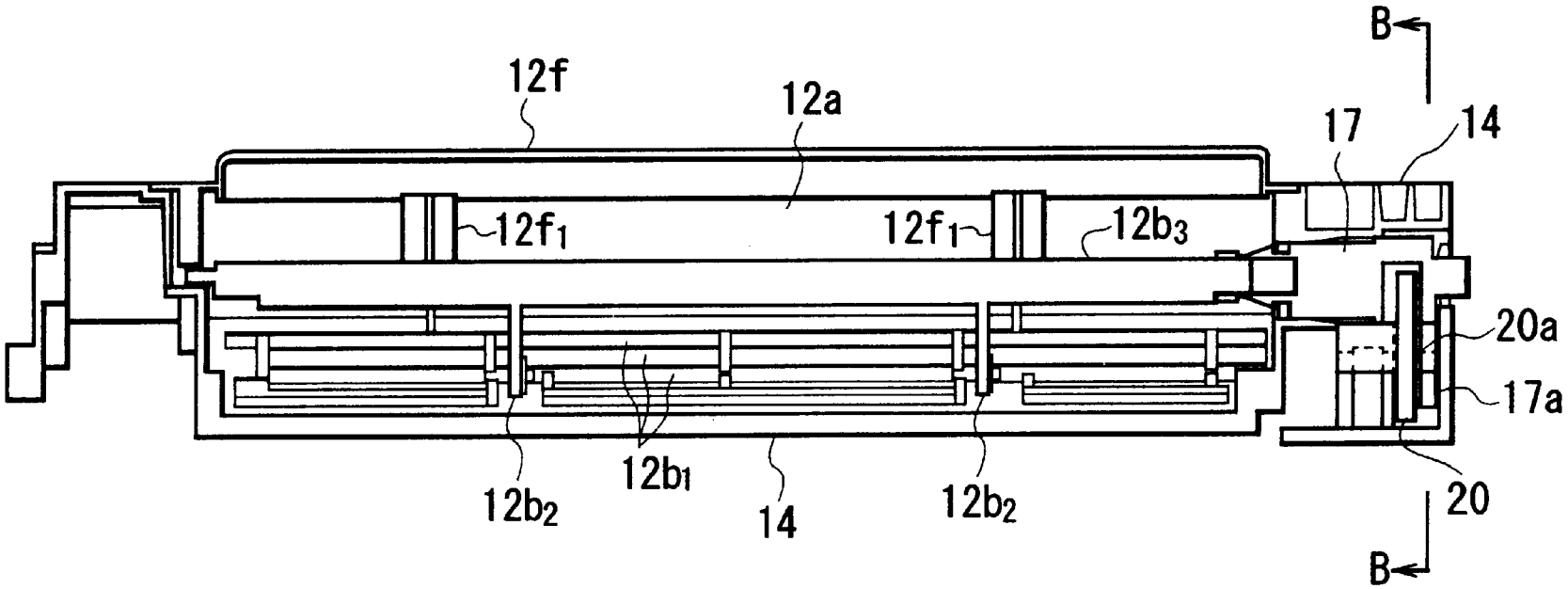
FIG. 13 is a sectional view taken along a line A—A in FIG. 3.
Figure 14:
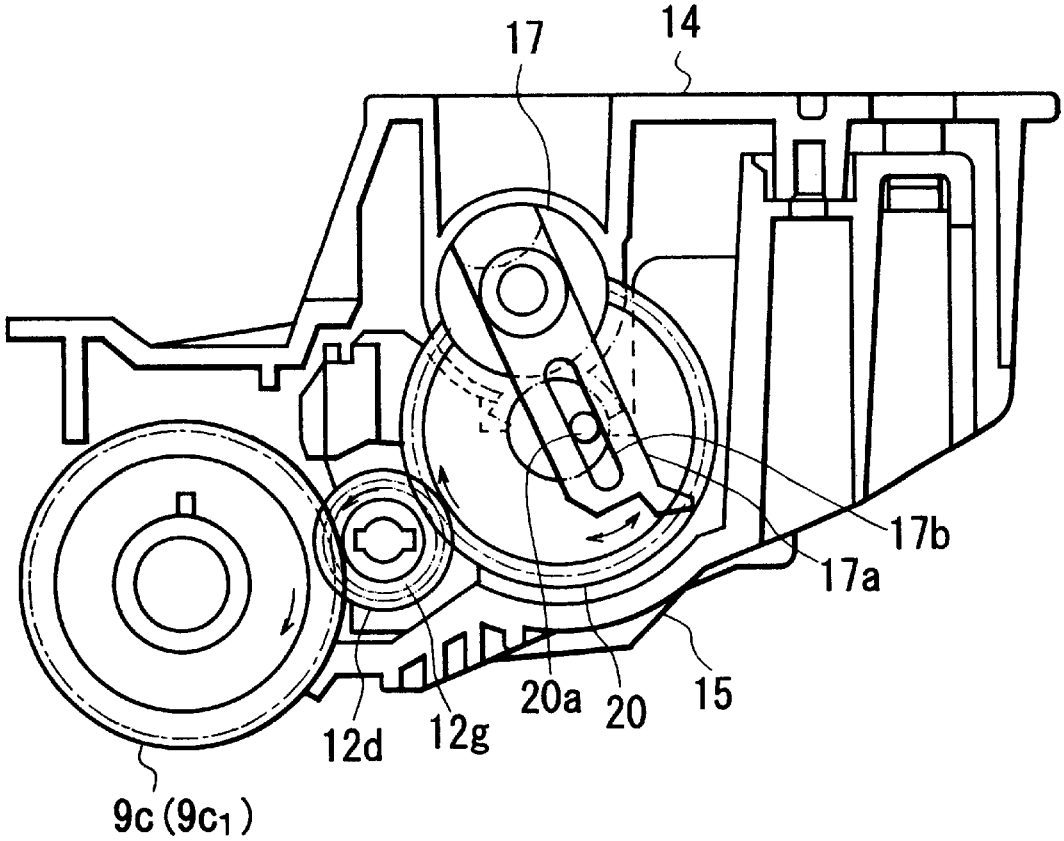
FIG. 14 is a sectional view taken along a line B—B in FIG. 3.

Next, referring to FIGS. 13 and 14, the driving force transmitting means for transmitting a driving force to the toner conveying mechanism 12*b* will be described. FIG. 13 is the cross section of the process cartridge B, at the plane A—A shown in FIG. 3, and FIG. 14 is the cross section of the process cartridge B, at the plane B—B shown in FIG. 13. Referring to FIG. 13, one end of the shaft 12*b*3, about which the toner conveying mechanism is oscillated, is connected to a driving force transmitting member 17, which is rotationally disposed through the lateral wall of the developer storage portion 12*a* of the top frame 14. The transmitting member 17 is formed of resinous substance such as polyacetal (POM) or polyamide, which is superior in slipperiness, and is attached to the top frame 14 by the so-called snap fitting. It is rotatable about the rotational axis of the shaft 12*b*3. On the other hand, the driving force transmitting means comprises the helical gear 9*c*1 of the flange gear 9*c* solidly attached to one end of the photoconductive drum 9, the development roller gear 12*g* of the development roller 12*d*, a stirring gear 20, a boss 20*a*, and the elongated hole 17*b* of the arm portion 17*a* of the driving force transmitting member 17, as shown in FIG. 14. The helical gear 9*c*1 is meshed with the development roller gear 12*g*, which is meshed with the stirring gear 20. The boss 20*a* is an integral part of the stirring gear 20, and is positioned a predetermined distance from the rotational axis of the stirring gear 20. It is fitted in the elongated hole 17*b*. With the provision of the above described structural arrangement, as the flange gear 9*c* is rotated in the direction indicated by an arrow mark in the drawing, the stirring gear 20 is rotated in the direction of the arrow mark, through the development roller gear 12*g*, and the transmitting member 17 is oscillated by the boss 20*a* of the stirring gear 20, in the direction indicated by a double-headed arrow mark in the drawing, transmitting the driving force to the shaft 12*b*3 connected to the transmitting member 17. As a result, the toner conveying member 12*b* is driven.

Figure 15:
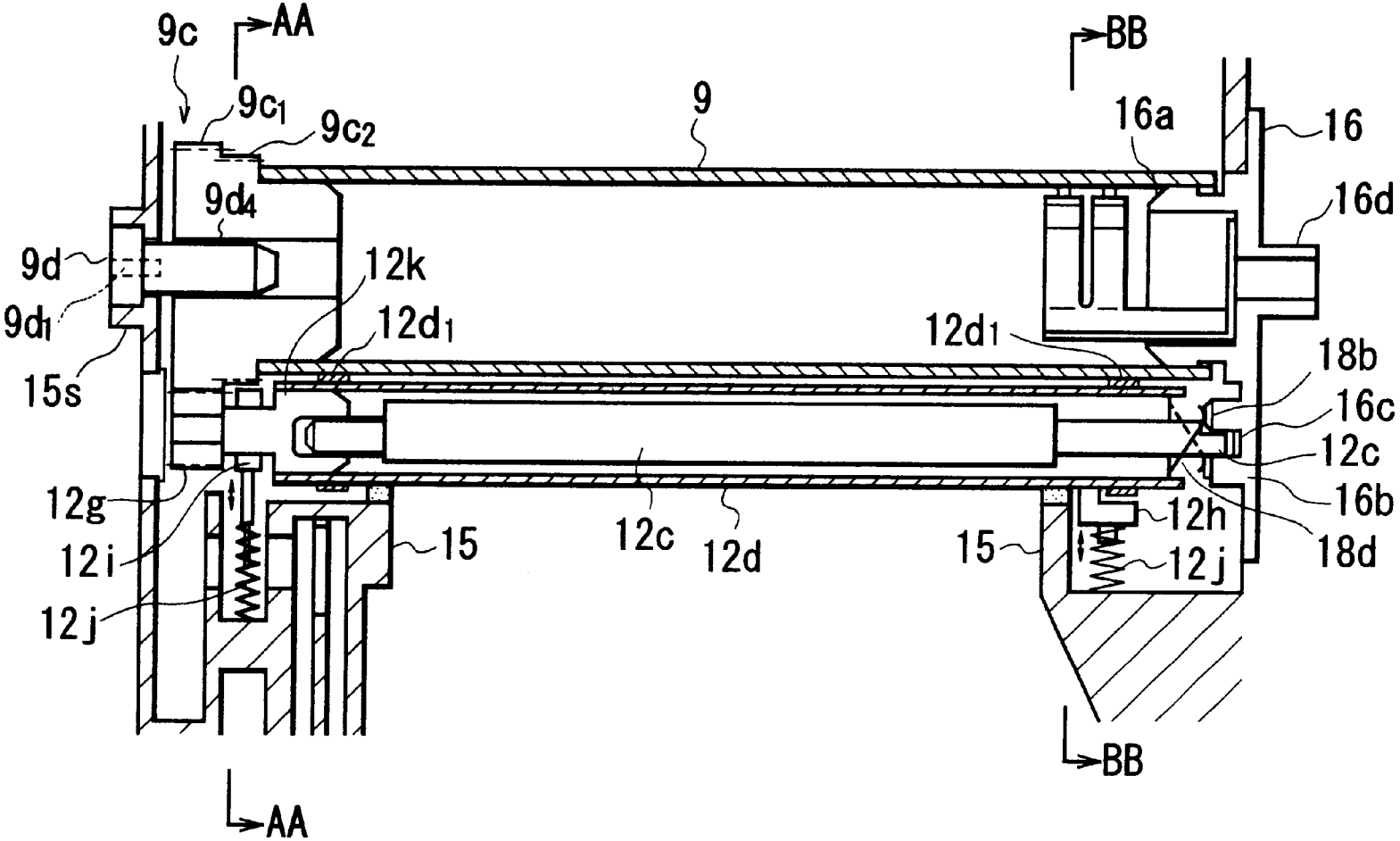
FIG. 15 is a cross-sectional view illustrating a positional relation between the photosensitive drum and the developing roller and illustrating a pressing method for the developing roller.
Figure 16:
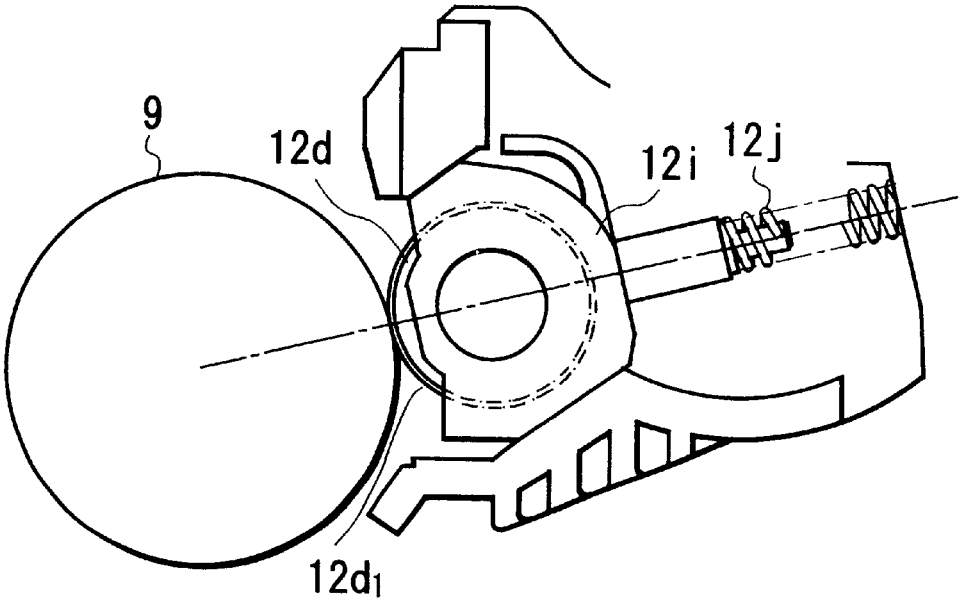
FIG. 16 is a longitudinal sectional view (a) taken along a line AA—AA in FIG. 15, and a longitudinal sectional view (b) taken along a line BB—BB in FIG. 15.
Figure 16:
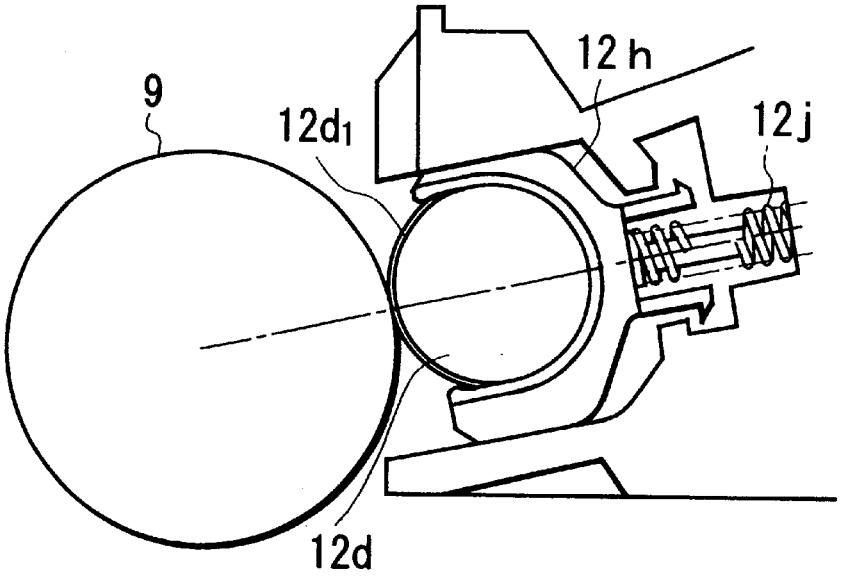

Next, the development roller 12*d* on which the toner layer is formed will be described. The development roller 12*d* and photoconductive drum 9 are positioned so that a microscopic gap (approximately 200 pm–300 pm) is provided between the peripheral surfaces of the two. Referring to FIG. 15, in order to maintain this gap, in this embodiment, the development roller 12*d* is provided with a pair of contact rings 12*d*1, which are fitted around the end portions, in terms of the axial direction of the development roller 12*d*, of the development roller 12*d*, and outside the toner layer formation range, and the external diameters of which are greater by the aforementioned gap than the external diameter of the development roller 12*d*. Thus, each contact ring 12*d*1 contacts the photoconductive drum 9, outside the latent image formation range of the photoconductive drum 9. At this time, the positional relationship between the photoconductive drum 9 and development roller 12*d* will be described. FIG. 15 is a sectional view of the photoconductive drum 9, development roller 12*d*, and their adjacencies. It shows the positional relationship between the photoconductive drum 9 and development roller 12*d*, and how the development roller 12*d* is kept pressed toward the photoconductive drum 9. FIGS. 16(*a*) and 16(*b*) are the vertical sectional views of the photoconductive drum 9, development roller 12*d*, and their adjacencies, at the planes AA—AA and BB—BB, respectively, in FIG. 15. Referring to FIG. 15, the development roller 12*d* on which the toner layer is formed, and the photoconductive drum 9, are positioned so that a microscopic gap (approximately 200 pm–400 pm) is provided between the peripheral surfaces of the development roller 12*d* and photoconductive drum 9. As described previously, the photoconductive drum 9 is provided with the flange gear 9*c*, which is solidly fixed to one of the lengthwise ends of the photoconductive drum 9. The flange gear 9*c* is provided with a shaft hole, about the axial line of which the photoconductive drum 9 is rotated. One of the lengthwise ends of the photoconductive drum 9 is rotationally supported by the drum supporting shaft 9*d*, which is inserted into the shaft hole of the flange gear 9*c*. The drum supporting shaft 9*d* is attached to the bottom frame 15 by being pressed into the shaft hole 15*s* of the bottom frame 15. As for the other lengthwise end of the photoconductive drum 9, it is rotationally supported by the bearing portion 16*a* of the bearing member 16 pressed into the bearing hole of the bottom frame 15 (FIG. 9). Also as described above, the development roller 12*d* is provided with the pair of contact rings 12*d*1, which are fitted around the end portions, in terms of the axial direction of the development roller 12*d*, of the development roller 12*d*, and outside the toner layer formation range, and the external diameters of which are greater by the aforementioned gap than the external diameter of the development roller 12*d*. Thus, each contact ring 12*d*1 contacts the photoconductive drum 9, outside the latent image formation range of the photoconductive drum 9. The development roller 12*d* is rotationally supported by a pair of development roller bearings 12*h* and 12*i*, by the adjacencies of the lengthwise ends, one for one. More specifically, in terms of the lengthwise direction of the development roller 12*d*, the development roller bearing 12*h*, or the bearing on the non-driven side, is positioned outside the toner formation range, and inside the corresponding contact ring 12*d*1, whereas the development roller bearing 12*i*, or the bearing on the driven side, is positioned outside the toner layer formation range, and outside the corresponding contact ring 12*d*1. The development roller bearings 12*h* and 12*i* are attached to the bottom frame 15 so that they are allowed to slightly slide in the direction indicated by an arrow mark in FIG. 15. In addition, they are provided with a projection which extends rearwards in terms of the process cartridge mounting direction, and a compression spring 12*j* is attached to this projection. Thus, the compression spring 12*j* is kept compressed between the projection and the wall of the bottom frame 15, and the resiliency of the spring 12*j* keeps the development roller 12*d* pressured toward the photoconductive drum 9. Consequently, the pair of contact rings 12*d*1 are kept in contact with the peripheral surface of the photoconductive drum 9, assuring that the predetermined microscopic gap is maintained between the peripheral surfaces of the development roller 12*d* and photoconductive drum 9, and that driving force is transmitted to the flange gear 9*c* of the photoconductive drum 9, and the development roller gear 12*g* of the development roller 12*d*, which is meshed with the helical gear 9*c*1 of the flange gear 9*c*.

(Cleaning Means) <Structure of Cleaning Means>

The cleaning means 13 is for removing the toner particles remaining on the photoconductive drum 9 after the toner image on the photoconductive drum 9 is transferred onto the recording medium by the transfer roller 6. Referring to FIG. 3, this cleaning means 13 comprises: a cleaning blade 13*a* for scraping away the toner particles remaining on the photoconductive drum 9, by contacting the peripheral surface of the photoconductive drum 9; a toner catching sheet 13*b*, which is located below the blade 13*a* to catch the toner particles scraped away from the photoconductive drum 9 by the blade 13*a*; and a toner bin 13*c* in which the toner particles caught by the toner catching sheet 13*b* are collected.

Referring to FIG. 3, the cleaning blade 13*a* is made up of an elastic member formed of polyurethane rubber (which is 60'—70' in JISA hardness scale), and a supporting member 13*a*1 to which the elastic member is integrally attached. The supporting member 13*a*1 is a piece of metallic plate, for example, a piece of cold rolled steel plate. The supporting member 13*a*1, which is a part of the cleaning blade 13*a*, is attached, with the use of screws or the like, to the cleaning blade attachment seat of the bottom frame 15 to which the photoconductive drum 9 is attached. The cleaning blade seat of the bottom frame 15 is precisely formed so that after the supporting member 13*a*1 of the cleaning blade 13*a* is attached to the seat, the functional edge of the blade 13*a* is kept pressed upon the peripheral surface of the photoconductive drum 9, with the presence of a predetermined contact pressure.

(Top and Bottom Frames)

Next, the top and bottom frames 14 and 15, which together constitute the housing portion of the process cartridge B, will be described. Referring to FIG. 6, in the bottom frame 15, the development roller 12*d* and development blade 12*e*, which are parts of the developing means 12, and the cleaning means 13, are disposed in addition to the photoconductive drum 9. On the other hand, in the top frame 14, the charge roller 10, and the developer storage portion 12*a* and toner conveying mechanism 12*b*, which are parts of the developing means 12, are disposed.

Figure 17:
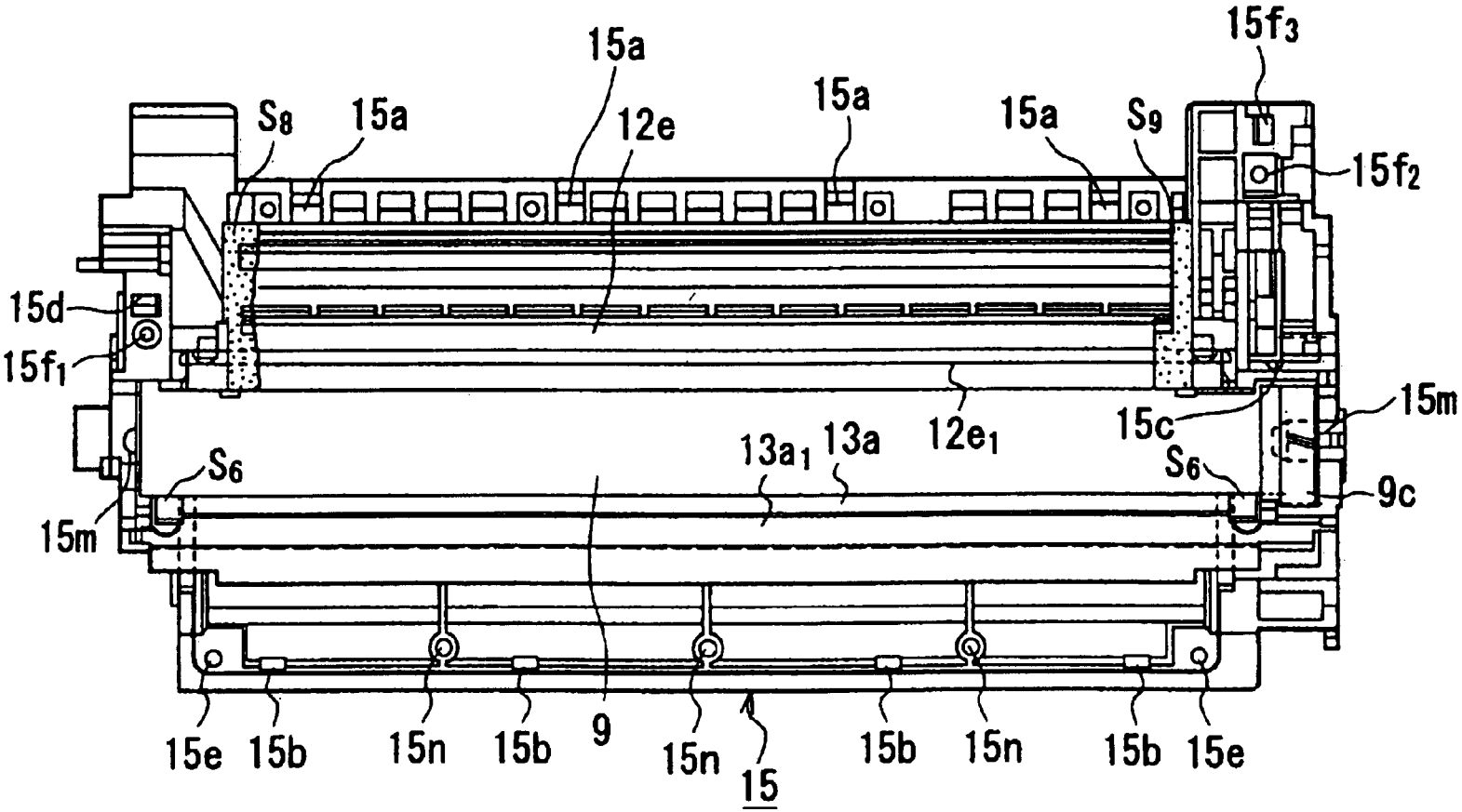
FIG. 17 is a top plan view of the inside of the lower frame member in FIG. 17.
Figure 18:
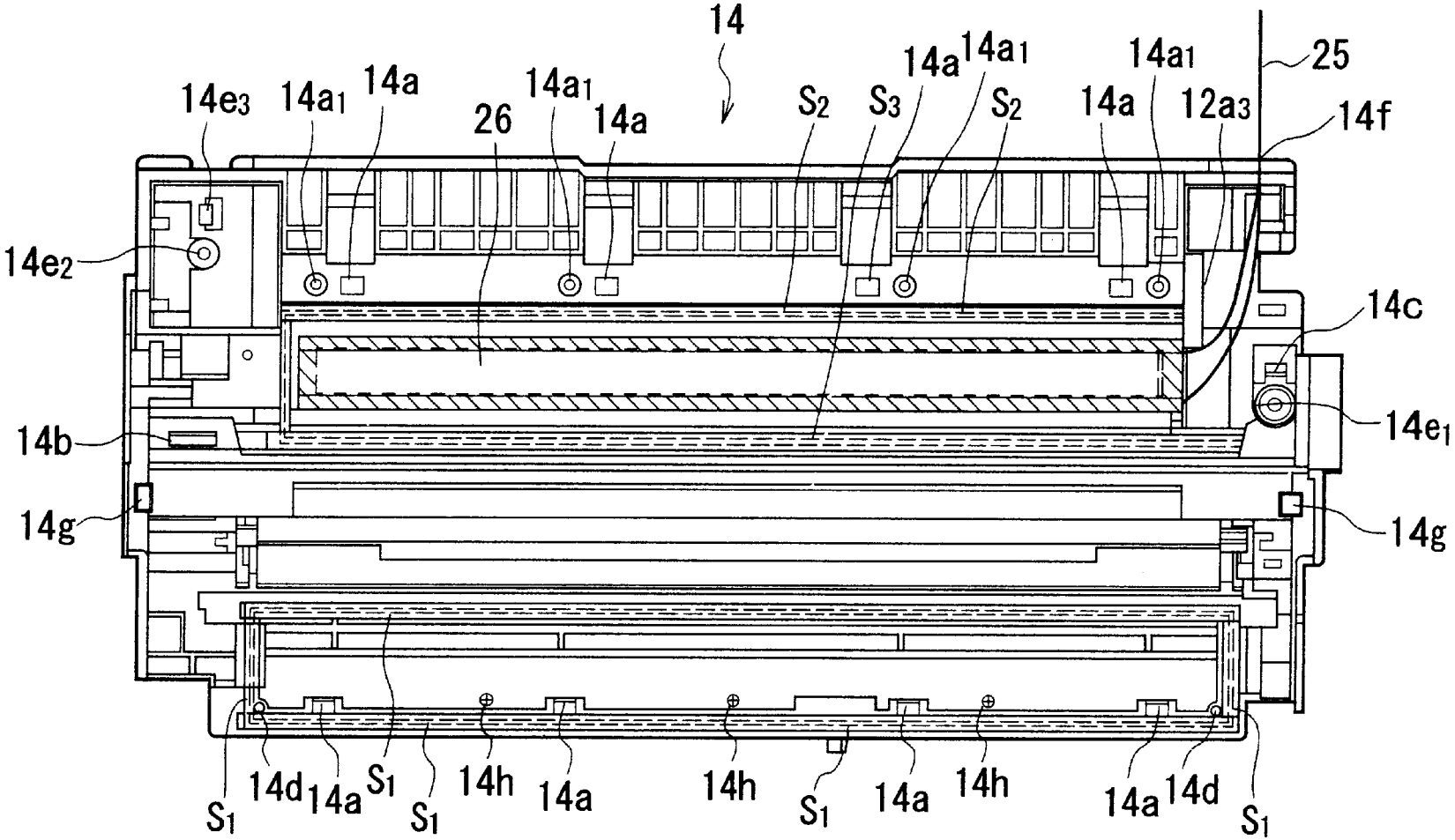
FIG. 18 is a top plan view of an inside of the upper frame.

(1) In order to attach the top and bottom frames 14 and 15 to each other, the top frame 14 is provided with four sets of fastening claws 14*a*, which are integral parts of the top frame 14, and are distributed in the lengthwise direction with the provision of approximately equal intervals, as shown in FIGS. 8 and 18. Each fastening claw 14*a* is in the form of a cantilever, and has an inverse tip. The bottom frame 15 is provided with a pluralily of combinations of fastening claw slots 15*a* and fastening claw catching projections 15*b*, as shown in FIGS. 7 and 17, on which the fastening claws 14*a* latch, one for one. The fastening claw slots 15*a* and projections 15*b* are integral parts of the bottom frame 15. The fastening projections 15*b* extend in the lengthwise direction of the process cartridge B. Thus, as the top and bottom frames 14 and 15 are pressed upon each other after being aligned with each other, the fastening claws 14*a* latch into, or on, the fastening claw slots 15*a* or fastening projections 15*b*, respectively, and keep the top and bottom frames 14 and 15 attached to each other. Incidentally, the fastening claws 14*a* elastically latch into the slots 15*a*. Therefore, they can be unlatched from each other to separate the top and bottom frames 14 and 15.

(2) In order to assure that the top and bottom frames remain attached to each other, the bottom frame 15 is provided with a fastening claw 15*c* and a fastening claw slot 15*d*, which are located, one for one, in the adjacencies of the lengthwise ends of the bottom frame 15, as shown in FIGS. 7 and 17, whereas the top frame 14 is provided with a fastening claw slot 14*b* and a fastening claw 14*c*, which are located, one for one, in the adjacencies of the lengthwise ends of the top frame 14, as shown in FIGS. 8 and 18, to be engaged with the fastening claw 15*c* and fastening claw slot 15*d*, respectively, of the bottom frame 15.

(3) Further, the bottom frame 15, to which the photoconductive drum 9 is attached, is provided with a pair of positioning projections 15*m*, which are located in the adjacencies of the lengthwise ends of the bottom frame 15, one for one, as shown in FIGS. 7 and 17. Referring to FIG. 4, each of these positioning projections 15*m* penetrates upward through the corresponding through hole 14*g* of the top frame 14, as the top and bottom frames 14 and 15 are attached to each other.

As described above, the process cartridge B is configured so that the various internal components of the process cartridge B are divided into two groups: a group which is disposed in the top frame 14, and a group which is disposed in the bottom frame 15. More specifically, such members as the development roller 12*d*, development blade 12*e*, cleaning blade 13*a*, and the like, which need to be precisely positioned relative to the photoconductive drum 9, are disposed in the same frame (bottom frame 15 in this embodiment). Therefore, these members can be precisely positioned relative to each other, as well as relative to the photoconductive drum 9. As a result, it becomes easier to assemble the process cartridge B.

(4) Further, the bottom frame 15 in this embodiment is provided with a plurality of frame alignment recesses 15*n*, which are disposed, with predetermined intervals, along one of the edges of the bottom frame 15 parallel to the lengthwise direction of the process cartridge B, as shown in FIGS. 7 and 17 whereas the top frame 14 is provided with a plurality of frame alignment projections 14*h*, as shown in FIGS. 8 and 18, which are disposed along one of the edges of the top frame 14, corresponding to the edges of the bottom frame 15 along which the plurality of frame alignment recesses 15*n* are disposed. Each frame alignment projection 14*h* is approximately in the middle of each interval of the fastening claws 14*a*, one for one, and engages into the corresponding frame alignment recess 15*n*.

(5) The bottom frame 15 in this embodiment is also provided with a pair of frame alignment recesses 15*e*, a frame alignment projection 15*f*1, and a frame alignment recess 15*f*2, which are located approximately in the adjacencies of the four corners, one for one, of the bottom frame 15, which is virtually rectangular as seen above, as shown in FIGS. 7 and 17, whereas the top frame 14 is provided with a pair of frame alignment projections 14*d*, a frame alignment recess 14*e*1, and a frame alignment projection 14*e*2, which are located approximately in the adjacencies of the four corners, one for one, of the top frame 14, as shown in FIGS. 8 and 18, which engage with the pair of frame alignment recesses 15*e*, the frame alignment projection 15*f*1, and frame alignment recess 15*f*2, of the bottom frame 15, correspondingly.

Further, the bottom frame 15 is provided with a fastening claw slot 15*f*3, which is in the adjacencies of the frame alignment recess 15*f*2 of the bottom frame 15, whereas the bottom frame 14 is provided with a fastening claw 14*e*3, which is in the adjacencies of the frame alignment projection 14*e*2, and engages into the fastening claw slot 15*f*3 of the bottom frame 15.

Thus, when the top and bottom frames 14 and 15 are attached to each other, the frame alignment projections 14*h* (4), 14*d* (5), 14*e*2 and 15*f*1 (5), of the top and bottom frames 14 and 15, fit into the frame alignment recesses 15*n* (4), 15*e* (5), 15*f*2 (5), 14*e*1 (5) of the bottom and top frames 15 and 14, one for one, and fastening claw 14*e*3 (5) is engaged into the frame alignment slot 15*f*3, in addition to the engagement between the frame fastening means of the top and bottom frames 14 and 15 listed in paragraphs (1) and (2). Therefore, the top and bottom frames 14 and 15 are attached to each other so firmly that even if the top frame 14 and/or bottom frame 15 are subjected to torsional force after they are attached to each other, they do not disengage from each other. Incidentally, the positions of these frame alignment projections, frame alignment recesses, fastening claws, and fastening claw slots, and their mutual relationship, do not need to be as described above; their positions and mutual relationship do not matter as long as the mutually attached top and bottom frames 14 and 15 are prevented from being dislodged from each other, by the torsional force to which the frame 14 and/or frame 15 are subjected. Further, the top frame 14 is provided with a drum shutter mechanism 24, which protects the photoconductive drum 9 from external light and/or foreign substances such as dust, when the process cartridge B is outside the image forming apparatus A.

(Drum Shutter Mechanism)

Figure 11:
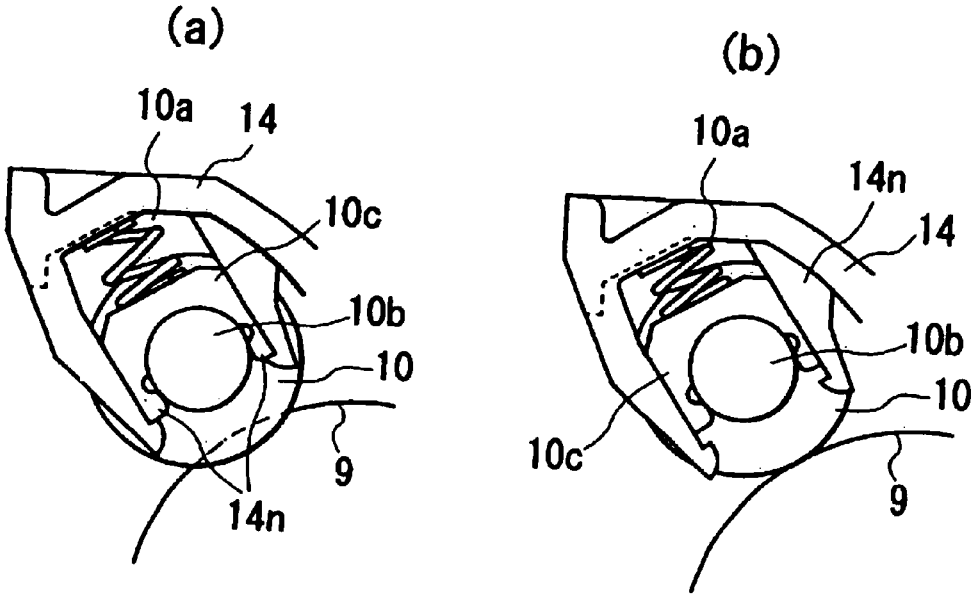
FIG. 11 is an enlarged side view of a major part in the neighborhood of a charging roller.
Figure 19:
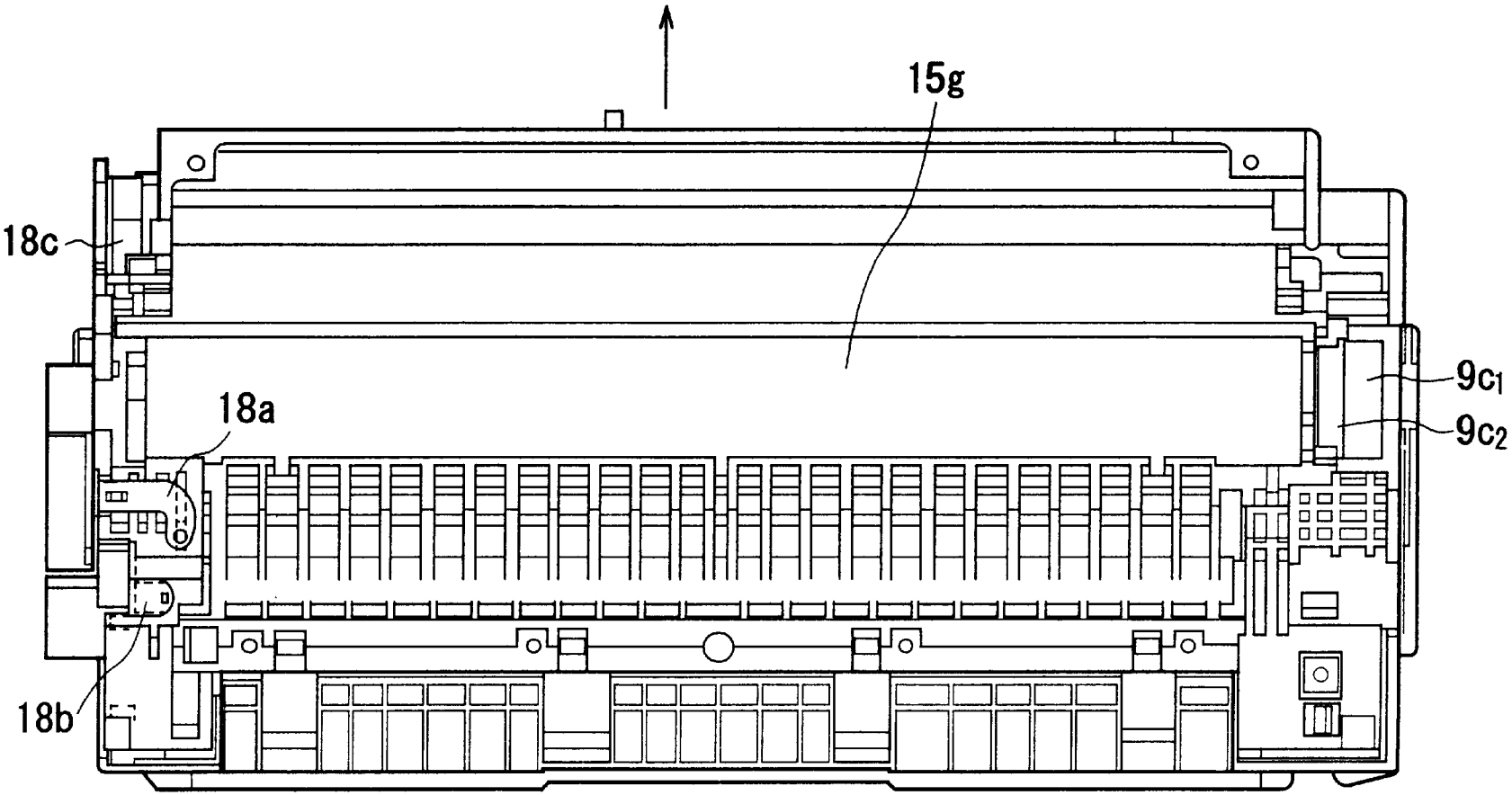
FIG. 19 is a bottom view of an outside of the process cartridge.

In order to transfer development toner onto recording medium, the bottom frame 15 is provided with an opening 15*g* (FIG. 19), through which the photoconductive drum 9 is exposed to the transfer roller 6, which is disposed so that its peripheral surface opposes the peripheral surface of the photoconductive drum 9. Thus, without some type of a cover for the opening 15*g*, when the process cartridge B is out of the image forming apparatus A, the photoconductive drum 9 remains exposed to the external ambience. As a result, the photoconductive drum 9 is exposed to the ambient light, and/or dusts or the like, which tend to adhere to the photoconductive drum 9. Further, the exposure of the photoconductive drum 9 to the ambient light deteriorates the photoconductive drum 9. Therefore, the process cartridge B in this embodiment is provided with the drum shutter mechanism 24, which protects the portion of the photoconductive drum 9, which would be exposed to the ambient light, dusts, and/or the like, when the process cartridge B is out of the image forming apparatus A. Referring to FIG. 11, the drum shutter mechanism 24 has a shutter portion 24*c*, which is enabled to assume a position, in which it covers the aforementioned opening 15*g*, and another position, in which it exposes the opening 15*g*. The shutter portion 24*c* is attached to the top frame 14, with the interposition of a linkage mechanism 24*b*, and is kept under the pressure generated by a helical torsion spring 24*a* in the direction to keep the shutter portion 24*c* closed. As the process cartridge B is mounted into the cartridge mounting portion 2 of the image forming apparatus A, the shutter portion 24*c* is prevented from advancing into the cartridge mounting portion 2, being therefore left behind the opening 15*g*. Consequently, the opening 15*g* is exposed. On the other hand, as the process cartridge B is dismounted, the shutter portion 24*c* under the pressure from the helical torsion spring 24*a* covers the opening 15*g*.

(Structure and Assembly of Process Cartridge)

Next, the assembly of the process cartridge B designed as described above will be described in detail with reference to the drawings.

(Attachment of Members Belonging to Bottom Frame)

Figure 20:
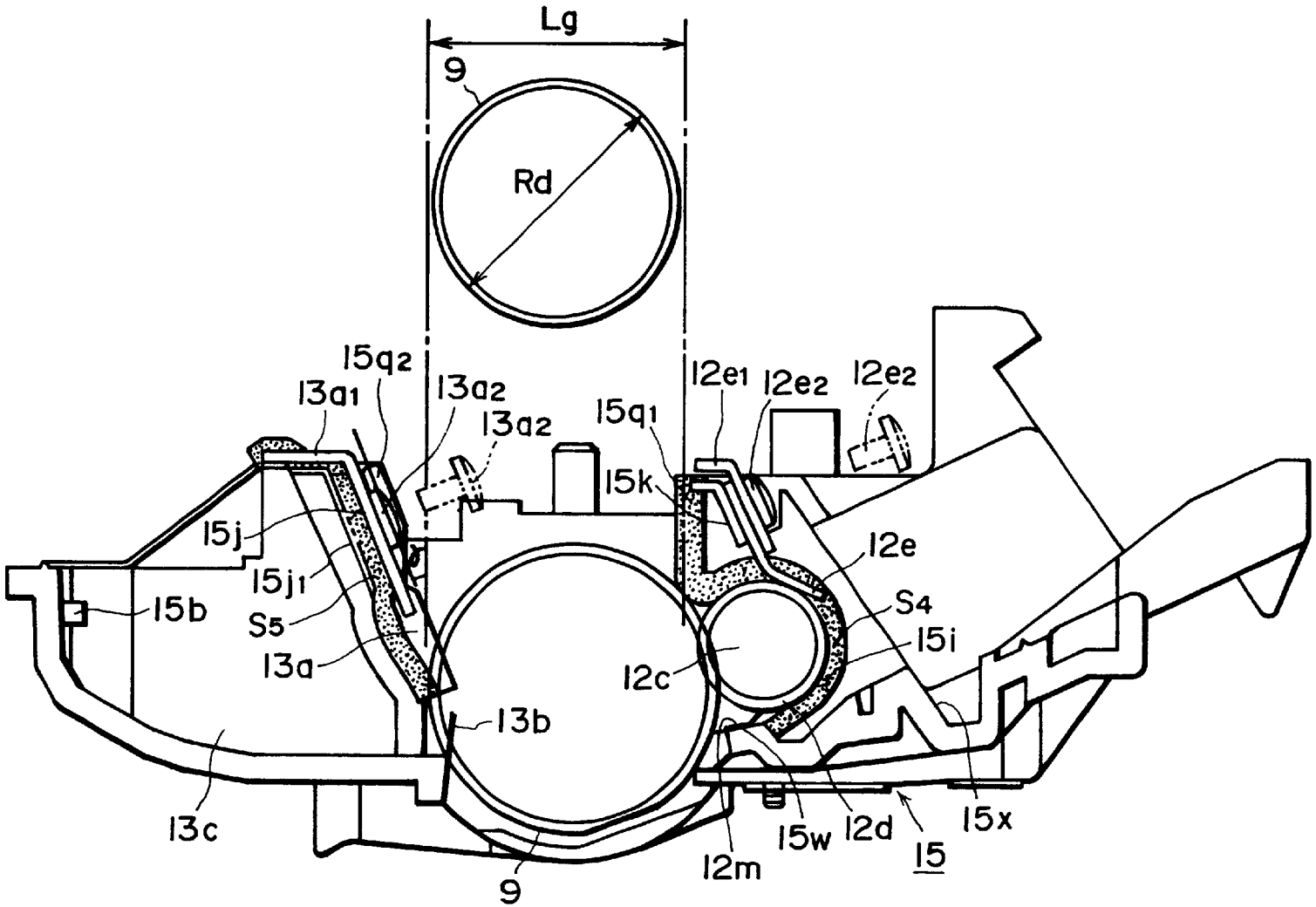
FIG. 20 is a longitudinal sectional view for describing assembling the photosensitive drum into the unit at the final stage.

Referring to FIG. 20, first, development roller end seals S4 and cleaning blade back seal S5, which are for preventing toner leak, are pasted to the development roller seal seats 15*i* of the bottom frame 15, and the stepped portions 15*j*1 of the cleaning blade attachment seats 15*j* of the bottom frame 15, respectively, with the use of double-sided adhesive tape. The stepped portions 15*j*1 are on the outward sides of the cleaning blade attachment seats 15*j*, in terms of the lengthwise direction of the process cartridge B. These seals S4 and S5 are in predetermined forms, and are formed of foamed polyurethane or the like. In this embodiment, the development roller end seals S4, which are pasted to the development roller seal seats 15*i* are formed of felt, whereas the cleaning blade back seals S5, which are pasted to the stepped portions 15*j*1 of the cleaning blade attachment seats 15*j*, are formed of foamed polyurethane. Incidentally, the development roller end seals S4 and cleaning blade back seals S5 for toner leak prevention, do not need to be in the predetermined forms. Instead, liquid substance, which solidifies into elastomer, may be poured into the recesses formed in the above described portions of the frame, in order to form the toner leak prevention seals S4 and S5 and attach them to the above described portions of the frame.

Next, a "blow-by" prevention seal sheet 12*m* as a seal for sealing between the development roller 12*d* and bottom frame 15, across the entire range between the left and right development roller end seals S4, is pasted along the edge portion 15*w* of the bottom frame 15, which will be below the development roller 12*d* after the assembly, as shown in FIG. 20. The blow-by prevention sheet 12*m* is similar to the toner catching sheet 13*b* described previously, and is a piece of thin plate formed of flexible substance such as PET. One edge of the blow-by prevention sheet 12*m*, in terms of the width direction of the process cartridge B, is pasted to the bottom frame 15 with the use of pasting means such as double-side adhesive tape, and the other edge is elastically placed in contact with the peripheral surface of the development roller 12*d*.

Figure 21:
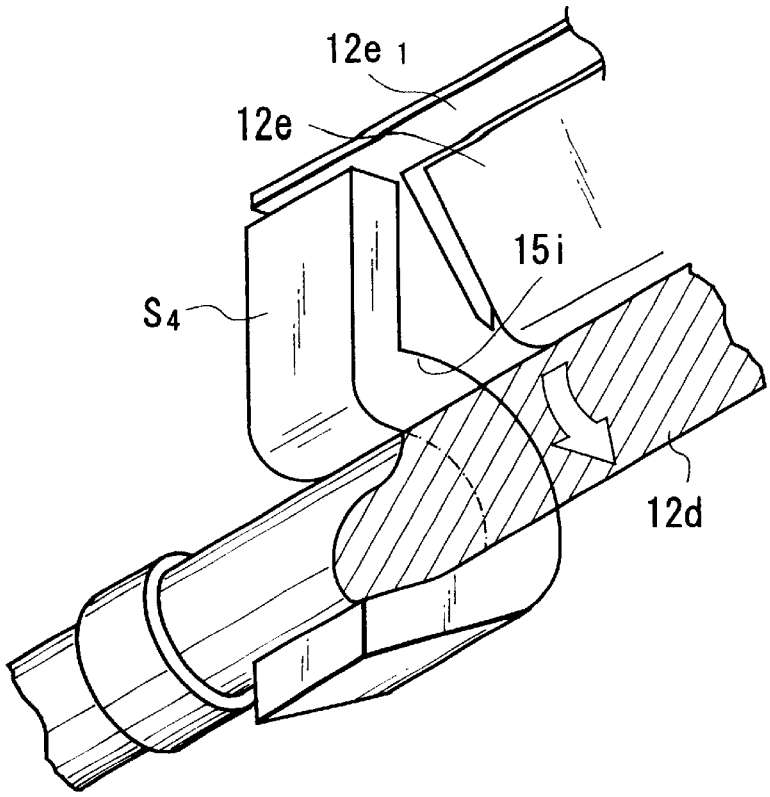
FIG. 21 is a perspective view illustrating a state of toner deposition at an end of the developing roller.
Figure 22:
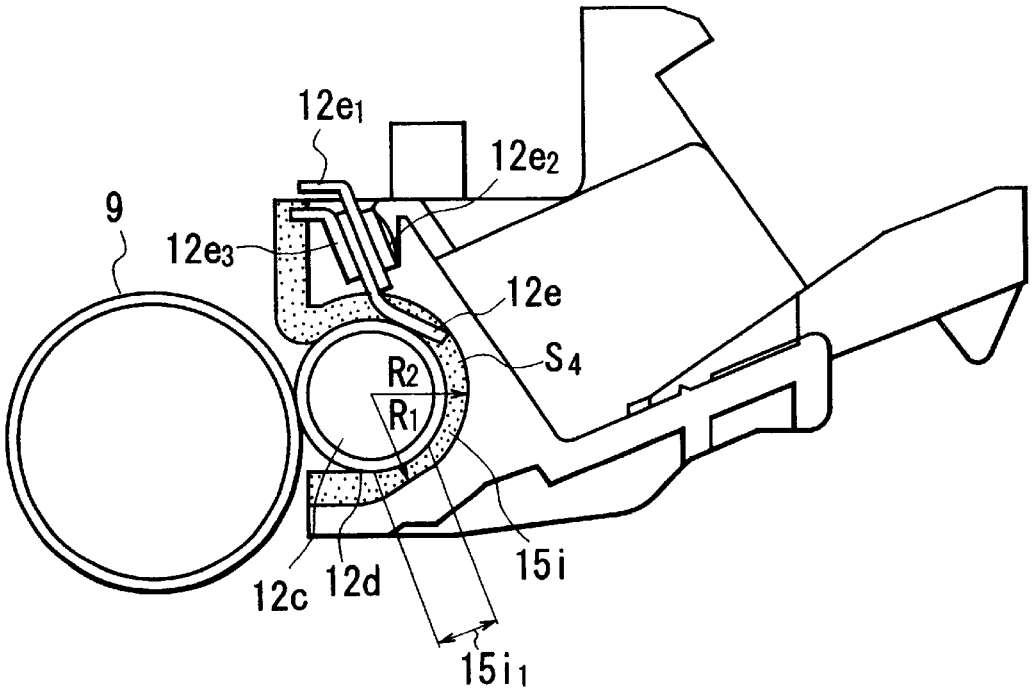
FIG. 22 is a longitudinal sectional view illustrating the state of molding of a developing roller mounting seat.

Next, the development roller 12*d* is attached to the bottom frame 15, to which the development roller end seals S4 have been pasted. Referring to FIG. 21, toner is borne on the peripheral surface of the development roller 12*d*, across the hatched area, due to the relationship between the rotational direction (direction indicated by an arrow mark in drawing) of the development roller 12*d*, and the magnetic poles of the magnetic roll 12*c* inside the development roller 12*d*. Therefore, the sealing performance of each development roller end seal S4 for preventing toner from leaking from the ends of the development roller 12*d* as described above, must be the highest across its bottom portion 15*i*l shown in FIG. 22. Therefore, the bottom frame 15 is molded so that the radius R1, with respect to the axial line of the development roller 12*d*, of the portion of each development roller seal seat 15*i*, which corresponds to the bottom portion 15*i*1 of the development roller end seal S4, becomes smaller than the radius R2 of the other portion of each development roller seal seat 15*i*; R1<R2. Thus, as the development roller 12*d* is attached to the bottom frame 15, with the interposition of the bearings 12*h* and 12*i*, the portion of the development roller end seal S4, which corresponds to the bottom portion 15*i*1 of the development roller seal seat 15*i*, is compressed more, generating thereby higher sealing pressure, in other words, providing better sealing performance, than the other portion of the development roller end seal S4. In this embodiment, the development roller seal seat 15*i* is positioned so that the portion of the development roller end seal S4 corresponding to the bottom portion 15*i*1 of the development seal seat 15*i* is compressed more by approximately 0.4 mm than the rest of the seal S4.

Next, the supporting member 12*e*1, in the form of a blade supporting metallic plate to which the development blade 12*e* has been attached, and the supporting member 13*a*1, in the form of a blade supporting metallic plate, to which the cleaning blade 13*a* has been attached, are attached to the blade attachment seats 15*k* and 15*j* of the bottom frame 15, with the use of the screws 12*e*2 and 13*a*2, respectively. In this embodiment, in order to allow the screws 12*e*2 and 13*a*2 to be screwed from the same directions, the planes of the surfaces of the blade attachment seats 15*k* and 15*i* to which the blade supporting metallic plates 12*e*1 and 13*a*1 are attached, are rendered approximately parallel to each other, as indicated by the broken lines in FIG. 20. Therefore, when the process cartridge B is mass-produced, the process for attaching the development blade 12*e* and cleaning blade 13*a* with the use of screws can be automatically and continuously carried out. Further, this structural arrangement makes it easier to secure the spaces for screwdrivers or the like for turning the screws, and allows the directions in which the metallic molds for forming the housing (frames) of the process cartridge B, to be made the same. In other words, this structural arrangement makes it possible to simplify the mold structure to reduce the cost of the process cartridge B.

Figure 23:
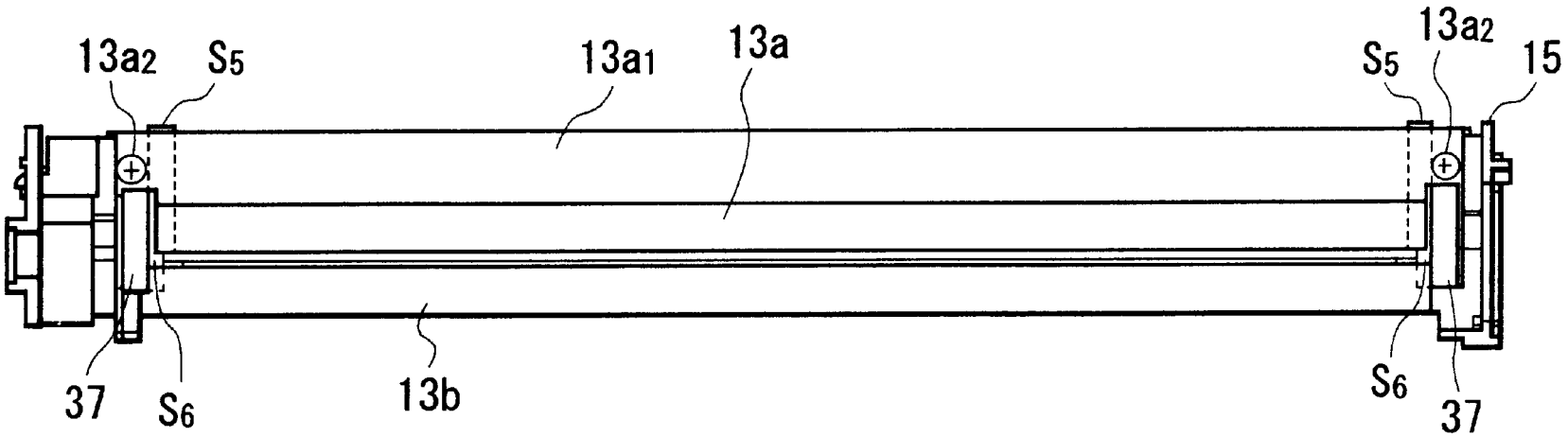
FIG. 23 is a front view as seen in a direction perpendicular to the longitudinal direction, illustrating a state of sealing member at a cleaning blade end.
Figure 24:
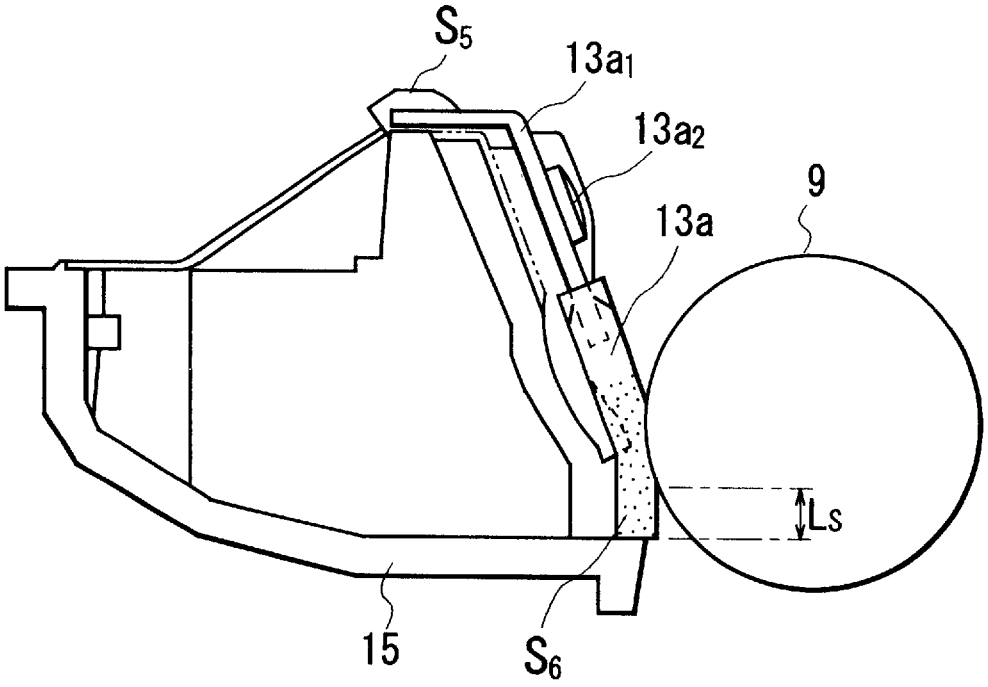
FIG. 24 is a longitudinal sectional view illustrating a relation between the sealing member at the cleaning blade end and the photosensitive drum.

Next, a cleaning blade end seal S6 formed of foamed polyurethane or the like is pasted to the bottom portion of each blade attachment seat 15*j*, the position of which corresponds to the lengthwise end of the cleaning blade 13*a*, as shown in FIG. 23. This seal S6 is a seal for preventing the toner particles having been scraped off by the cleaning blade 13*a*, from leaking from the lengthwise ends of the blade 13*a* after traveling on the blade 13*a* in the lengthwise direction. Referring to FIG. 24, if the distance Ls between the bottom corner of the cleaning blade end seal S6, and the bottom edge of the interface between the photoconductive drum 9 and cleaning blade end seal S6, is reduced (to no more than 0.5 mm) by an attempt to reduce the process cartridge size, it is possible that the cleaning blade end seal S6 is pulled into the juncture between the photoconductive drum 9 and cleaning blade end seal S6, by the torque and/or vibrations of the photoconductive drum 9. It is also possible that as the cumulative usage of the process cartridge B increases, the cleaning blade end seal S6 is peeled by the torque and/or vibrations of the photoconductive drum 9. Thus, in this embodiment, in order to prevent the cleaning blade end seal S6 from being pulled into the above described juncture, by reducing the friction between the peripheral surface of the photoconductive drum 9 and cleaning blade end seal S6, the cleaning blade end seal S6 is covered with a piece of high density polyethylene sheet 37, which is pasted to the surface of the cleaning blade end seal S6.

Figure 25:
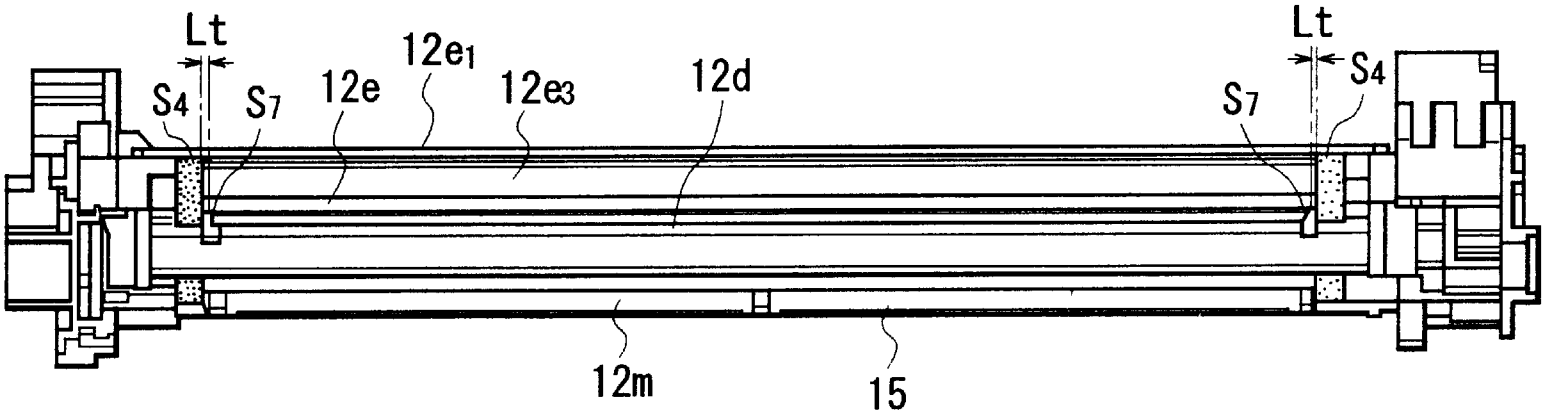
FIG. 25 is a front view illustrating a state of a sealing member at the developing blade end.
Figure 26:
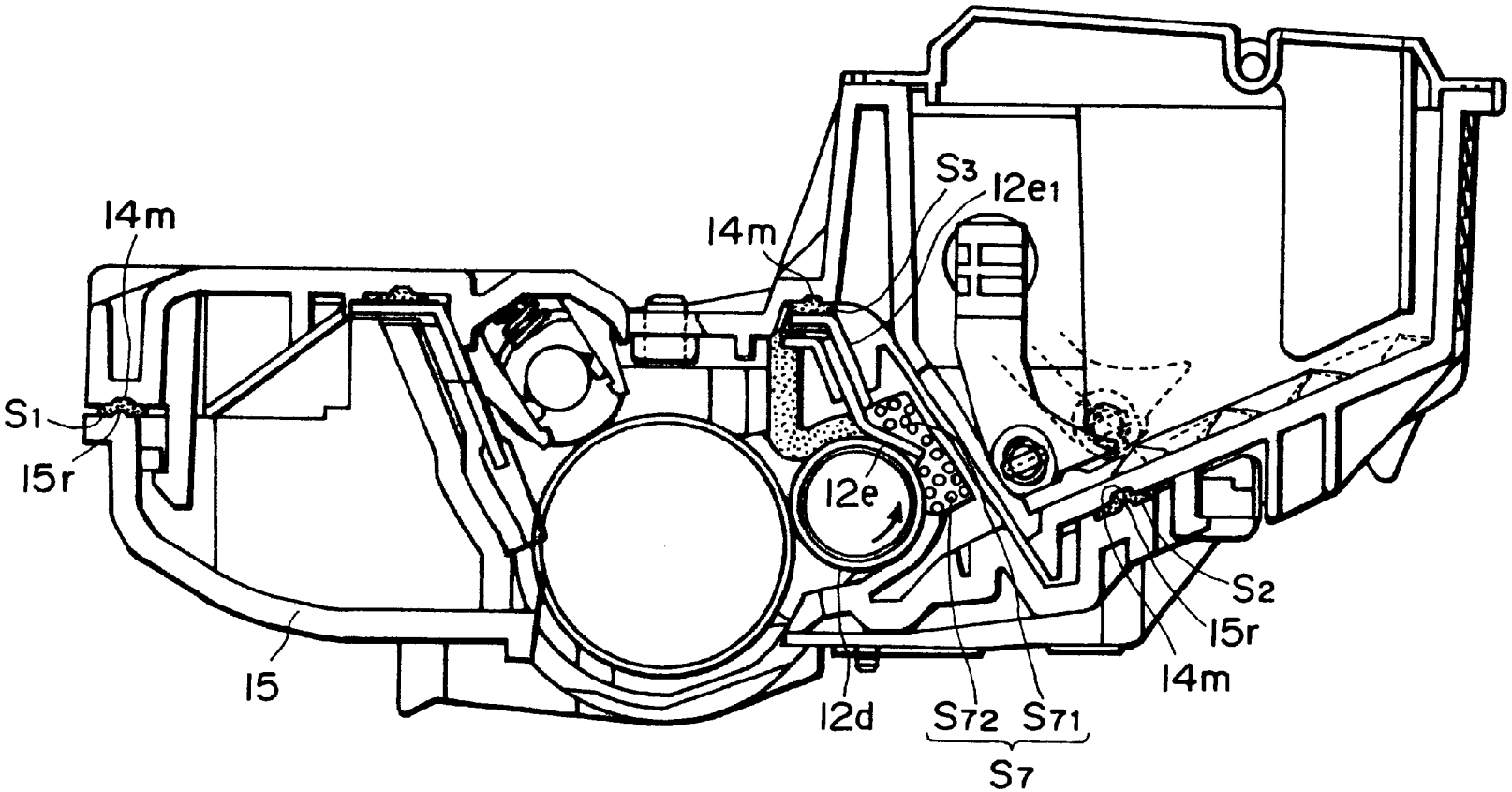
FIG. 26 is a longitudinal sectional view of a process cartridge for illustrating a configuration of a sealing member at the developing blade end.

Next, a pair of auxiliary development roller end seals S7 are pasted to both lengthwise ends of the development blade 12*e*, one for one, as shown in FIG. 25. These auxiliary development roller end seals S7 prevent toner from leaking through gaps Lt between the lengthwise ends of the development blade 12*e* and the bottom frame 15 (end surface of each development roller end seal S4 in FIG. 25), and also, scrape down the toner layers which form on the development roller 12*d*, across the ranges corresponding to the gaps Lt. Referring to FIG. 26, each auxiliary development roller end seal S7 is pasted to the bottom frame 15 by the lateral surface so that the surface by which it is not pasted is placed in contact with the development blade 12*e* (rubber portion) and development roller 12*d*, across the range in which the development blade 12*e* will be in contact with the development roller 12*d*. The auxiliary development roller end seal S7 is given such a shape that conforms to the shape of the development blade 12*e* in the state of being pressed upon the development roller 12*d*; in other words, it is configured so that the force applied to the development roller 12*d* by the development blade 12*e* due to the presence of the auxiliary development roller end seal S7 is minimized. With the provision of this configuration of the auxiliary development roller end seal S7, the auxiliary development roller end seal S7 prevents toner from leaking, by its top side portion S71 (portion which contacts development blade 12*e*), and scrapes down the toner particles on the end portion of the developer roller by the bottom side portion S72 (portion which contacts the development blade 12*d*). Incidentally, there are cases in which the top side of the auxiliary development roller end seal S7 is extended to be placed in contact with the development blade supporting metallic plate 12*e*1; in other words, there are cases in which the auxiliary development blade end seal S7 is pasted to the bottom frame 15 by the lateral surface, so that the surface of the auxiliary development roller end seal S7, by which the auxiliary development roller end seal S7 is not pasted, is placed in contact the development blade supporting metallic blade 12*e*1, the development blade 12*e* (rubber portion), and the development roller 12*d*, across the gaps and interfaces among them.

Figure 27:
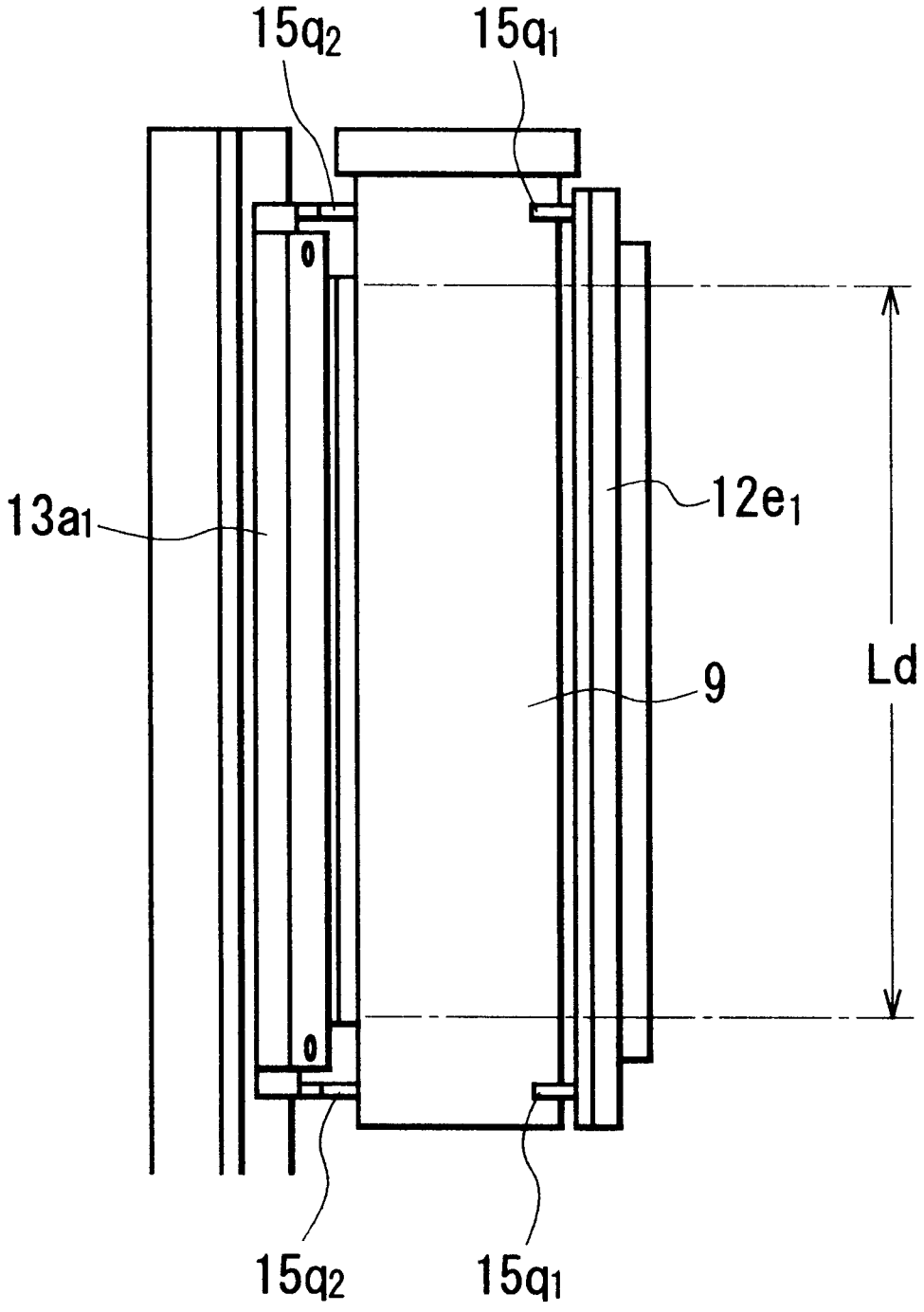
FIG. 27 is a top plan view showing a mounting position of the guiding member when the photosensitive drum is assembled into the unit.

As described above, after attaching the development blade 12*e*, cleaning blade 13*a*, and development roller 12*d*, the photoconductive drum 9 is attached. For this purpose, the bottom frame 15 in this embodiment is provided with a pair of guiding members 15*q*1 and a pair of guiding members 15*q*2, as shown in FIG. 20. The guiding member 15*q*1 is provided on the surface of the development blade supporting metallic plate 12*e*1, which faces the photoconductive drum 9, and the guiding member 15*q*2 is provided on the surface of the cleaning blade supporting metallic plate 13*a*1, which also faces the photoconductive drum 9. Both guides 15*q*1 and 15*q*2 are outside the image formation range (range Ld in FIG. 27) of the photoconductive drum 9. The distance Lg between the guiding members 15*q*1 and 15*q*2 is larger than the external diameter Rd of the photoconductive drum 9. Therefore, the photoconductive drum 9 can be attached to the bottom frame 15, being guided by the guiding members 15*q*1 and 15*q*2, by the lengthwise end portions (portions outside image formation range), as development blade 12*e* and cleaning blade 13*a*, which are to be attached to the bottom frame 15, are attached to the bottom frame 15. More specifically, first, the development roller 12*d* is moved aside by slightly flexing the cleaning blade 13*a*, and the photoconductive drum 9 is inserted into the photoconductive drum space, while causing the development roller 12*d* to rotate, and then, is attached to the bottom frame 15. If the bottom frame is structured so that various members inclusive of the development blade 12*e*, cleaning blade 13*a* and the like, are attached after the photoconductive drum 9 is first attached, there is a possibility that the peripheral surface of the photoconductive drum 9 is damaged when the development blade 12*e* the cleaning blade 13*a*, and the like, are attached to the bottom frame 15. Further, the process cartridge B cannot be checked regarding the positions of the development blade 12*e* or cleaning blade 13*a*, relative to the bottom frame 15, and also, the contact pressures between the development blade 12*e* and photoconductive drum 9, and between the cleaning blade 13*a* and photoconductive drum 9, cannot be measured, during the assembly process, which is inconvenient. The blades 12*e* and 13*a* are coated with lubricant before they are attached to the bottom frame 15. This is for the following reason. When the process cartridge B is brand new, there are no toner particles on the blades 12*e* and 13*a*; in other words, there is not substance on the blades 12*e* and 13*a*, which functions as a lubricant. Thus, unless the surfaces of the blades 12*e* and 13*a* are pre-coated with lubricant, the blades 12*e* and 13*a* are placed directly in contact with the development roller 12*d* and photoconductive drum 9, respectively, increasing the torque necessary for rotating the photoconductive drum 9 and development roller 12*d* and/or causing the blades 12*e* and/or 13*a* to be peeled. This is why the blades 12*e* and 13*a* are coated with lubricant before they are attached to the bottom frame 15. If the process cartridge design is such that the various members, such as the development roller 12*e* and cleaning blade 13*a*, are attached to the bottom frame 15 after the photoconductive drum 9 is first attached to the bottom frame 15, as described above, lubricant may come off when the blades 12*e* and 13*a* are attached, which is inconvenient. Thus, in this embodiment, the process cartridge B is designed so that the photoconductive drum 9 is attached last to the bottom frame 15 to eliminate the above described inconveniences.

As described above, according to this embodiment, such tests as checking the positions of the developing means 12 and cleaning means 13 relative to the bottom frame 15, can be carried out after attaching them to the bottom frame 15. Also, it is possible to prevent the photoconductive drum 9 from being damaged, for example, being scratched or dented, across the image formation range, when the photoconductive drum 9 is attached to the bottom frame 15. Further, the developing means 12 and cleaning means 13 can be coated with lubricant after they are attached to the frame. Therefore, lubricant does not fall off from the blades 12*e* and 13*a*, preventing the development blade 12*e* and cleaning blade 13*a* from being placed directly in contact with the development roller 12*d* and photoconductive drum 9, respectively. Therefore, the torque required to rotate the photoconductive drum 9 and development roller 12*d* when the process cartridge B is brand new, is not greater than the normal torque for rotating the photoconductive drum 9 and development roller 12*d*, and also, the blades 12*e* and 13*a* are not peeled when the process cartridge B is new.

Figure 28:
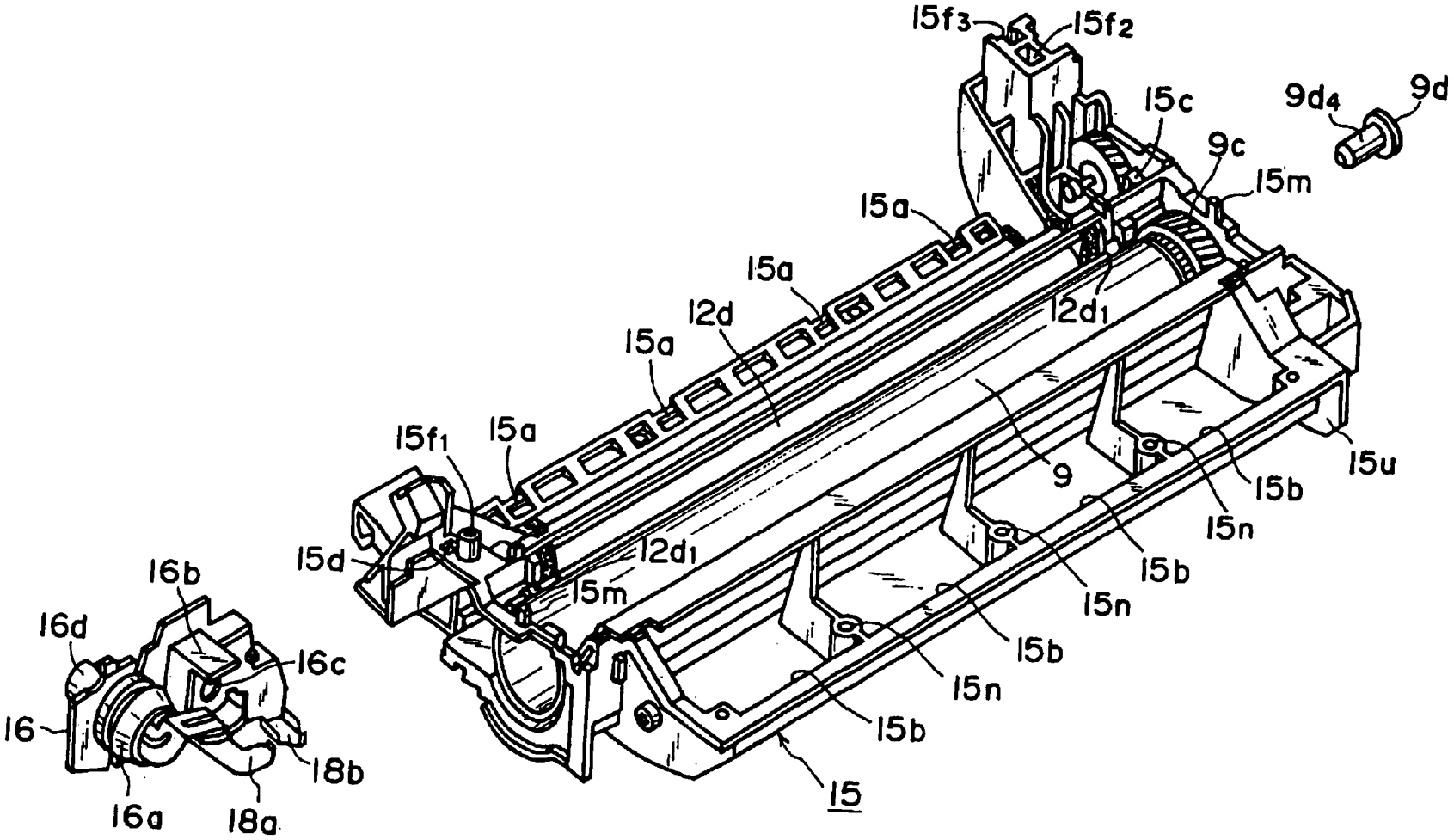
FIG. 28 is a perspective view for illustrating mounting of a bearing member for the developing roller and the photosensitive drum.

After the development roller 12*d*, the development blade 12*e*, and the cleaning blade 13*a*, are attached to the bottom frame 15, and the photoconductive drum 9 is placed in the bottom frame 15, as described above, the drum supporting shaft 9*d*, which has a drum supporting portion 9*d*4, and the bearing member 16, are attached to the lengthwise ends of the photoconductive drum 9, one for one. As a result, the photoconductive drum 9 is rotationally attached to the bottom frame 15, as shown in FIG. 28, a perspective view, and FIG. 15, a sectional view. The drum supporting shaft 9*d* and bearing member 16 are such members that are attached to the lengthwise ends of the photoconductive drum 9, one for one, to support the photoconductive drum 9 by the bottom frame 15. The bearing member 16 is molded of slippery substance such as polyacetal, and integrally comprises: the bearing portion 16*a*, which is inserted into the photoconductive drum 9; a development roller bearing portion 16*b* for loosely guiding the development roller 12*d* by the peripheral surface; and a hole 16*c*, the cross section of which is in the form of a letter D, and into which one of the lengthwise ends of the magnetic roll 12*c*, the cross section of which is in the form of a letter D, is fitted. Therefore, as the bearing member 16 is fitted into the bearing member attachment hole in the bottom frame 15 after the bearing portion 16*a* is inserted into the end of the cylindrical photoconductive drum 9, and the end of the magnetic roll 12*c* is fitted into the D-cut hole 16*c* of the bearing member 16, the photoconductive drum 9 and magnetic roller 12*c* become supported by the drum supporting shaft 9*d* and bearing member 16, respectively.

Referring to FIG. 28, to the bearing member 16, the electrically conductive ground contact 18*a* is attached in such a manner that the ground contact 18*a* comes into contact with the electrically conductive aluminum base member 9*a* of the photoconductive drum 9 as the bearing portion 16*a* of the bearing member 16 is fitted into the photoconductive drum 9. Also to the bearing member 16, the bias contact 18*b* is attached in such a manner that as the bearing member 16 is attached to the development roller 12*d*, the bias contact 18*b* comes into contact with the electrically conductive member 18*d* which is in contact with the internal surface of the development roller 12*d*. By supporting the photoconductive drum 9 and magnetic roll 12*c* by a single component, that is, the bearing member 16, by their shaft portions, the positional accuracy with which both the photoconductive drum 9 and development roller 12*d* are attached to the bottom frame 15, can be increased. Further, the component count can be reduced to simplify the process cartridge assembly process, and process cartridge cost can be reduced.

Moreover, the photoconductive drum 9 and magnetic roll 12*c* can be accurately positioned with the use of a single member, improving the accuracy with which the photoconductive drum 9 and magnetic roll 12*c* are positioned. Therefore, the magnetic force is kept constant at the peripheral surface of the photoconductive drum 9, making it possible to form uniform and highly precise images.

By attaching the drum ground contact 18*a* for grounding the photoconductive drum 9, and the development bias contact 18*b* for applying bias to the development roller 12*d*, to the bearing member 16, component size can be effectively reduced, which in terms makes it possible to effectively reduce the size of the process cartridge B.

Further, by providing the bearing member 16 with the portion by which the position of the process cartridge B is fixed within the image forming apparatus main assembly 1 as the process cartridge B is mounted into the image forming apparatus main assembly 1, the process cartridge B can be accurately positioned in the image forming apparatus main assembly 1.

Figure 31:
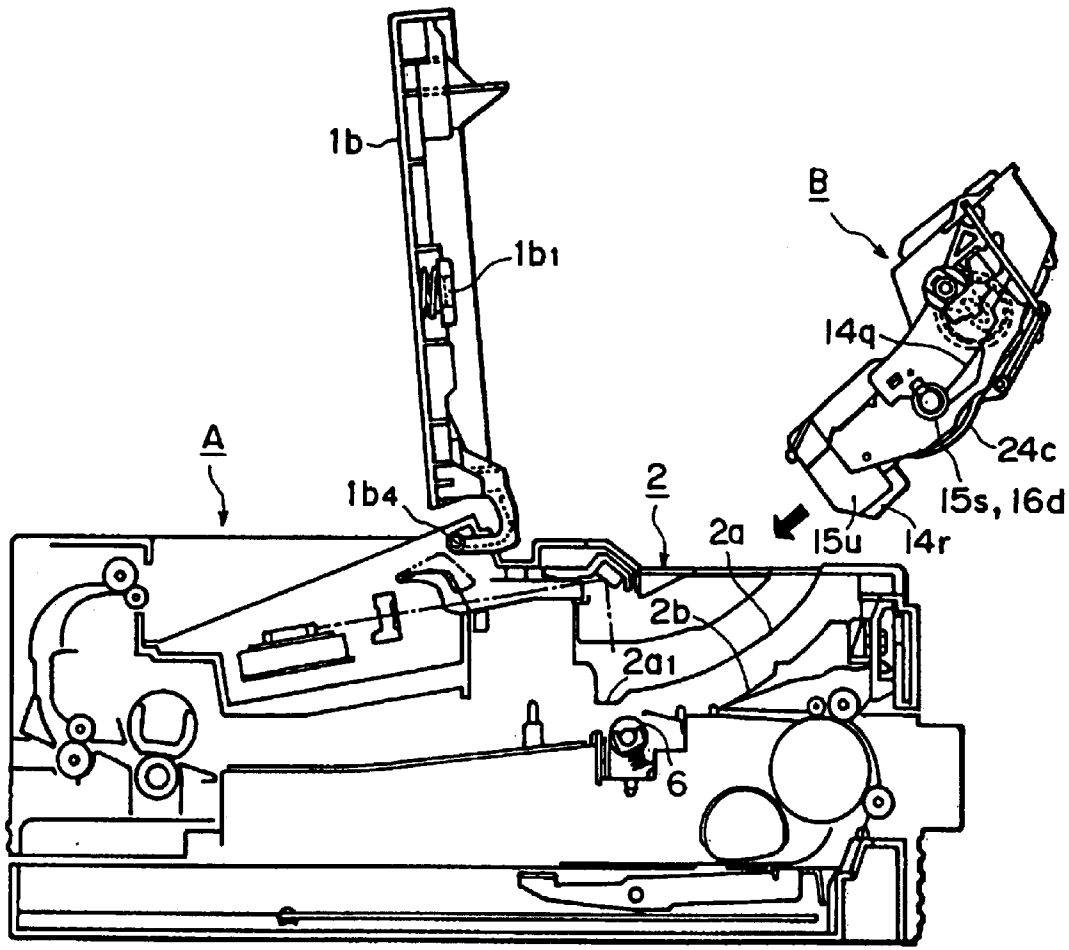
FIG. 31 is a longitudinal sectional view for illustrating a mounting state of the process cartridge into the image forming apparatus.

Referring to FIG. 15, the bearing member 16 is provided with the drum shaft portion 16*d*, which is a cylindrical projection which extends in the outward direction of the process cartridge B. As the process cartridge B is mounted into the apparatus main assembly 1, this drum shaft portion 16*d*, and the cylindrical projection 15*s* of the bottom frame 15, which will be described later, fit into the corresponding recesses or grooves 2*a*1 of the cartridge mounting portion 2, which are approximately U-shaped in cross section, as shown in FIG. 31, and as they fit into the corresponding recesses 2*a*1, the process cartridge B is precisely placed into the designated position in the image forming apparatus main assembly 1. As described before, the hollow of the cylindrical projection 15*s* of the bottom frame 15 is the portion into which the drum supporting shaft 9*d* is pressed. In other words, when the process cartridge B is mounted into the apparatus main assembly 1, the cylindrical portion 15*s* and shaft portion 16*d*, which directly support the photoconductive drum 9, determine the position of the process cartridge B in the apparatus main assembly 1. Therefore, the positioning of the process cartridge B is not affected by the processing errors and/or assembly errors involving the members other than the cylindrical portion 15*s* and shaft portion 16*d*. Consequently, the process cartridge B is precisely positioned.

(Attachment of Members Belonging to Top Frame)

As for the top frame 14, first, the plain bearing 10*c* is attached to the bearing slide guide 14*n* (FIG. 11), with the interposition of the spring 10*a*, and the shaft 10*b* of the charge roller 10 is rotationally fitted into the plain bearing 10*c*. Then, the toner conveying mechanism 12*b* is attached within the developer storage portion 12*a*. Then, a cover film 26, shown in FIG. 29, which is provided with a tear tape 25, is pasted to the edge of the toner supply opening 12*a*2, through which toner is sent from the developer storage portion 12*a* to the development roller 12*d*, to seal the opening 12*a*2. Next, toner is poured into the developer storage portion 12*a*, and the lid 12*f* is welded to the edge of the top opening of the developer storage portion 12*a*, to seal the developer storage portion 12*a*.

Figure 29:
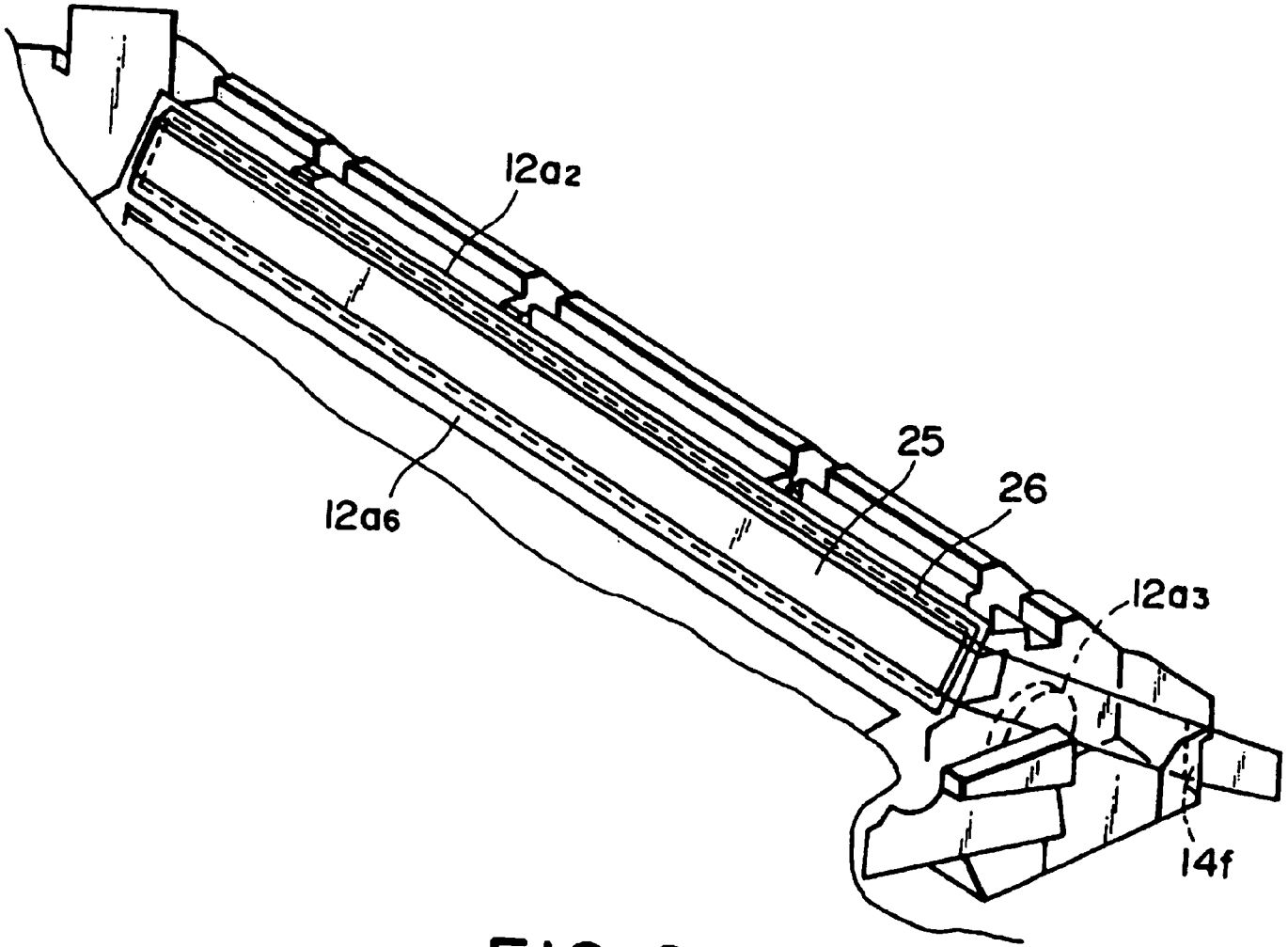
FIG. 29 is a perspective view illustrating a sticking state of a cover film having a tear-tape onto the toner sump opening.

Referring to FIG. 29, the tear tap 25 (formed of, for example, polyethylene terephthalate or polyethylene) laminated to the cover film 26 pasted to the edge of the toner supply opening 12*a*2 of the developer storage portion 12*a*, is extended from one of the lengthwise ends of the toner supply opening 12*a*2 (right end in figure 29) to the other end (left end in FIG. 29), is doubled back to the first end, and then, is further extended outward of the process cartridge B, through an opening 14*f* (FIG. 30), that is, a gap formed in the trailing side of the top frame 14, in terms of the process cartridge insertion direction. Since the top frame 14 is structured so that when the process cartridge B is mounted into the apparatus main assembly 1, the opening 14*f* will be on the trailing side, that is, the operator side, of the process cartridge B, the tear tape 25 will be within the clear view of an operator, being therefore easier to notice. Incidentally, in order to prevent an operator from forgetting to pull out the tear tape 25, by improving the visibility of the tear tape 25, the tear tape 25 may be given such color that is conspicuous against the color of the frames 14 and 15. For example, when the frame color is black, the tear tape 25 may be made white, yellow, or orange. When using a new process cartridge B for the first time, an operator is supposed to pull out the tear tape 25 exposed from the process cartridge B through the opening 14*f*. As the tear tape 25 is pulled out, the cover film 26 pasted to the surrounding edge of the toner supply opening 12*a*2 of the developer storage portion 12*a* is torn by the tear tape 25, by the width equal to the width of the tear tape 25, making it possible for the toner within the developer storage portion 12*a* to be moved toward the development roller 12*d*. Then, the process cartridge B should be mounted into the image forming apparatus A by the operator.

Sealing Member for Sealing Joint Between Top and Bottom Frames)

Next, the sealing member to be pasted to the joint between the top and bottom frames 14 and 15 will be described. Referring to FIGS. 17 and 18, a plurality of seals are pasted to the top and bottom frames 14 and 15, across their mutually facing surfaces at the joint between the two frames. More specifically, to the top frame 14, a first frame seal S1, a second frame seal S2, and a third frame seal S3 are pasted, whereas to the bottom frame 15, a fourth frame seal S8 and a fifth frame seal S9 are pasted. Toner is prevented by these seals from leaking from the joints between the top and bottom frames 14 and 15. In this embodiment, the frame seal which prevents toner from leaking from the portion of the joint between the frames 14 and 15, corresponding to the position of the cleaning means, is the first frame seal S1, and the frame seals which prevent toner from leaking from the portion of the joint between the frames 14 and 15, corresponding to the position of the developing means, are the second, third, fourth, and fifth frame seals S2, S3, S8, and S9, correspondingly.

As described above, the seals for preventing toner from leaking out of the process cartridge B are pasted to the top and bottom frames 14 and 15, across the joint portions between the two frames. Referring to FIG. 6, the seal seats of the top frame 14, to which the first, second, and third frame seals S1, S2, and S3, are pasted, are provided with a groove 14*m*, whereas the portions of the bottom frame 15, the positions of which correspond to those of the first, second, and third frame seals S1, S2, and S3 are provided with a triangular rib 15*r*. The position of the third frame seal S3 corresponds to the positions of the base portion of the development blade supporting metallic plate 12*e*1, and the position of the portion of the bottom frame 15, which corresponds to the hypothetical extension of the base portion. Thus, as the top and bottom frames 14 and 15 are joined with each other, the first and second frame seals S1 an S2 are compressed in the form of a wave, as shown in FIG. 26, and the third frame seal S3 is partially compressed into the groove 14*m*. Therefore, the joint between the top and bottom frames 14 and 15 is better sealed. Since these frame seals are only partially compressed, the reactive force generated as the seals are compressed is not large enough to adversely affect the joining of the two frames 14 and 15. In other words, when the process cartridge B is assembled, the first, second, and third frame seals S1, S2, and S2 are placed between the top and bottom frames, and then, the top and bottom frames 14 and 15 are joined with each other so that the first, second, and third frame seals S1, S2, and S3 are partially compressed. If pressure applies to the toner within the process cartridge B due to external causes (for example, vibrations, impacts, and the like), the toner is sometimes forced into the joint between the top and bottom frames 14 and 15, in which the first, second, and third frame seals S1, S2, and S3 are sandwiched by the two frames 14 and 15. However, even if the toner is forced into the joint, it is prevented from advancing outward of the process cartridge B, by the aforementioned triangular rib 15*r*, and the reactive force from the first and second frame seals S1 and S2 partially compressed by the triangular ribs 15*r*, and the reactive force from the third frame seal S3 partially forced into the groove 14*m* by the blade supporting metallic plate 12*e*1. In other words, it does not occur that external force causes the toner within the process cartridge B to leak out of the process cartridge B. In this embodiment, foamed polyurethane, for example, Moltprene (trade name), is used as the material for the first, second, and third frame seals S1, S2, and S3. However, liquid substance, which solidifies into elastomer, may be poured into the groove 14*m* to form a seal. Regarding the triangular rib 15*r*, the cross section of the rib 15*r* does not need to be triangular; any shape is acceptable as long as the shape makes the rib to partially compress these seals. Further, the presence of the groove in the seal seat to which the seal is pasted is not mandatory.

Figure 30:
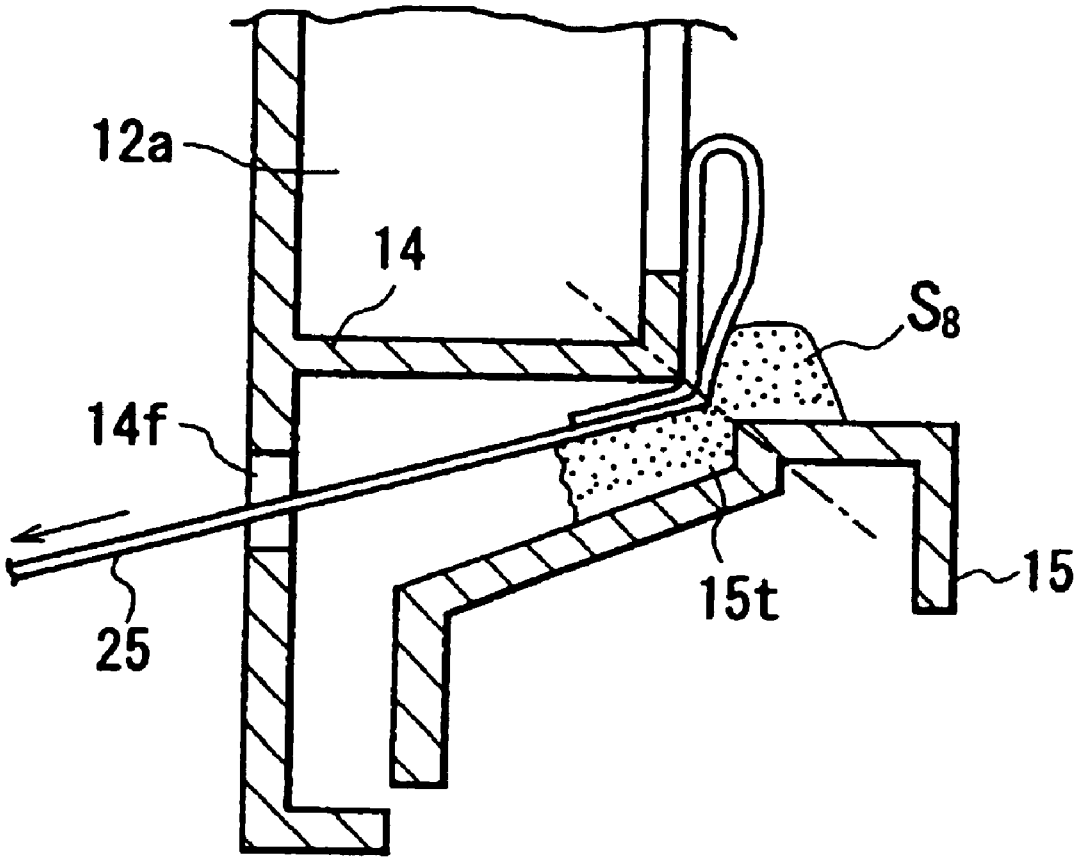
FIG. 30 is a longitudinal sectional view showing a state of the sealing member stuck on the pulling portion of the tear-tape.

Referring to FIG. 17, the bottom frame 15 is provided with the fourth and fifth frame seals S8 and S9, which are pasted to the lengthwise ends, one for one, of the bottom frame 15, on the developing means side. Referring to FIG. 30, of the fourth and fifth frame seals S8 and S9, the fourth frame seal S8, which is at the lengthwise end, from which the tear tape 25 is pulled out, is pasted to the corner area 15*t* of the bottom frame 15, astride the corner by which the bottom frame 15 is joined with the top frame 14, in such a manner that the approximate center line of the seal S8, in terms of the lengthwise direction of the process cartridge B, coincides with the above described edge of the bottom frame 15, or the joint (indicated by the broken line in FIG. 30) between the top and bottom frames 14 and 15, one of the two sides of the seal S8 divided by the aforementioned center line being pasted on the inward side of the bottom frame 15, with respect to the joint between the frames 14 and 15, and the other side being pasted on the outward side. Therefore, when an operator pulls the tear tape 25 out of the process cartridge B, the tear tape 25 comes out of the process cartridge B through the junction between the top frame 14 and the fourth frame seal S8 pasted to the corner area 15*t* of the bottom frame 15. In other words the only portion of the fourth frame seal S8, with which the tear tape 25 makes contact while the tear tape 25 is pulled out, is the center portion of the seal S8, in terms of the widthwise direction of the seal S8. Therefore, the fourth frame seal S8 is not peeled by the pulling of the tear tape, and also, it does not require a large amount of force to pull out the tear tape 25. In other words, the tear tape 25 contacts the arcuate portion of the fourth frame seal S8, without coming into contact with the edge of the fourth frame seal S8. Therefore, the tear tape 25 does not peel the fourth frame seal S8 when it is pulled out. Further, the direction in which the tear tape 25 is pulled out is made different from the direction of the plane of the surface of the surrounding edge of the aforementioned opening 12*a*2, to which the tear tape 25 is adhered. Therefore, the tear tape 25 does not come into contact with the edge of the fourth frame seal S8 when it is pulled out. As is evident from the above description, according to this embodiment, the cover film 26 for sealing the toner supply opening 12*a*2 can be adhered to the edge of the toner supply opening 12*a*2 in such a manner that when the tear tape 26 is pulled out to expose the toner supply opening 12*a*2, it does not come into contact with the edge of the fourth frame seal S8.

Next, the top and bottom frames 14 and 15, to which the various members have been attached, are attached to each other so that the aforementioned fastening claws and fastening claw slots engage. This concludes the assembly of the process cartridge B.

(Structural Arrangement for Mounting process Cartridge)

Next, the structural arrangement for mounting the process cartridge B into the main assembly of the image forming apparatus A, will be described, with reference to the drawings.

Figure 32:
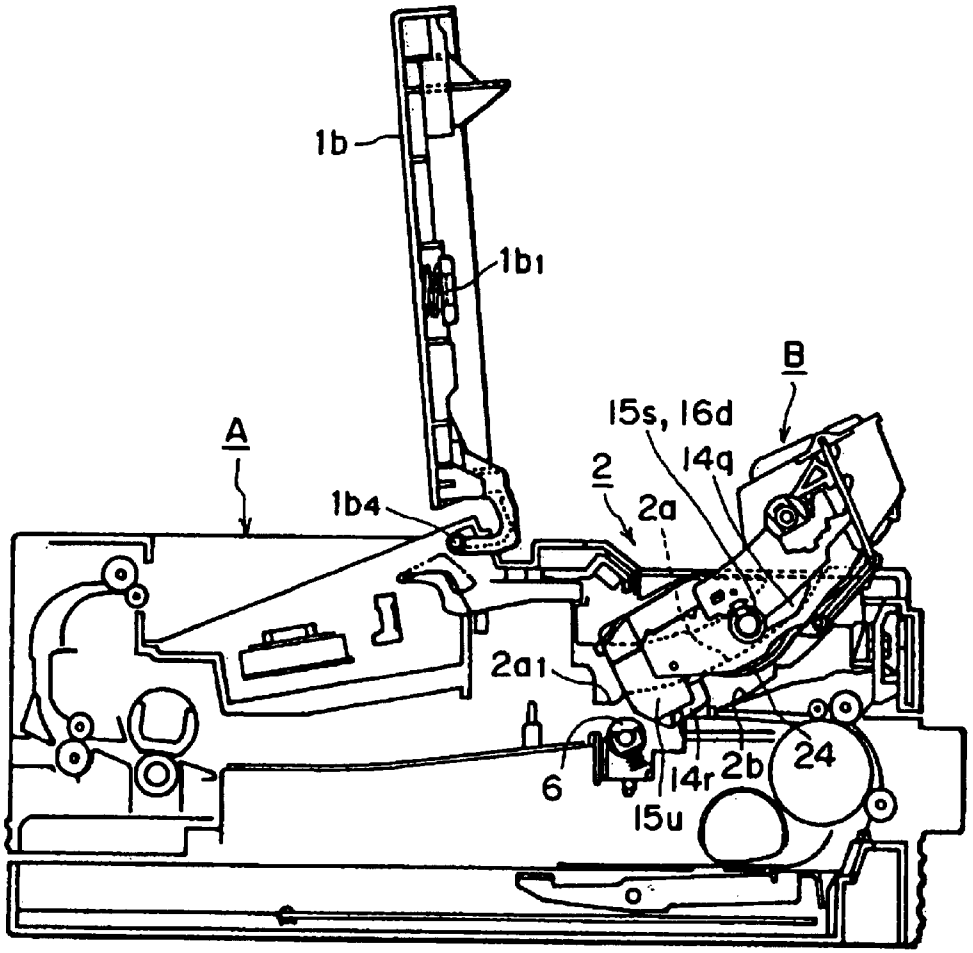
FIG. 32 is a longitudinal sectional view for illustrating a mounting state of the process cartridge into the image forming apparatus.

Referring to FIG. 31, in order to mount the process cartridge B into the image forming apparatus A, first, the top cover 1*b*, which is attached to the top portion of the apparatus main assembly 1 so that it can be opened or closed by being rotated about the shaft 1*b*4, must be opened. Then, the process cartridge B is inserted into the cartridge mounting portion 2 within the apparatus main assembly 1 in the direction indicated by an arrow mark in FIG. 31. During this insertion, the hollow cylindrical portion 15*s* of the bottom frame 15, shaft portion 16*d* of the bearing member 16, and a pair of first guiding shoe portions 14*q* of the process cartridge B, are guided, as shown in FIG. 32, by the corresponding first guide portions 2*a*, which are provided on both lateral walls of the process cartridge mounting portion 2, one for one, and also, a pair of second guiding shoe portions 15*u*, and a pair of second guiding shoe portions 14*r*, are guided by the corresponding second guide portions 2*b*, which are provided on both lateral walls of the process cartridge mounting portion 2. The hollow cylindrical portion 15*s* is a cylindrical portion which is projecting in the lengthwise direction of the process cartridge B from the end surface of one of the lengthwise ends of the process cartridge B, and the bearing portion 16*d* of the bearing member 16 is a cylindrical projection which is projecting in the lengthwise direction of the process cartridge B from the end surface of the other end of the process cartridge B, as described before. The first guiding shoe portions 14*t* are on the surfaces, one for one, from which the hollow cylindrical portion 15*s* and the shaft portion 16*d* are projecting, and which extend from the hollow cylindrical portion 15*s* and shaft portion 16*d*, one for one, in the rearward direction in terms of the cartridge insertion direction (diagonally upward in the rearward direction shown in FIG. 32). The second guiding shoe portions 15*u* and 14*r* are also on the end surface of the lengthwise ends of the process cartridge B, and are located on the bottom front portions in terms of the process cartridge insertion direction. Therefore, the process cartridge B is smoothly inserted, being guided by the first and second guide portions 2*a* and 2*b*. Referring to FIG. 1, as the top cover 1*b* is closed, the hollow cylindrical portion 15*s* and shaft portion 16*d* fit into the grooves 2*a*1, one for one, which are located at the downstream end of the pair of first guide portions 2*a*, and have an approximately U-shaped cross section. As a result, their positions relative to the cartridge mounting portion 2 become fixed.

(Movement of Drum Shutter Mechanism During Mounting of Process Cartridge)

The process cartridge B is provided with the drum shutter mechanism 24 for protecting the surface of the photoconductive drum 9. The drum shutter mechanism 24 in this embodiment is structured so that it is automatically opened as the process cartridge B is mounted into the image forming apparatus A.

(Relationship Between Electrical Contact and Electrical Contact Pin)

Figure 33:
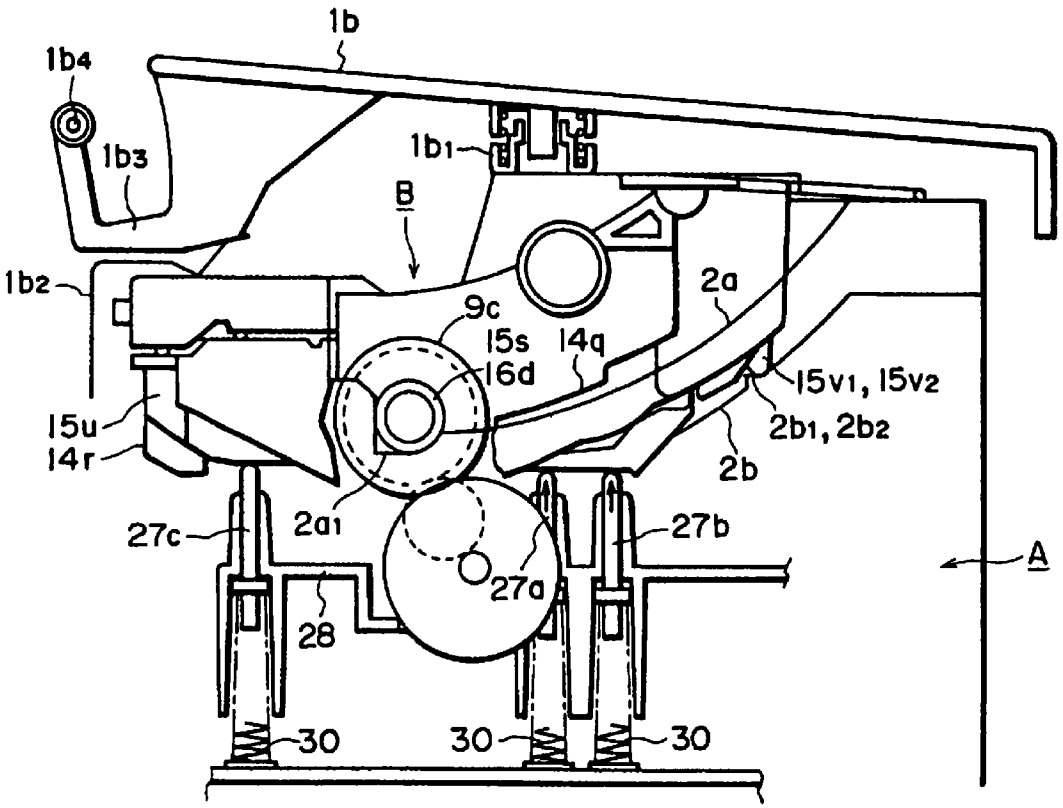
FIG. 33 is a longitudinal sectional view showing a state in which the process cartridge has been mounted to the image forming apparatus.

Referring to FIG. 5, the process cartridge B is provided with the electrically conductive drum grounding contact 18*a* (FIG. 9) in contact with the photoconductive drum 9, the electrically conductive development bias contact 18*b* (FIG. 28) in contact with the development roller 12*d*, and the electrically conductive charge bias contact 18*c* (FIG. 12). These contacts are exposed at the bottom surface of the bottom frame 15. Thus, as the process cartridge B is mounted into the apparatus main assembly 1 as described above, these contacts 18*a*, 18*b*, and 18*c* are pressed upon the drum grounding contact pin 27*a*, development bias contact pin 27*b*, and charge bias contact pin 27*c*, correspondingly, with which the apparatus main assembly 1 is provided as shown in FIG. 33. The electrically conductive drum grounding contact 18*a* and electrically conductive development bias contact 18*b* are on the bottom frame 15, whereas the electrically conductive charge bias contact 18*c* is on the top frame 14.

Also referring to FIG. 33, the contact pins 27*a*–27*c* are attached to the inward side of a holder cover 28 so that they project inward of the cartridge mounting portion 2 from the holder cover 28, without dislodging from the holder cover 28. Further, each of the contact pins 27*a*–27*c* is electrically connected by an electrically conductive compression spring 30 to the corresponding portion of the wiring pattern of the electrical circuit board to which the holder cover 28 is attached.

(Structure for Retaining process Cartridge)

After the process cartridge B is inserted into the cartridge mounting portion 2 along the guiding portions 2*a* and 2*b*, and the top cover 1*b* is closed, the process cartridge B must be secured to the cartridge mounting portion 2. Thus, the image forming apparatus in this embodiment is structured so that as the top cover 1*b* is closed, the process cartridge B is pressed, and kept pressed, upon the cartridge mounting portion 2 in the apparatus main assembly 1. More specifically, referring to FIG. 33, the top cover 1*b* is provided with a pressing means 1*b*1 and a leaf spring 1*b*2. The pressing means 1*b*1 is provided with a shock absorbing spring, and is on a predetermined portion of the inward surface of the top cover 1*b*, and the leaf spring 1*b*2 is located near the rotational center of the top cover 1*b*. When the top cover 1*b* is open, more specifically, while the process cartridge B is inserted into the predetermined location in the apparatus main assembly 1 along the guide portions 2*a* and 2*b* after the opening of the top cover 1*b*, the leaf spring 1*b*2 is not in contact with the process cartridge B. However, as the top cover 1*b* is closed after the insertion of the process cartridge B, not only does the pressing means 1*b*1 on the inward surface of the top cover 1*b* press downward on the top surface of the process cartridge B, but also the arm portion 1*b*3 of the top cover 1*b* presses on the leaf spring 1*b*2 causing the leaf spring 1*b*2 to press downward upon the top surface of the process cartridge B. Consequently, the hollow cylindrical portion 15*s* and shaft portion 16*d* of the process cartridge B are kept pressed upon the walls of the corresponding grooves 2*a*1, being therefore retained in the grooves 2*a*1, and also the leg portions 15*v*1 and 15*v*2 which project from the bottom portion of the bottom frame 15 are placed in contact with the leg portion seats 2*b*1 and 2*b*2 provided on the predetermined portions of the second guide portion 2*b*, controlling thereby the rotation of the process cartridge B. Therefore, the process cartridge B is precisely retained in the predetermined position in the cartridge mounting portion 2.

(Image Forming Operation)

Next, the image forming operation of the image forming apparatus A in which the process cartridge B has been mounted as described above, will be described with reference to FIG. 1.

As a recording start signal is inputted into the apparatus, the pickup roller 5*a* begins to be driven along with the recording medium conveying roller 5*b*. Therefore, the recording media in the cassette 4 are fed out of the cassette 4 while being separated one by one by the recording medium separating claw 4*e*, and are conveyed toward the image formation station by the conveying roller 5*d* while being placed upside down by the conveying roller 5*b* and being guided by the guides 5*c*. Then, as the leading end of each recording medium is detected by an unshown sensor, an image is formed in the image formation station, in synchronism with the timing with which the leading end of the recording medium is delivered from the sensor to the transfer nip. In other words, the photoconductive drum 9 is rotated in the direction of the arrow mark in FIG. 1 in synchronism with the recording medium conveyance timing. As the photoconductive drum 9 is rotated, charge bias is applied to the charging roller 10, in order to uniformly charge the peripheral surface of the photoconductive drum 9. Then, a beam of laser light modulated with the image formation signals is projected onto the uniformly charged peripheral surface of the photoconductive drum 9 from the optical system. As a result, a latent image in accordance with the image formation signals is formed on the peripheral surface of the photoconductive drum 9. In synchronism with the formation of the latent image, the developing means 12 of the process cartridge B is driven to send the toner within the developer storage portion 12*a* to the development roller 12*d* to form a toner layer on the rotating development roller 12*d*. The latent image on the peripheral surface of the photoconductive drum 9 is developed into a toner image, by applying to this development roller 12*d*, a voltage which is the same in polarity, and virtually the same in potential level, as the charge given to the peripheral surface of the photoconductive drum 9. Then, the toner image on the photoconductive drum 9 is transferred onto the recording medium having been conveyed to the transfer nip, by applying to the transfer roller 6, a voltage which is reverse in polarity to the electrical charge of the toner. After the transfer of the toner image onto the recording medium, the photoconductive drum 9 is further rotated in the direction of the arrow mark in FIG. 1. As the photoconductive drum 9 is further rotated, the toner particles remaining on the peripheral surface of the photoconductive drum 9 are removed by being scraped down by the cleaning blade 13*a*, and are collected into the toner bin 13*c* for the removed toner. On the other hand, the recording medium, on which the toner image has been transferred, is conveyed to the fixing means 7 while being guided by the cover guide 5*e*, by the bottom surface. In the fixing means 7, heat and pressure are applied to the recording medium to permanently fix the unfixed image on the recording medium to the recording medium. Thereafter, the recording medium is placed upside down by the intermediary discharge roller 5*f* and second reversing path 5*g*, while the curvature of the recording medium is removed by the intermediary discharge roller 5*f* and second reversing path 5*g*. Then, the recording medium is discharged into the delivery portion 8 by the discharge rollers 5*h* and 5*i*.

(Structure for Dismounting Process Cartridge)

As it is detected during the above described image forming operation of the image forming apparatus A, by an unshown sensor or the like, that the amount of the remaining toner within the developing means has become small, this information is displayed in the display section, or the like, of the apparatus main assembly 1, attracting the operator's attention to the fact that the process cartridge B should soon be replaced. Incidentally, the provision of the sensor or the like is not mandatory. Instead, the process cartridge B may be replaced, for example, as the image density begins to reduce. In order to remove the process cartridge B from the apparatus main assembly 1, the top cover 1*b*, shown in FIGS. 31 and 32, must be opened before the process cartridge B is pulled out.

Next, the process cartridge remanufacturing method in accordance with the present invention will be described. The general steps which are taken to remanufacture the process cartridge B are: (1) recovery; (2) cartridge sorting; (3) disassembly; (4) component sorting; (5) cleaning; (6) inspection; and (7) reassembly. Hereinafter, these steps will be concretely described.

(1) Recovery

Used process cartridges are collected at a recycle center with the cooperation of users, service persons, and the like.

(2) Cartridge Sorting

Used process cartridges having been collected at the local recycle centers are shipped to a process cartridge remanufacturing factory, and are sorted according to model.

(3) Disassembly

Sorted process cartridges are disassembled to remove the components. Next, the processes which are carried out to disassemble the process cartridge B will be described.

Figure 34:
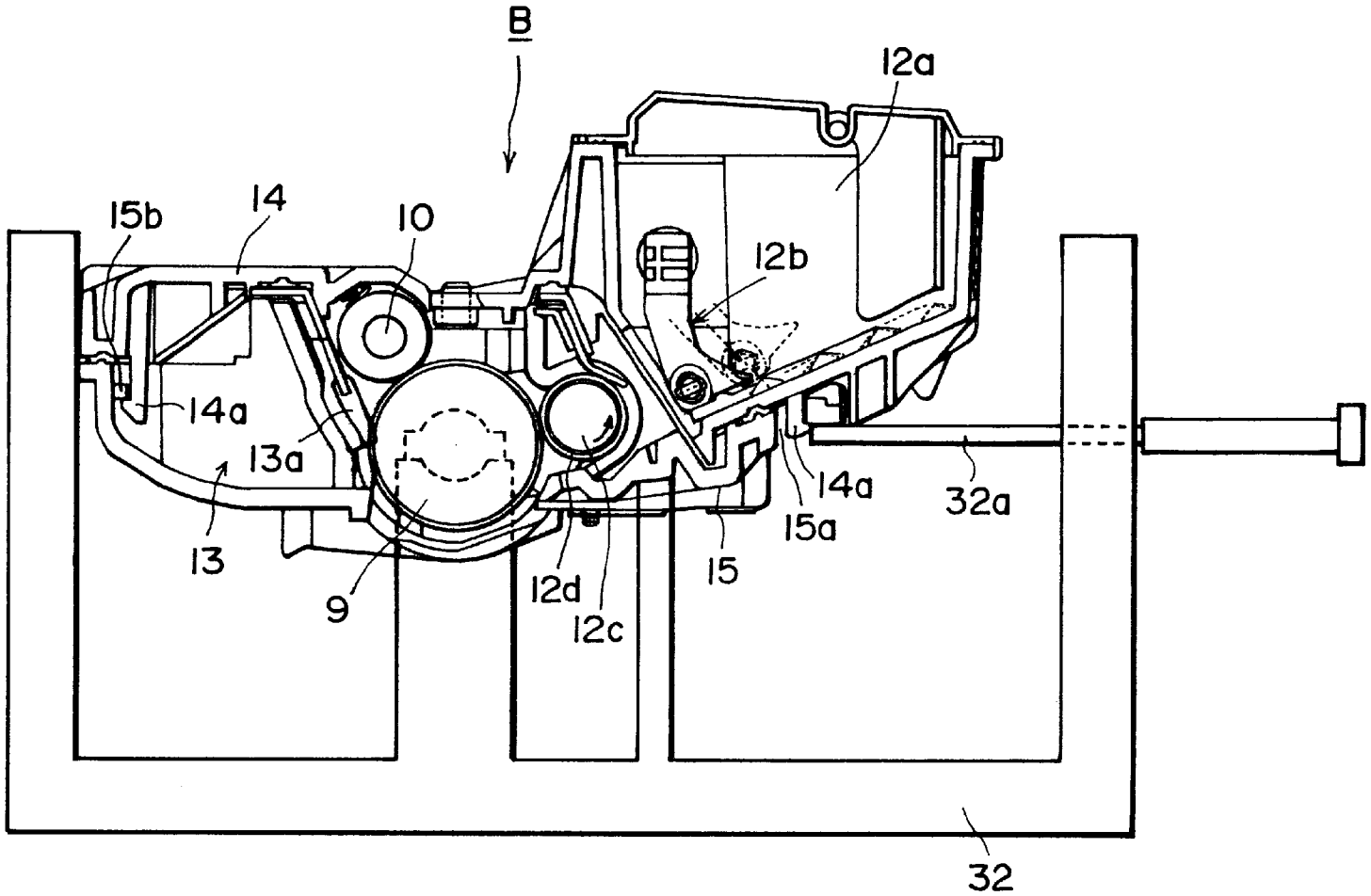
FIG. 34 is a longitudinal sectional view illustrating release of the connection between the upper frame and the lower frame member.

The top and bottom frames 14 and 15 can be separated from each other by dissolving the engagements between the fastening claws 14*a* and fastening claw slots 15*d*, 15*f*3, between the fastening claws 14*a* and fastening claw catching projections 15*b*, and between the fastening claws 14*c* and fastening claw slots 15*d*, shown in FIGS. 7, 8, 17, and 18, and also, the engagements between the fastening claws 15*c* and fastening claw slots 14*b*, and between the fastening claws 14*e*3 and fastening claw slots 15*f*3, shown in FIGS. 17 and 18, of the top and bottom frames 14 and 15, which are keeping the top and bottom frames 14 and 15 fastened to each other. Referring to FIG. 34, these engagements between the fastening claws and their counterparts can be easily dissolved by pushing the fastening claws 14*a* by pushing a rod 32*a* inward of a disassembly jig 32 against the fastening claws 14*a* after setting a used process cartridge on the disassembly jig 32. The engagements between the fastening claws and their counterparts can be also dissolved by simply pushing each of the fastening claws 14*a*, 14*c*, 15*c*, and 14*e*3, instead of using the disassembly jig 32; the fastening claws separate from their counterparts as their inverse tips are pushed.

Referring to FIGS. 7 and 8, after the separation of the top and bottom frames 14 and 15 from each other as described above, the toner particles adhering to the inward side of the process cartridge B are removed by blowing air upon each of the top and bottom frames 14 and 15. Then, the top and bottom frames 14 and 15 are separately cleaned. More specifically, the top and bottom frames, and the components therein, are disassembled to component level. More concretely, in the case of the top frame 14*r*, the charge roller 10 and the like are detached from the top frame 14, and then, are individually cleaned, whereas in the case of the bottom frame 15, the photoconductive drum 9, development roller 12*d*, cleaning blade 13*a*, and the like, are detached from the bottom frame 15, and then, are individually cleaned. In this embodiment, however, the top and bottom frames 14 and 15 themselves are cleaned without removing the first, second, and third frame seals S1, S2, and S3 pasted to the top frame 14, the auxiliary development roller end seals S7 (FIG. 26), fourth frame seal S8, and fifth frame seal S9 pasted to the bottom frame 15, and also, the development blade 12*e* attached to the bottom frame 15.

Next, the disassembly of the bottom half of the process cartridge B, that is, the unit comprising the bottom frame 15 and the components therein, will be described in detail.

(Process for Removing Photoconductive Drum)

As described above, the driven side of the photoconductive drum 9 is rotationally supported by the metallic drum supporting shaft 9*d*, and the non-driven side of the photoconductive drum 9 is rotationally supported by the bearing portion 16*a* of the bearing member 16 (FIG. 9). The drum supporting shaft 9*d* and bearing member 16 are removed from the lengthwise ends of the photoconductive drum 9 in the lengthwise direction of the photoconductive drum 9, placing the bottom frame 15 in the state shown in FIG. 28. In this state, the photoconductive drum 9 can be lifted straight up to be removed from the bottom frame 15 as shown in FIG. 20. In other words, all that is necessary to remove the photoconductive drum 9 from the bottom frame 15 is to carry out in reverse the process for attaching the photoconductive drum 9 to the bottom frame 15.

(Process for Removing Development Roller)

Without the presence of the photoconductive drum 9, the development roller 12*d* is simply resting on the development roller bearings 12*h* and 12*i*, by the lengthwise end portions. Therefore, the development roller 12*d* can be easily removed from the bottom frame 15, by pulling the development roller 12*d* in the direction of the openings of the development roller bearings 12*h* and 12*i* (leftward in FIGS. 16(*a*) and 16(*b*)).

(Process for Detaching Cleaning Blade)

Figure 35:
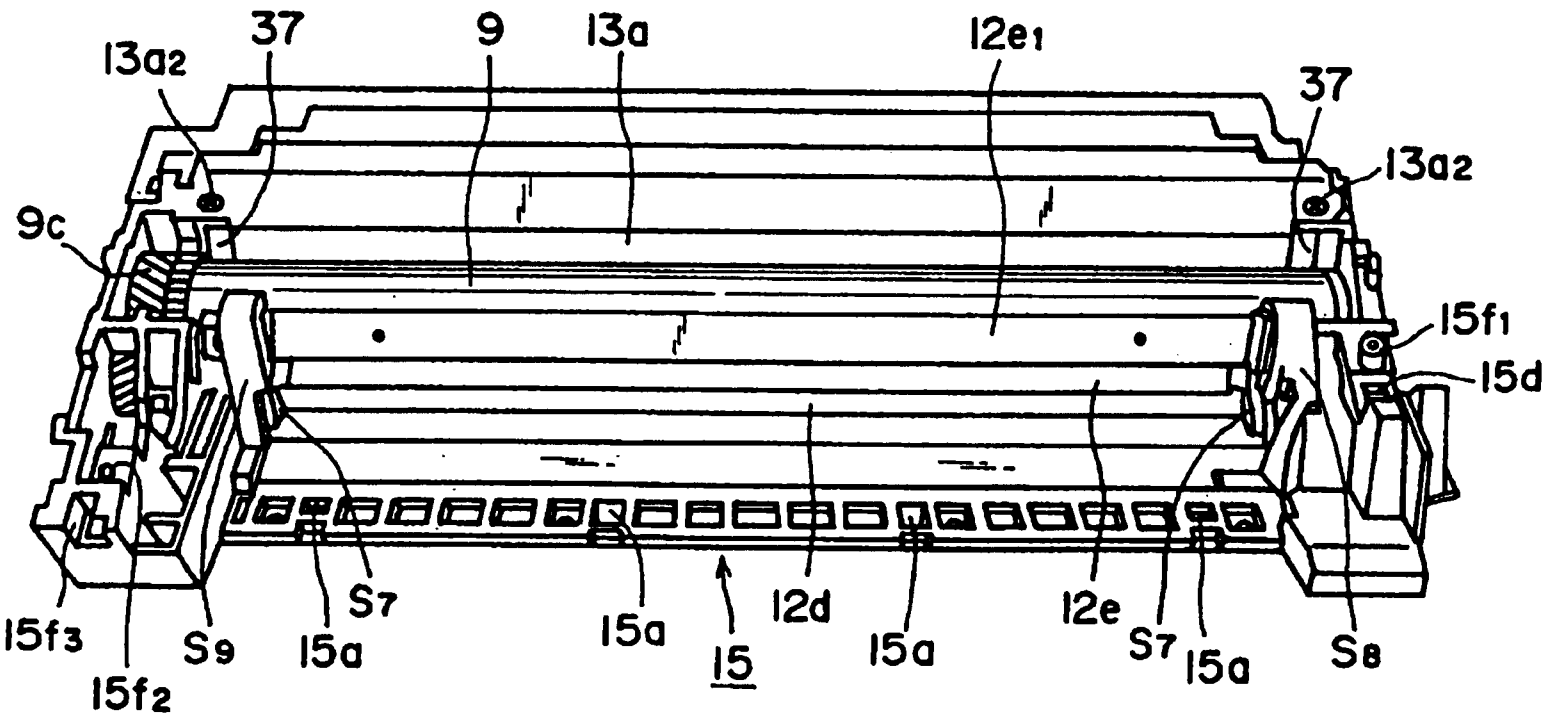
FIG. 35 is a perspective view of an inside of the lower frame member.
Figure 36:
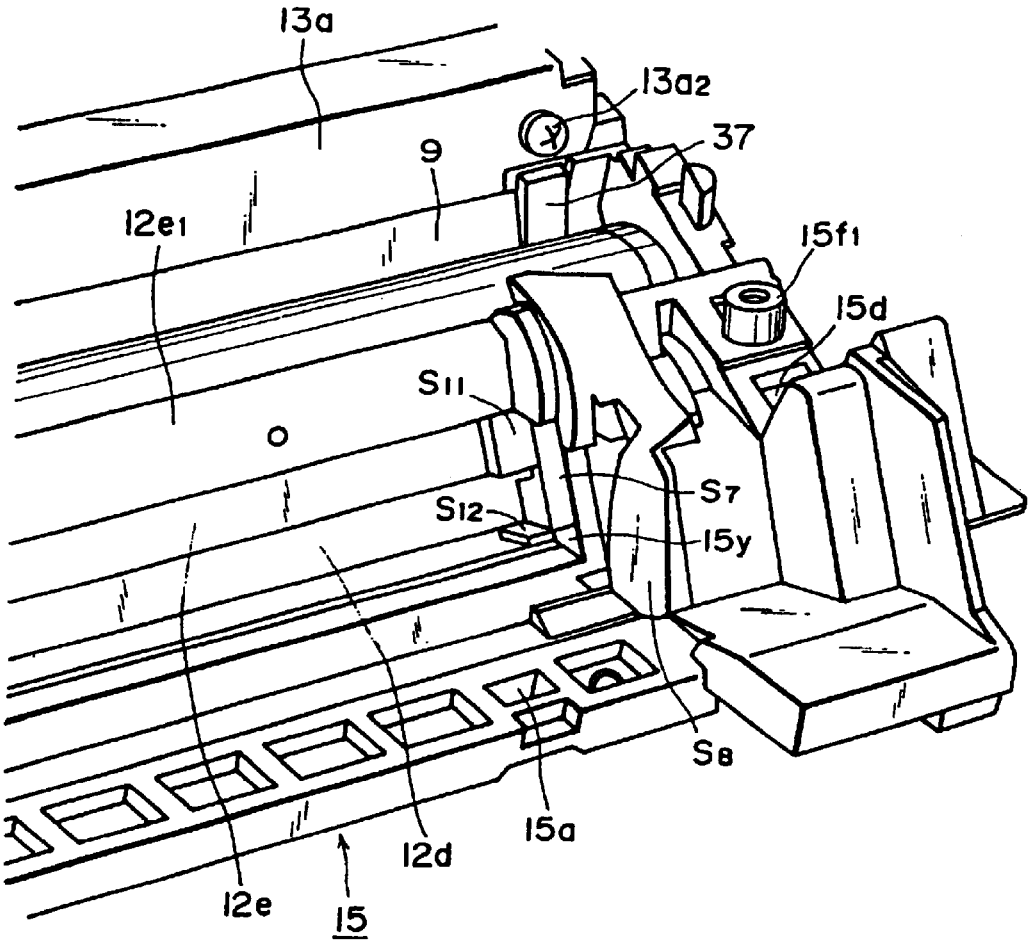
FIG. 36 is a perspective view of an inside in which the non-driving side of the lower frame member is enlarged.

The cleaning blade 13*a* is attached, with the use of the screws 13*a*2, to the cleaning blade attachment seat of the bottom frame 15, to which the photoconductive drum 9 is attached (FIGS. 6, 35, and 36). The cleaning blade 13*a* is detached by removing the two screws 13*a*2 screwed into the cleaning blade attachment seat through the left and right end portions of the blade supporting metallic plate 13*a*1, one for one, as shown in FIG. 35.

(Disassembly of Top Half of Process Cartridge)

Next, the top half of the process cartridge, or the unit comprising the top frame 14 and the components therein, is disassembled. Referring to FIGS. 11 and 12, each plain bearing 10*c* for rotationally supporting the roller shaft 10*b* of the charge roller 10 is held to the top frame 14 with the use of the bearing slide guide claw 14*n*, so that it does not become disengaged from the top frame roller 10 toward the opening of the plain bearing 10*c* (toward photoconductive drum 9 in FIG. 11), since the pulling makes the plain bearing 10*c* bend slightly. Thereafter, the plain bearing 10*c* is disengaged from the bearing slide guide claw 14*n*. However, when it has been statistically determined based on the studies made during the process cartridge development or process cartridge remanufacture that the plain bearing 10*c* does not need to be replaced, the step which would come after the disengagement of the plain bearing 10*c*, and will be described later, is sometimes carried out, with the plain bearing left attached to the bearing slide guide claw 14*n*.

(4) Component Sorting

The components removed from the top and bottom frames 14 and 15 are inspected and sorted into a group of recyclable components, and a group of components that are not suitable for recycling, because their service lives have expired, or they have been damaged. The inspection for sorting may be carried out visually, or with the use of apparatuses if necessary.

(5) Cleaning

The components which have passed the sorting inspections are cleaned with scrupulous care, and reused as the components for process cartridge remanufacture; they are painstakingly cleaned by blowing high pressure air upon them, by wiping with cleaning liquid such as alcohol, and/or by the like methods, to remove the toner particles and/or the like adhering to the components.

(6) Inspection

The components, which have been cleaned after passing the sorting inspection, are reinspected by inspectors to determine whether or not their functions have been restored to a level suitable for recycling.

(7) Reassembly

A process cartridge is remanufactured with the use of the components which have passed the final inspection, along with the new components which replace the components which have failed to pass the final inspection. Hereinafter, the process cartridge remanufacturing process in accordance with the present invention will be described.

(Cover Film)

Obviously, the toner supply opening 12*a*2 of the developer storage portion 12*a* of the recycled top frame 14 to be used for remanufacture of a process cartridge B is open. In other words, the cover film 26 which was sealing the toner supply opening 12*a*2 as shown in FIG. 29 has been torn away, by a width equal to the width of the tear tape 25. Thus, with the restoration of the cover film 26, a remanufactured process cartridge will be virtually the same as a new one. According to the present invention, however, the cover film 26 is not restored, for the following reasons. That is, all that is required of a remanufactured process cartridge is that it is as leak-proof as a new cartridge, and further, the restoration of the cover film 26 requires complicated operation, which will be described next.

Even after passing the final inspection for recycling, the cover film 26 still remains on the top frame 14. More specifically, the portions of the cover film 26, which were not torn away by the tear tape 25 when the tear taped 25 was pulled out, remain welded to the long edges 12*a*6 of the toner supply opening 12*a*2. Unless the remaining portions of the original cover film 26 are removed, it is difficult to weld another cover film to the edges of the toner supply opening 12*a*2, because the replacement cover film must be welded over the original one. Thus, in order to properly weld the replacement cover film to the edges 12*a*6 of the toner supply opening 12*a*2, the remaining portions of the original cover film 26 must be removed. As for an example of a method for removing the remaining portions of the original cover film 26, there are a method in which the remaining portions of the original cover film 26 are manually peeled by an assembly worker, and the pieces of the original cover film 26 still remaining on the edges 12*a*6 after the peeling by an assembly worker are wiped away with the use of a waste piece of cloth or a piece of sponge soaked with solvent such as isopropyl alcohol (IPA), methanol, or ethanol, or a method in which the remaining portions are mechanically scraped away with the use of a cutter or the like. Either method involves complicated operations.

Next, a method which does not require the restoration of the cover film 26, and yet is capable of providing a remanufactured process cartridge with a level of airtightness high enough to prevent toner from leaking, will be described. To describe, by way of caution, "level of airtightness high enough to prevent toner from leaking" does not mean that the level of the airtightness of a process cartridge is high enough only to prevent toner from leaking during the so-called normal handling of a process cartridge by a user, for example, when a user mounts the process cartridge into the image forming apparatus A, or dismounting it therefrom. It means that the level of the airtightness of a process cartridge is high enough to prevent toner from leaking even in a harsh environment, for example, during the shipment of the process cartridge by a truck, a ship, an aircraft, or the like, after its remanufacture in a factory. When a new process cartridge is used, a user naturally tears open the cover film 26 by pulling the tear tape 25 (unless the cover film 26 is torn open, toner is not supplied to the development roller, and therefore, an image cannot be formed). Thus, the user mounts the process cartridge, the cover film 26 of which has been torn open, into the main assembly of the apparatus A, dismounts it therefrom, or carries it by hand. Hence, it has been taken for granted that a the level of the airtightness of a process cartridge is high enough to prevent toner from leaking when the process cartridge is subjected to the above described handling by the user. In fact, a process cartridge does not leak toner when subject to the above described handling. The first frame seal S1 the second frame seal S2, the third frame seal S3 the development roller end seals S4 the cleaning blade back seal S5 the cleaning blade end seals S6 the auxiliary development roller end seals S7 the fourth frame seal S8, the fifth frame seal S9, the toner catching sheet 13*b*, and the blow-by prevention sheet 12*m* are seals for sealing the process cartridge B at a level of airtightness high enough to assure that toner does not leak when the process cartridge B is normally handled by a user. However, the vibrations and impacts to which a process cartridge is subjected while the process cartridge is delivered from a factory to an end user by a truck, a ship, an aircraft, or the like, are much harsher than those to which the process cartridge is subjected while normally handled by the user. Therefore, a measure for preventing toner from leaking from a remanufactured process cartridge during its transportation is necessary. Without replacing the torn original cover film 26, a certain amount of toner reaches the development roller 12*d*. Thus, in order to prevent toner from leaking from a process cartridge remanufactured without replacing the torn original cover film 26, the seals disposed in the adjacencies of the development roller 12*d* and development blade 12*e*, in other words, the second frame seal S2 the third frame seal S3 the development roller end seals S4 the auxiliary development end seals S7, the fourth frame seal S8, the fifth frame seal S9, and the blow-by prevention seal 12*m*, must be improved in sealing performance. The cover film 26 is for preventing toner from leaking during process cartridge transportation. Thus, if the cover film 26 is not restored in the remanufacture of a process cartridge, a member which plays the role of the cover film 26 is necessary. Since the toner which was removed by the cleaning means 13 and collected in the cleaning means 13 has been removed through the aforementioned cleaning process, the seals used for sealing the cleaning means 13, in other words, the first frame seal S1, the cleaning blade back seal S5 the cleaning blade end seals S6, and the toner catching sheet 13*b*, do not need to be improved in sealing performance.

(Assembly of Bottom Half of Process Cartridge)

Next, the method for reassembling the bottom half of the process cartridge B, or the unit comprising the bottom frame 15 and the components therein, will be described.

(Process for Pasting Magnetic Seal)

First, the process for pasting a magnetic seal will be described in detail. FIG. 35 is a perspective view of the bottom frame 15, as seen from the back side of the development blade 12*e*, and FIG. 36 is an enlarged perspective view of the right end portion (non-driven side) of the bottom frame 15 in FIG. 35. In FIG. 36, a component designated by a referential code S12 is a magnetic seal, which is a small piece of magnetized material. The magnetic seal S12 is pasted to the bottom frame 15, with the use of adhering means such as double-side tape or the like, so that it extends along the inward surface 15*y* of each lateral wall of the bottom frame 15, below the each end portion of the development roller 12*d* (although only right end portion of the bottom frame 15 shown in FIG. 35 is shown in FIG. 36, the magnetic seal S12 is also pasted to the left end portion (driven side) of the bottom frame 15, so that it extends along the inward surface 15*y* of the lateral wall of the bottom frame 15, below the left end of the development roller 12*d*, as it is on the right side). The magnetic seals S12 confine toner by magnetic force as toner enters below the lengthwise ends of the development roller 12*d*, preventing thereby toner from leaking from the ends of the blow-by prevention seals 12*m* and the bottom portions of the development roller end seals S4. In other words, the magnetic seals S12 improve the sealing performances of the blow-by prevention sheet 12*m* and development roller end seals S4.

(Process for Pasting Elastic Blade Seal)

The elastic blade seals are seals which are to be pasted to the bottom frame 15, on the portions corresponding to the lengthwise ends of the development blade 12*e*, one for one, on the back side of the development blade 12*e*. One of the elastic blade seals is designated by a referential code S11 in FIG. 36. The elastic blade seal S11 is pasted to the bottom frame 15, with the use of an adhering means such as a double-side adhesive tape, so that one of the primary surfaces is placed in contact with the rubber portion of the development blade 12*e*; one of the lateral edges is placed in contact with the inward lateral surface of the corresponding auxiliary development roller end seal S7; one of the lateral surfaces parallel to the lengthwise direction of the bottom frame 15 is placed in contact with one of the lateral surfaces of the blade supporting metallic plate 12*e*1 of the development blade 12*e*, which is also parallel to the lengthwise direction of the bottom frame 15 (although FIG. 36 shows only the right end portion of the bottom frame 15 shown in FIG. 35, another development blade seal S11 is similarly pasted to the left end (driven side)). The elastic development blade seal S11 is for improving the sealing performance of the auxiliary development roller end seal S7. It is formed of spongy substance or elastomer, for example, Moltprene (commercial name).

(Process for Attaching Cleaning Blade)

One of the cleaning blades 13*a* determined to be recyclable through the above described final inspection, or a new cleaning blade 13*a*, is attached to the bottom frame 15 (FIG. 35). The cleaning blade 13*a* is attached following in reverse order the steps followed to remove the blade; the screws 13*a*2 are put through the lengthwise end portions of the blade supporting metallic plate 13*a*1 of the cleaning blade 13*a*, and screwed in the cleaning blade attachment seat of the bottom frame 15.

(Process for Attaching Development Roller)

One of the development rollers 12*d* determined to be recyclable through the above described final inspection, or a new development roller 12*d*, is attached to the bottom frame 15; the lengthwise end portions of the development roller 12*d* are fitted into the development roller bearings 12*h* and 12*i*, one for one, from the direction corresponding to the openings of the bearings 12*h* and 12*i* (from the left in FIGS. 16(*a*) and 16(*b*)).

(Process for Attaching Photoconductive Drum)

One of the photoconductive drums 9 determined to be recyclable through the above described final inspection, or a new photoconductive drum 9, is attached to the bottom frame 15. The steps taken for attaching a photoconductive drum 9 during this process cartridge remanufacture are the same as those described previously in detail. In other words, the photoconductive drum 9 is placed into the bottom frame 15 from above as shown in FIG. 20, and the lengthwise end of the photoconductive drum 9, on the driven side, is attached to the bottom frame 15 by the metallic drum supporting shaft 9*d*, whereas the other lengthwise end of the photoconductive drum 9, that is, the one on the non-driven side, is attached to the bearing portion 16*a* of the bearing member 16.

(Reassembly of Top Half of Process Cartridge)

Next, the reassembly of the top half of the process cartridge B, or the unit comprising the top frame 14 and the components to be attached thereto, will be described in detailed.

(Process for Pasting Opening Edge Seal)

Figure 37:
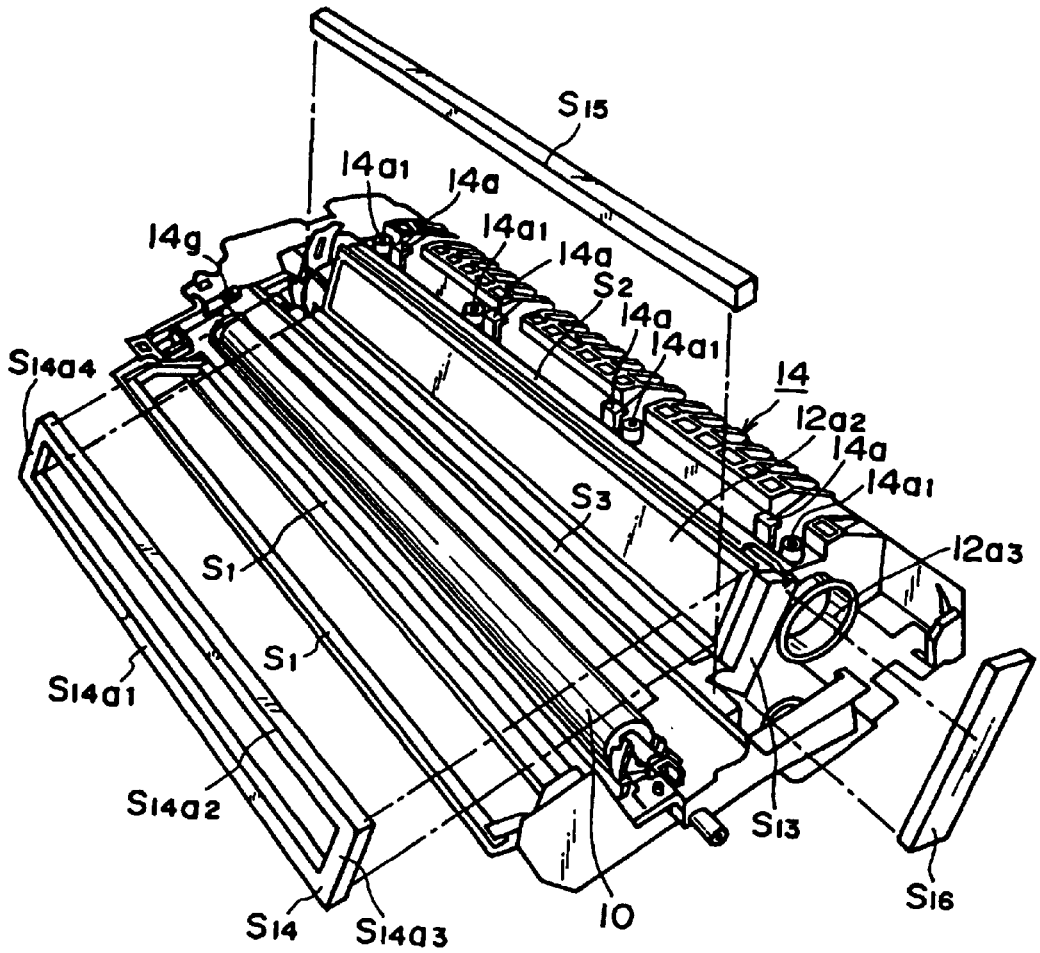
FIG. 37 is a perspective view for illustrating a sticking state of seals for the remanufacturing onto the upper frame.
Figure 38:
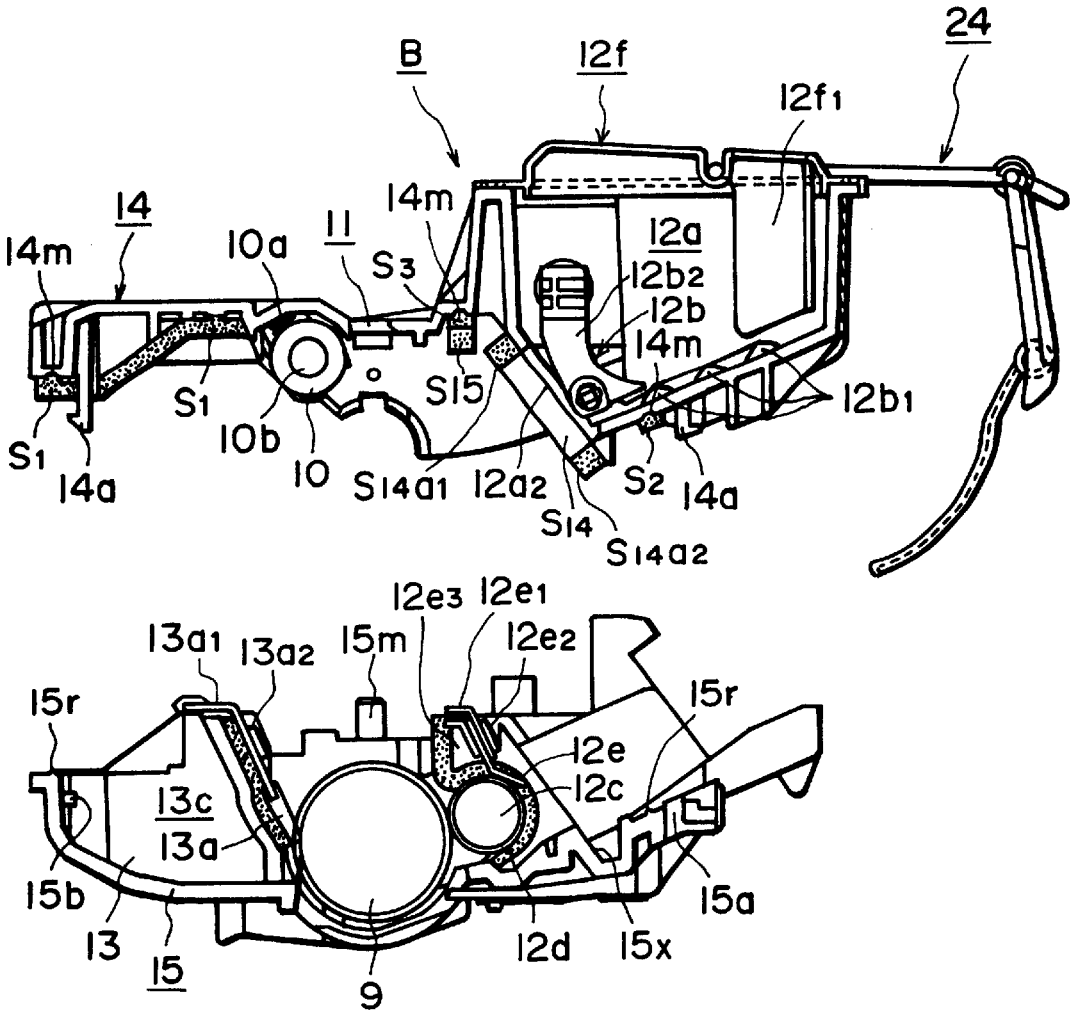
FIG. 38 is a longitudinal sectional view of the process cartridge which is divided into upper and lower frame members.

FIG. 37 is a perspective view of the inversely placed top frame 14, and shows the portions of the top frame 14, to which an opening edge seal, which will be described next, is pasted. In this drawing, the seal designated by a referential code S14 is the opening edge seal. The opening edge seal S14 is rectangular, and is approximately 5 mm in thickness. It is formed by punching a hole, which is approximately the same in shape and size as the toner supply opening 12*a*2, through a piece of rectangular plate, which is formed of a spongy substance or elastomer, for example, Moltprene (commercial name), is approximately 6 mm in thickness, is the same in shape as the toner supply opening 12*a*2, and is slightly larger than the toner supply opening 12*a*2. It is pasted to the edge of the toner supply opening 12*a*2, with the use of an adhering means such as double-sided adhesive tape, in a manner to surround the toner supply opening 12*a*2. Although it may not be clear in FIG. 37, the right end portion S14*a*3 of the toner supply opening edge seal S14, in terms of the lengthwise direction of the top frame 14, is sized so that it extends approximately 5 mm toward a corner seal S13 which has remained attached to the top frame 14, and will be described later. The toner supply opening edge seal S14 is for improving the airtightness between the top and bottom frames 14 and 15. To be described in more details the toner supply opening edge seal S14, as the top and bottom frames 14 and 15 are reattached to each other, the right and left end portions S14*a*3 and S14*a*4, respectively, of the toner supply opening edge seal S14, in terms of the lengthwise direction, come in contact with the fourth and fifth frame seals S8 and S9, which are on the bottom frame 15, improving the airtightness between the top and bottom frames 14 and 15, at their lengthwise ends (FIGS. 35 and 36). On the other hand, the top end portion S14*a*1 (bottom side in FIG. 37), and the bottom end portion S14*a*2 (top side in FIG. 37), in terms of the widthwise direction of the process cartridge B, come into contact with the blade supporting metallic plate 12*e*1 of the development blade 12*e*, and the tapered portion 15*x* of the bottom frame 15, respectively, also improving the airtightness between the top and bottom frames 14 and 15, as shown in FIG. 38. By the way, the toner supply opening edge seal S14 does not need to be a seal made by punching a hole in a rectangular piece of Moltprene or the like as described above. Instead, four separate seals corresponding, one for one, to the top, bottom, left and right edge portions S14*a*1, S14*a*2, S14*a*3, and S14*a*4 of the toner supply opening edge seal S14 may be pasted, one for one, to the four portions of the edge of the toner supply opening 12*a*2. In other words, what is important here is that a single or plurality of seals are pasted in a manner to completely surround the edge of the toner supply opening 12*a*2.

(Process for Pasting Sixth Frame Seal)

Next, the sixth frame seal will be described in detail. Referring to FIG. 37, a seal designated 5 by a referential code S15 is the sixth frame seal. The sixth frame seal S15 is approximately the same or slightly less in length than the third frame seal S3. It is approximately the same in cross section as the third frame seal S3, and is formed of spongy substance, for example, Moltprene (commercial name), or elastomer. As for the method for attaching the sixth frame seal S15, it is pasted over the preexisting third frame seal S3, with the use of an adhering means such as double-sided adhesive tape. This sixth frame seal S15 is for improving the airtightness between the top frame 15 and the blade supporting metallic plate 12*e*1 of the development blade 12*e*. In other words, it is a seal for improving the sealing performance of the third frame seal S3.

(Process for Pasting Top Corner Seal)

Referring to FIG. 37, the corner seal S13 is a preexisting corner seal, and is pasted astride the intersection between the lateral surface of the top frame 14, which has a toner filling hole, and the lateral surface of the top frame 14, which has the second frame seal S2. This toner filling hole is a hole of the top frame 14, through which developer is poured into the developer storage portion 12*a* of a process cartridge B when manufacturing the process cartridge B. Incidentally, a component designated by a referential code 12*a*3 in FIG. 37 is a lid for plugging the toner filling hole. The corner seal S13 is for supplementing the sealing function of the fourth frame seal S8.

In FIG. 37, a referential code S16 designates another corner seal in accordance with the present invention, which is also pasted to the top frame 14. As its name suggests, it is pasted over the aforementioned corner seal S13, with the use of an adhering means such as double-sided adhesive tape, to supplement the sealing function of the corner seal S13. In other words, the corner seal S16 improves the airtightness of the top and bottom frames 14 and 15, at their right ends, in terms of the lengthwise direction. The material for the corner seal S16 is the same as that for the above described seals, that is, spongy substance such as Moltprene (trade name), or elastomer.

(Process for Filling Toner)

Figure 39:
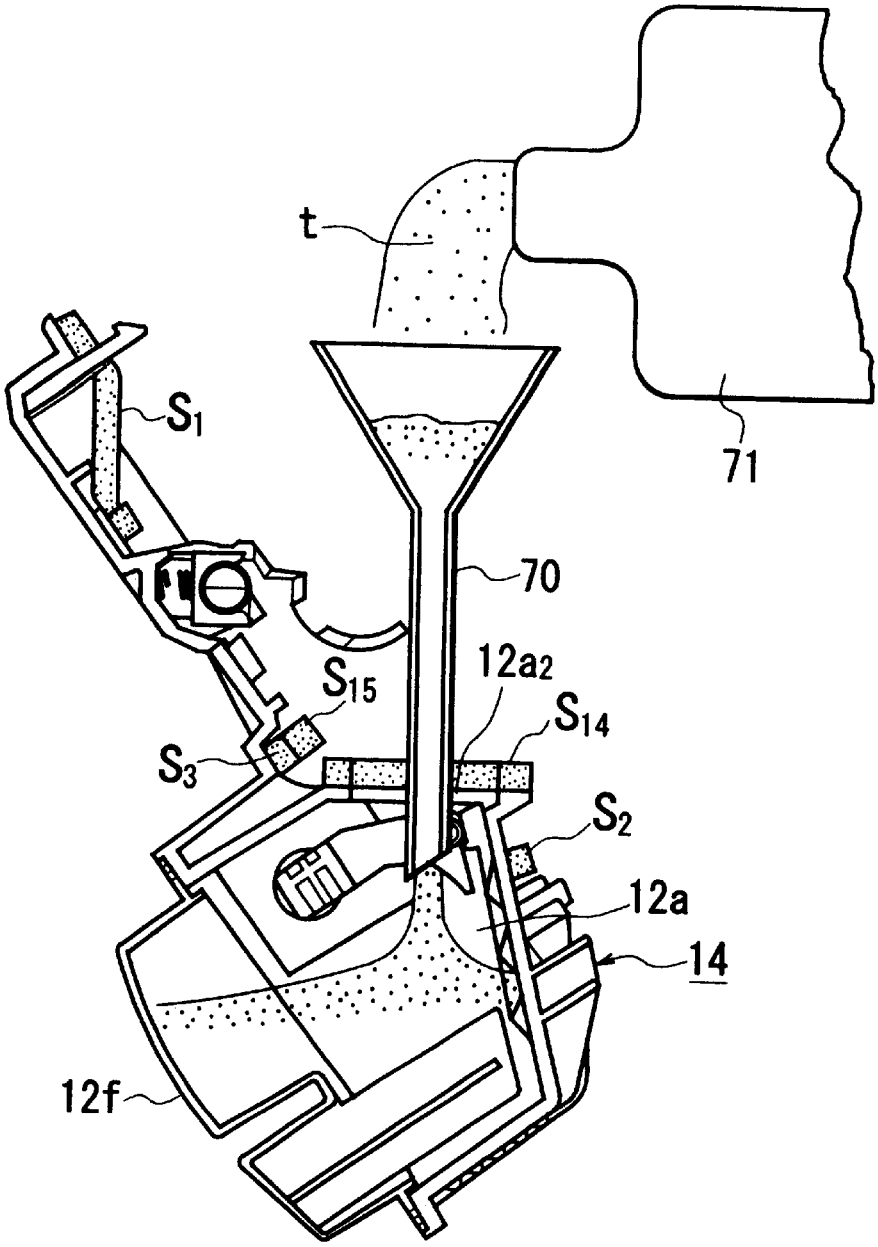
FIG. 39 is a longitudinal sectional view illustrating toner filling state into the upper frame.

Next, a method for filling toner into the developer storage portion 12*a* of the process cartridge B will be described with reference to the drawings. Referring to FIG. 39, in this toner filling process, the top frame 14 is held so that the toner supply opening 12*a*2 faces upward, and the developer storage portion 12*a* is placed on the bottom side. The tip portion of a funnel 70 is inserted into the opening 12*a*2, and toner t is poured into the funnel 70 from a toner bottle 71. By the way, employment of a funnel, the main section of which is provided with a fixed delivery apparatus having an auger, can improve toner refilling efficiency.

(Process for Reattaching Top and Bottom Frames)

Figure 40:
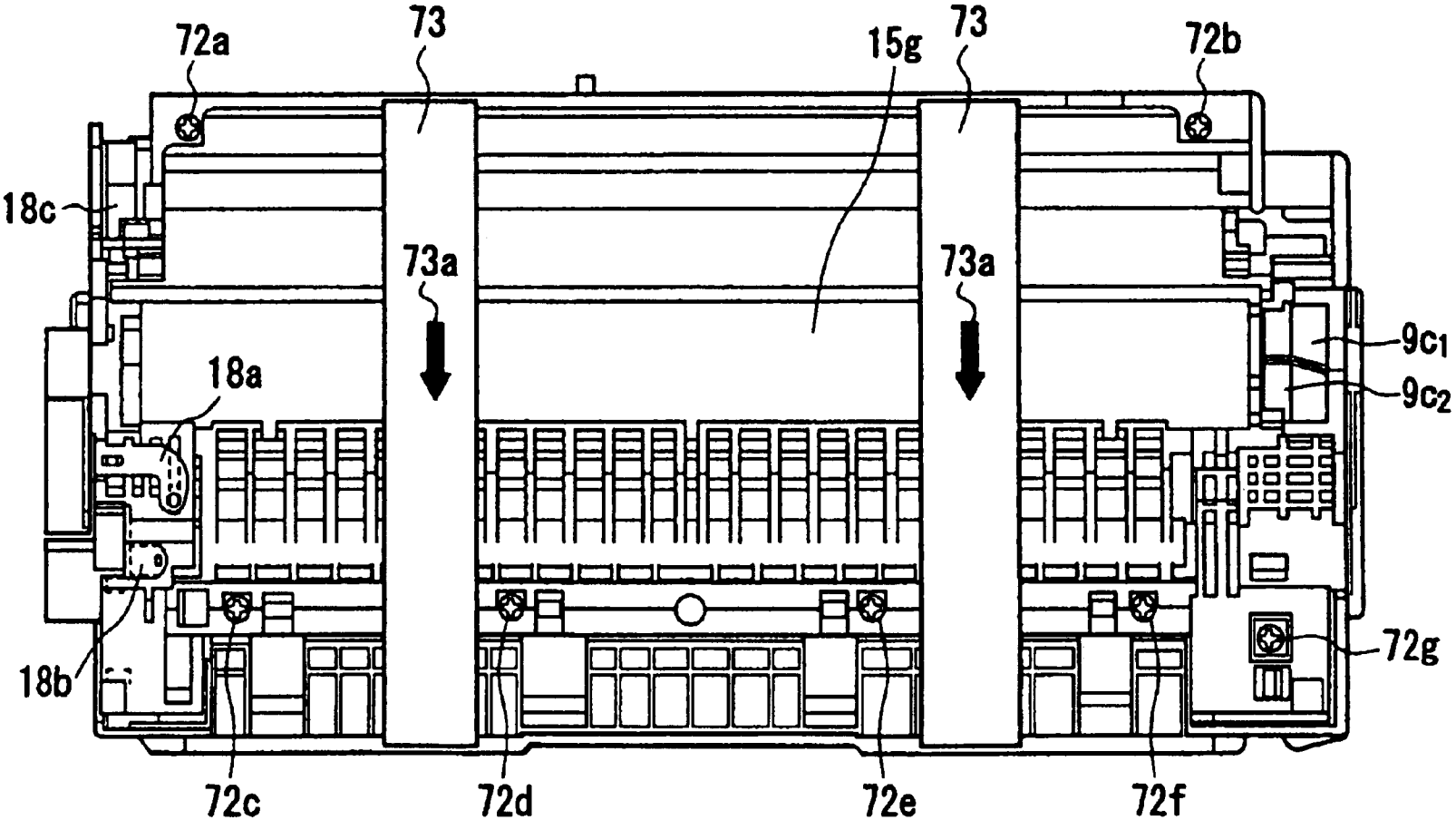
FIG. 40 is a bottom view of an outside of a process cartridge after the remanufacturing.
Figure 41:
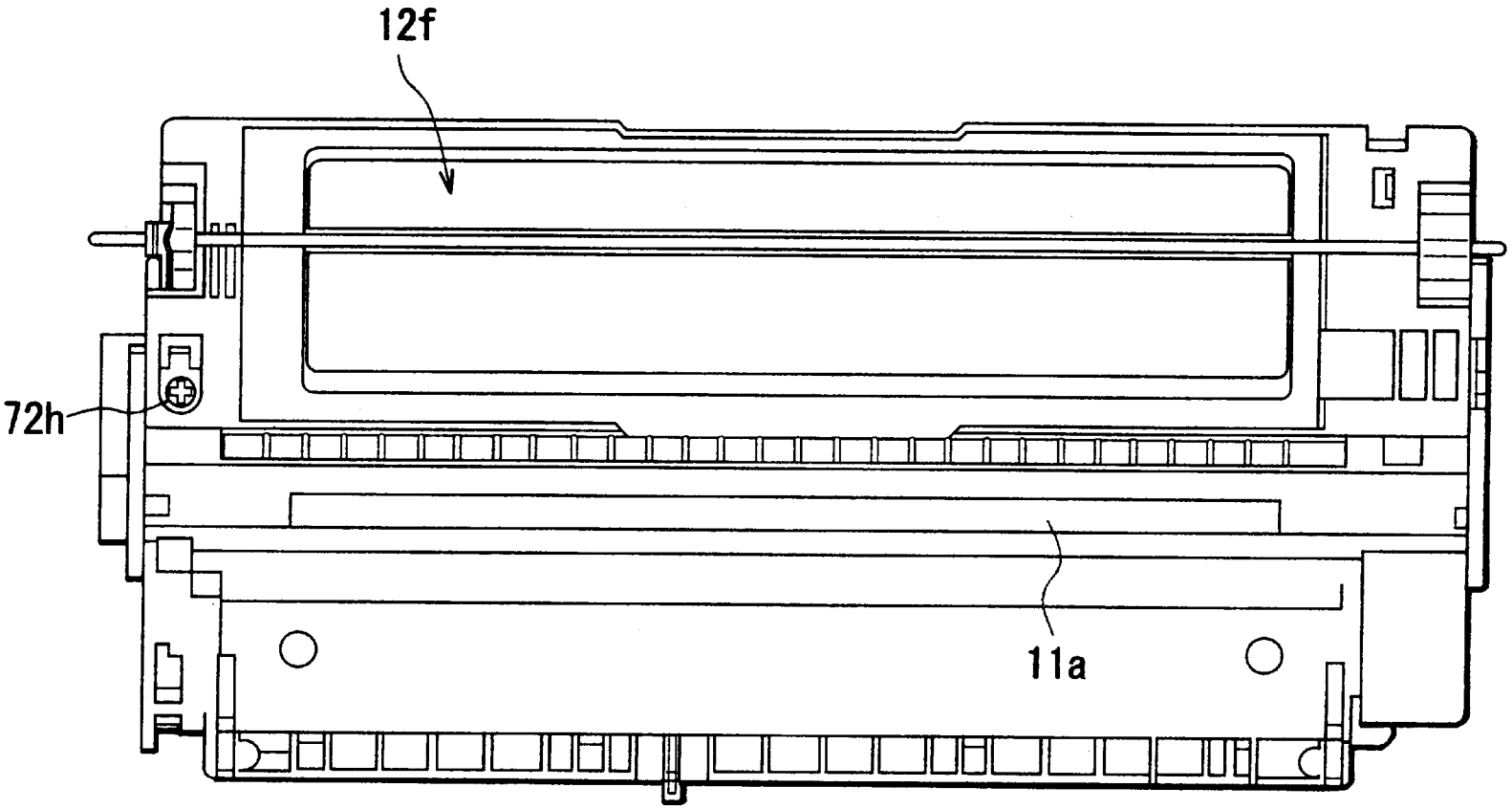
FIG. 41 is a top plan view of an outside of the process cartridge after remanufacturing.

The top and bottom frames 14 and 15, to which corresponding components have been reattached, are reattached to each other. Referring to FIG. 37, attaching the bottom frame 15 to the reversely placed top frame 14, from above, makes the reattachment easier, for the following reason. That is, in the remanufacture, the toner supply opening 12*a*2 is left open after the refilling of the developer storage portion 12*a*2 with toner. Therefore, it must be carefully handled. In other words, it should be moved as little as possible. In practice, the top frame 14 is set upside down on an cartridge reassembly table (unshown), and the bottom frame 15 is set on the upside down top frame 14 from above. Then, the fastening claws 14*a* of the top frame 14 are engaged into, or with, the fastening claw slots 15*a* and fastening claw catching projections 15*b* as described previously regarding the structures of the top and bottom frames 14 and 15. If some of the fastening claws 14*a* have been deformed or broken through the above described process for separating the top and bottom frames 14 and 15, the two frames may be reattached to each other with the use of screws. FIGS. 40 and 41 show a remanufactured process cartridge, the top and bottom frames of which have been fastened to each other with the use of screws, instead of the fastening claws 14*a* and fastening claw slots 15*a*. Referring to FIG. 40, instead of engaging the fastening claws 14*a* into the fastening claw slots 15*b* on the cleaning means 13 side, screws 72*a* and 72*b* are put through the holes of the frame alignment recesses 15*e* (FIG. 7) of the bottom frame 15, and screwed into the frame alignment projections 14*d* (FIG. 8) of the top frame 14, located at the lengthwise ends, and also, instead of engaging the fastening claws 14*a* into fastening claw slot 15*a* on the developing means 12 side, screws 72*c*, 72*d*, 72*e*, and 72*f* are screwed into the screw holes 14*a*1 of the top frame 14. Further, instead of the fastening claw 14*e*3 shown in FIG. 18 extending into the fastening claw slot 15*f*3 shown in FIG. 17, a screw 72*g* is put through the hole of the frame alignment recess 15*f*2 of the bottom frame 15, in the adjacencies of the fastening claw slot 15*d*, and is screwed into the hole of the frame alignment projection 14*e*2 of the top frame 14, which is also called a fastening claw catching projection. Moreover, instead of engaging the fastening claw 14*c* into the fastening claw slot 15*d*, a screw 72*h* is put through the hole of the frame alignment recess 14*e*1 of the top frame 14, in the adjacencies of the fastening claw 14*c*, and is screwed into the hole of the frame alignment projection 15*f*1 of the bottom frame 15.

It is not necessary to entirely replace the fastening claws 14*a*, fastening claw slots 15*d*, and fastening claw catching projection 15*b*, with the screws; only the fastening claws 14*a*, which had become unusable due to deformation and/or breakage, may be replaced with screws as necessary.

(Process for Pasting Tape)

Figure 42:
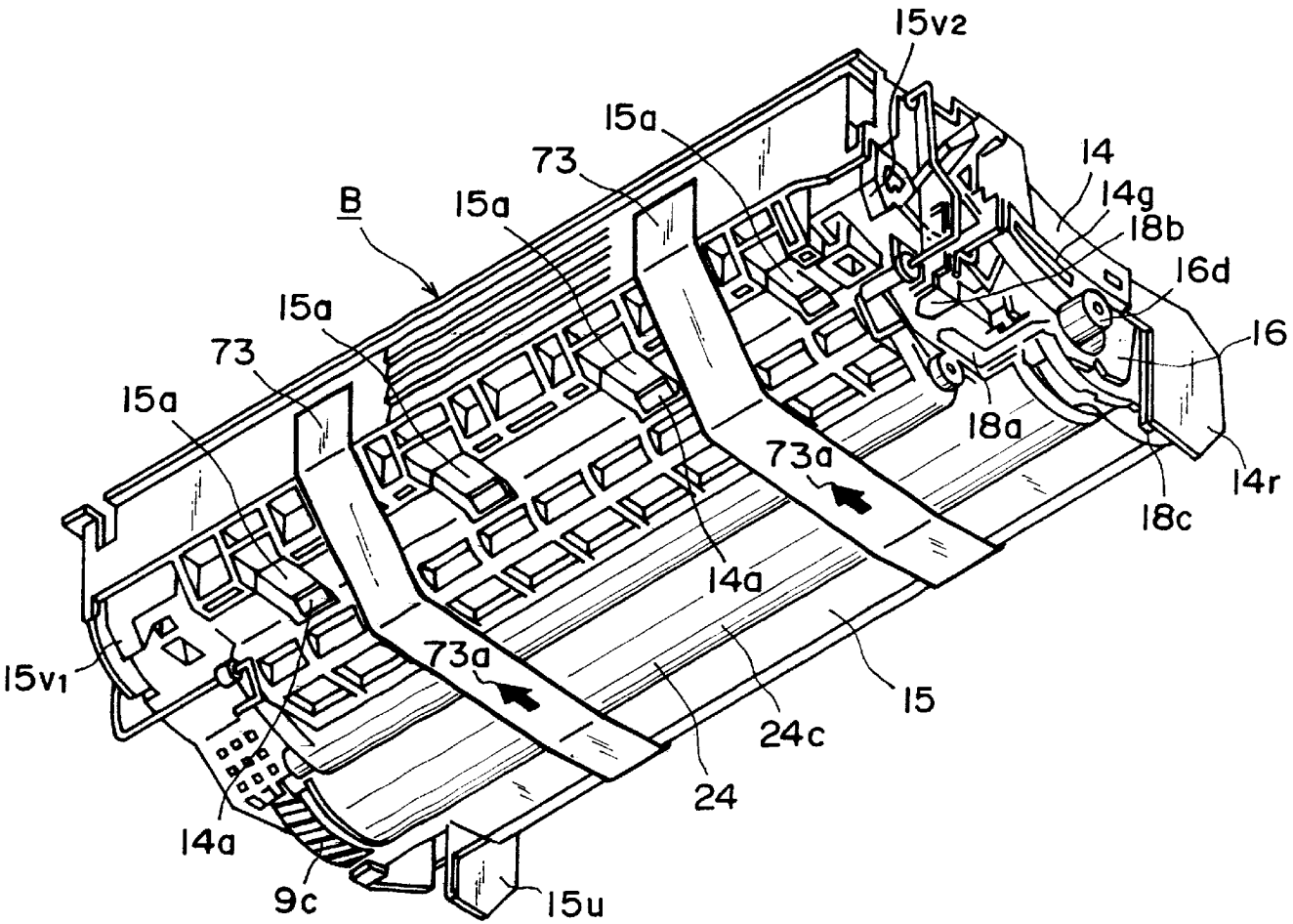
FIG. 42 is a perspective view of an outer appearance of the process cartridge upside-down, after the remanufacturing.

Next, pasting of a peelable tape will be described. It is as described above that during transportation, a process cartridge is subjected to much harsher vibrations and/or impacts than those to which a process cartridge is subjected during the normal usage by a user. Thus, there is a possibility that the edge portion 15*w* of the bottom frame 15, which is below the development roller 12*d*, deforms due to the vibrations and/impacts which occur during the transportation of a remanufactured process cartridge B, and allows toner to leak. To describe a solution to this problem in more detail, the edge portion 15*w* is provided with the blow-by prevention seal 12*m*, which had been pasted to the edge portion 15*w* as described previously (FIG. 20). Even if the edge portion 15*w* deforms toward the development roller 12*d* due to the vibrations and/or impacts, the only thing which will happen is that the contact pressure which the blow-by prevention sheet 12*m* exerts upon the development roller 12*d* increases. Therefore, toner does not leak. However, it is not only toward the development roller 12*d* that the edge portion 15*w* deforms, the edge portion 15*w* also deforms away from the development roller 12*d*. Even if the edge portion 15*w* deforms away from the development roller 12*d*, the blow-by prevention sheet 12*m* is kept in contact with the development roller 12*d*, by the elasticity of the blow-by prevention sheet 12*m*. However, if vibrations and/impacts of a larger magnitude, which seldom occur, happen to occur, there is a possibility that the blow-by prevention sheet 12*m* temporarily becomes separated from the development roller 12*d*, or the contact pressure between the blow-by prevention sheet 12*m* and development roller 12*d* is temporarily reduced by a substantial amount, and allows toner to leak from between the development roller 12*d* and blow-by prevention sheet 12*m*. Thus, in this embodiment, after the process for reattaching the top and bottom frames 14 and 15, two strips of peelable tape 73 are pasted across the exterior surface of the bottom frame 15, the exterior surface of the shutter portion 24*c*, and the exterior surface of the top frame 14, as shown in FIGS. 40 and 42, to prevent toner from leaking, by preventing the edge portion 15*w* from deforming toward the development roller 12*d*.

To describe this structure in more detail, the end of the shutter portion 24*c* of the drum shutter mechanism 24, in terms of the widthwise direction, is in contact with, or close to, the exterior surface of the edge portion 15*w*. Therefore, as the edge portion 15*w* deforms away from the development roller 12*d*, the exterior surface of the edge portion 15*w*comes into contact with the end of the shutter portion 24*c* in terms of the widthwise direction, and causes the shutter portion 24*c* to deform. Thus, reinforcing the shutter portion 24*c* so that it does not deform away from the development roller 12*d* inevitably prevents the deformation of the edge portion 15*w*. Accordingly, in this embodiment, two strips of peelable tape 73 are pasted across the exterior surface of the bottom frame 15, the exterior surface of the shutter portion 24*c*, and the exterior surface of the top frame 14, as shown in FIGS. 40 and 42, in a manner to divide the process cartridge B into three approximately equal sections, as shown in FIGS. 40 and 43, to reinforce the shutter portion 24*c* so that it does not deform away from the development roller 12*d*. It is essential that the peelable tape 73 is pasted without leaving any slack; with the presence of slack, the pasted peelable tape 73 cannot prevent the deformation of the shutter portion 24*c*, and therefore, the peelable tape 73 should be pasted while providing the peelable tape 73 with a proper amount of tension. As for the material for the peelable tape 73, it is desired to be as low as possible in stretchability, and also to be as wide as possible, within reason, to increase its tensile strength. Further, in consideration of the fact that it must be peeled, as will be described later, when the process cartridge is put to use, it is desired to be easy to peel, and not to leave adhesive behind. According to the present invention, the peelable tape 73 is approximately 20 mm wide, and is a laminar combination of a base film of polyester, polyester fibers, or glass fibers, coated thereon, and adhesive belonging to the rubber group. Although not shown in the drawings, one of the lengthwise ends of the peelable tape 73 is folded back, by a short length, being pasted to itself to provided the peelable tape 73 with a portion which does not adhere to the bottom frame 14 or top frame 15. This nonadhesive portion, or the portion which was not adhered to a remanufactured process cartridge, of the peelable tape 73 serves as a portion to be grasped by a user when the user peels the peelable tape 73. Although the peelable tapes 73 are necessary during the transportation of a remanufactured process cartridge, they get in the way when printing an image after the mounting of the process cartridge B into the image forming apparatus A. Therefore, the peelable tapes 73 must be removed by the user. Thus, in order to urge the user to peel the peelable tapes 73 by grasping the nonadhesive portions, before mounting the process cartridge B into the image forming apparatus A, an unshown warning label is pasted to a conspicuous portion of the process cartridge B. Further, an arrow mark 73*a* showing the peeling direction is provided on each of the peelable tape 73, to prevent the user from forgetting to remove the peelable tapes 73, and also to improve the usability of the process cartridge B. In FIGS. 40 and 42, two pieces of peelable tape 73 are shown, being pasted across two locations, one for one. However, the number of the locations to which the peelable tape 73 is pasted does not need to be limited to two; it may be only one in the center, or three or more if necessary. Further, the tape width as well as the tape type do not need to be limited to those described above.

The processes described above are the essential processes in "process cartridge remanufacture" in accordance with the present invention. However, those described above are examples of the essential processes in only one of the many process cartridge remanufacturing methods in accordance with the present invention, and the processes and methods for process cartridge remanufacture do not need to be limited to those described above. Hereinafter, the descriptions given above regarding the process cartridge remanufacturing method in accordance with the present invention will be supplemented so that the process cartridge remanufacturing method in accordance with the present invention will be accurately understood.

First, in the preceding descriptions, the (Disassembly of Top Half of process Cartridge) was described after the (Disassembly of Bottom Half of process Cartridge). However, this does not mean that the top frame is always disassembled after the disassembly of the bottom frame. In other words, since the top and bottom frames are not in contact with each other after the (process for Separating Top Frame from Bottom Frame), the top and bottom halves of the process cartridge B can be independently disassembled. Thus, both portions may be disassembled at the same time; obviously, either the top portion may be disassembled after the bottom portion, or the bottom portion may be disassembled after the top portion. The same is true for the reassembly of the top and bottom portions of a process cartridge. In other words, the top and bottom portions can be independently reassembled. Thus, the two portions may be reassembled at the same time. Obviously, either the top portion may be reassembled after the assembly of the bottom portion, or the bottom portion may be reassembled after the top portion.

Secondly, when remanufacturing a process cartridge, there is no assurance that each component is reattached to the frame from which it was detached during the disassembly (it may be attached to the frame from which it was detached, which is obvious). To describe in more detail, for example, even if a photoconductive drum, a development roller, and a cleaning blade, from the same or different bottom frames, are all determined to be recyclable through inspections, there is no guarantee that they will be reattached to the particular bottom frame, or frames, from which they are detached. In other words, in a case in which a process cartridge is remanufactured on an assembly line, the cleaning blades, for example, removed from the bottom frames are placed together, by a certain number, in a tote box or the like, are cleaned with pressurized air, and are delivered to the portion of the assembly line, at which the blades are reattached. Therefore, each cleaning blade is not necessary reattached to the very bottom frame from which it was detached. As long as the cleaning blades are from the image forming apparatuses of the same type, they all are the same in shape, admitting that there are a certain amount of differences in size among them due to production errors. Therefore, it is not mandatory that each cleaning blade is to be attached to the very bottom frame to which it was attached. The same is true for a development roller and a photoconductive drum. This is also true for a charge roller, which was removed from a top frame; it does not need to be reattached to the top frame on which it was. Moreover, for the same reason, there is no assurance that a top frame and a bottom frame will be reattached to the bottom and top frame, respectively, from which they were detached, and also, there is no need for them to be.

In addition, the various processes in the above described embodiment may be automated as necessary with the use of robots, which is obvious. Not only is a process cartridge in accordance with the present invention applicable to an image forming apparatus for forming a monochromatic image as described above, but it also is applicable, with preferable results, to an image forming apparatus, which is provided with a plurality of developing means 12, and is capable of producing a multicolor image (for example, a dichromatic image, a trichromatic image, a full-color image, or the like). Regarding the charging means structure, in the above described embodiment, a so-called contact type charging method was employed. However, other conventional structures which have been widely used, for example, a structure in which a piece of tungsten wire is surrounded on three sides by a metallic shield such as an aluminum shield, and positive or negative ions generated by applying high voltage to the tungsten wire are transferred onto the peripheral surface of a photoconductive drum to uniformly charge the peripheral surface of the photoconductive drum, may be employed, which is obvious. There are many other charging means compatible with the present invention, in addition to the above described roller type; for example, a blade type (charge blade), a pad type, a block type, a rod type, a wire type, and the like. Further, regarding the cleaning method for removing the toner particles remaining on a photoconductive drum, a magnetic brush or the like may be used as the cleaning means. The aforementioned process cartridge B is a cartridge in which an image bearing member and a developing means are integrally disposed, and which is removably mountable in the main assembly of an image forming apparatus, or a cartridge in which charging means, a developing means or a cleaning means, and an electrophotographic photoconductive member, are integrally disposed, and which is removably mountable in the image forming apparatus main assembly. Further, the image forming apparatus B also refers to a cartridge in which a minimum of a developing means and an electrophotographic photoconductive member are integrally disposed, and which is removably mountable in the image forming apparatus main assembly. Further, in the preceding description of the embodiment of the present invention, a laser printer was described as an example of an image forming apparatus. However, the application of the present invention does not need to be limited to a laser beam printer. Rather, the present invention is also applicable to image forming apparatuses other than a laser beam printer; for example, an LED printer, an electrophotographic copying machine, a facsimile apparatus, and a word processor, which is obvious.

The above described embodiment includes a process cartridge remanufacturing method in which, used process cartridges are recovered and disassembled; the components removed by the disassembly from the recovered process cartridges are sorted into different component groups of the same components; and a process cartridge is remanufactured using the components from the groups of sorted components, and the above described remanufacturing method, except that the components unsuitable for recycling, for example, those components, the service lives of which had expired, or which had been damaged, are replaced with new components. It also includes a process cartridge remanufacturing method in which, used process cartridges are recovered and disassembled; the components removed by the disassembly from the recovered process cartridges are sorted into different component groups of the same components; and a process cartridge is remanufactured using the components from the groups of sorted components, and the above described remanufacturing method, except that the components unsuitable for recycling, for example, those components, the service lives of which had expired, or which had been damaged, are replaced with new components, or the recyclable components removed from other process cartridges.

The present invention includes any of the following cases:

(1) a process cartridge is remanufactured using only the components removed from a single, that is, the same, used process cartridge;

(2) a process cartridge is remanufactured using the components removed from a single used process cartridge, except that the components unsuitable for recycling, for example, those, the service lives of which had expired, or which had been damaged, are replaced with new ones, or the recyclable components removed from other used process cartridges;

(3) a process cartridge is remanufactured using a pool of recyclable groups' of the same components removed from a plurality of used process cartridges; and (4) a process cartridge is remanufactured using a pool of recyclable groups of the same components from a plurality of used process cartridges, except that the components undesirable for recycling, for example, those, the service lives of which had expired, or which has been damaged, are replaced with new ones.

In the immediately preceding paragraph, the term "components" refers to such components which make up a cartridge having the structure disclosed in claims Section. They includes a relatively large unit comprising a certain number of "components," as well as each component, that is, the smallest unit to which a process cartridge can be disassembled.

As described above, the present invention provides a simple method for remanufacturing a process cartridge.

While the invention has been described with reference to the structures disclosed herein, it is not confined to the details set forth and this application is intended to cover such modifications or changes as may come within the purpose of the improvements or the scope of the following claims.

What is claimed is:

1. A remanufacturing method for a process cartridge detachably mountable to a main assembly of an electrophotographic image forming apparatus, comprising:

(a) a frame separating step of separating a process cartridge into a lower frame member having an electrophotographic photosensitive drum, a developing roller for developing an electrostatic latent image formed on said photosensitive drum and a cleaning blade for removing a developer remaining on said photosensitive drum, and an upper frame having a charging roller for electrically charging said photosensitive drum and a developer accommodating portion for accommodating a developer to be used for developing the electrostatic latent image;

(b) a photosensitive drum dismounting step of dismounting said photosensitive drum from said lower frame member by removing from said lower frame member a supporting member provided at one and the other longitudinal ends of the photosensitive drum;

(c) a developing roller dismounting step of dismounting said developing roller from said lower frame member;

(d) a magnetic seal sticking step of sticking magnetic seals on said lower frame member along a direction crossing with a longitudinal direction of said developing roller such that they are opposed to parts of a peripheral surface of said developing roller, and are disposed at one and the other longitudinal ends of said developing roller, respectively, when said developing roller is mounted to said lower frame member, wherein there is provided a gap between an outer surface of a stuck magnetic seal and a part of a peripheral surface of said developing roller;

(e) an elastic member sticking step of sticking a blade elastic member at each of one and the other longitudinal ends of a developing blade on its backside which is opposite from a side opposed to said developing roller, said developing blade being effective to regulate an amount of the developer deposited on the peripheral surface of said developing roller;

(f) a developing roller mounting step of mounting said developing roller onto said lower frame member;

(g) a photosensitive drum mounting step of mounting said photosensitive drum to said lower frame member by inserting said photosensitive drum into said lower frame member and mounting said supporting member to an outside of said lower frame member at said one and other longitudinal ends;

(h) a developer filling step of refilling the developer into said developer accommodating portion in said upper frame; and (i) a frame coupling process of connecting the upper frame into which the developer has been refilled with the lower frame member having said blade elastic member on the backside of said developing blade, said magnetic seal, said developing roller and said photosensitive drum which have been remounted.

2. A remanufacturing method according to claim 1, wherein said magnetic seal is stuck on an inner surface of a side wall of said lower frame member in said magnetic seal sticking step.

3. A remanufacturing method according to claim 1 or 2, wherein said developing blade includes an elastic rubber and a metal plate supporting said elastic rubber, and in said elastic member sticking step, said blade elastic member is stuck on the elastic rubber such that it is contacted to a longitudinally extending end surface of said metal plate, and is contacted to a side surface thereof which is opposite from a side surface having a sealing member stacked on said lower frame member such that one surface contacts said developing blade and said developing roller.

4. A remanufacturing method according to claim 3, wherein said magnetic seal sticking step is carried out prior to said elastic member sticking, or said elastic member sticking step is carried out prior to said magnetic seal sticking step.

5. A remanufacturing method for a process cartridge detachably mountable to a main assembly of an electrophotographic image forming apparatus, comprising:

(a) a frame separating step of separating a process cartridge into a lower frame member having an electrophotographic photosensitive drum, a developing roller for developing an electrostatic latent image formed on said photosensitive drum and a cleaning blade for removing a developer remaining on said photosensitive drum, and an upper frame having a charging roller for electrically charging said photosensitive drum and a developer accommodating portion for accommodating a developer to be used for developing the electrostatic latent image;

(b) a photosensitive drum dismounting step of dismounting said photosensitive drum from said lower frame member by removing from said lower frame member a supporting member provided at one and the other longitudinal ends of the photosensitive drum;

(c) a developing roller dismounting step of dismounting said developing roller from said lower frame member;

(d) an opening edge seal sticking step of sticking a sealing member along an edge of a supply opening of said developer accommodating portion for permitting supply of the developer to said developing roller from said developer accommodating portion provided in said upper frame, such that said sealing member encloses said supply opening;

(e) a frame seal sticking step of overlaying and sticking another frame seal on such a surface of a frame seal as contacts a metal plate portion of a developing blade, said frame seal having been stuck on said upper frame along a longitudinal direction of said supply opening and being in contact with the metal plate portion of said developing blade along its longitudinal direction when said upper frame and said lower frame member are coupled;

(f) an elastic seal sticking step of overlaying and sticking another elastic seal on an elastic seal which has been stuck on said upper frame over such a side surface of said upper frame as is provided with a filling port for filling the developer into said developer accommodating portion provided in said upper frame and a side crossing with said side surface, wherein said filling port is provided to permit the developer to be filled when said process cartridge is first manufactured;

(g) a developing roller mounting step of mounting said developing roller to said lower frame member;

(h) a photosensitive drum mounting step of mounting said photosensitive drum to said lower frame member by inserting said photosensitive drum into said lower frame member and mounting said supporting member to an outside of said lower frame member at said one and other longitudinal ends;

(i) a developer filling step of refilling the developer into said developer accommodating portion provided in said upper frame; and (j) a frame coupling process of coupling said lower frame member with said upper frame in which the developer has been refilled.

6. A remanufacturing method for a process cartridge detachably mountable to a main assembly of an electrophotographic image forming apparatus, comprising:

(a) a frame separating step of separating a process cartridge into a lower frame member having an electrophotographic photosensitive drum, a developing roller for developing an electrostatic latent image formed on said photosensitive drum and a cleaning blade for removing a developer remaining on said photosensitive drum, and an upper frame having a charging roller for electrically charging said photosensitive drum and a developer accommodating portion for accommodating a developer to be used for developing the electrostatic latent image;

(b) a photosensitive drum dismounting step of dismounting said photosensitive drum from said lower frame member by removing from said lower frame member a supporting member provided at one and the other longitudinal ends of the photosensitive drum;

(c) a developing roller dismounting step of dismounting said developing roller from said lower frame member;

(d) a magnetic seal sticking step of sticking magnetic seals on said lower frame member along a direction crossing with a longitudinal direction of said developing roller such that they are opposed to parts of a peripheral surface of said developing roller, and are disposed at one and the other longitudinal ends of said developing roller, respectively, when said developing roller is mounted to said lower frame member, wherein there is provided a gap between an outer surface of the stuck magnetic seal and a part of a peripheral surface of said developing roller;

(e) an elastic member sticking step of sticking a blade elastic member at one and the other longitudinal ends of a developing blade on a backside which is opposite from a side opposed to said developing roller, said developing blade being effective to regulate an amount of the developer deposited on the peripheral surface of said developing roller;

(f) an opening edge seal sticking step of sticking a sealing member along an edge of a supply opening of said developer accommodating portion so as to enclose said supply opening for permitting supply of the developer to said developing roller from said developer accommodating portion provided in said upper frame;

(g) a frame seal sticking step of overlaying and sticking another frame seal on such a surface of a frame seal as contacts a metal plate portion of said developing blade, said frame seal having been stuck on said upper frame along a longitudinal direction of said supply opening and being in contact with the metal plate portion of said developing blade along its longitudinal direction when said upper frame and said lower frame member are coupled;

(h) an elastic seal sticking step of overlaying and sticking another elastic seal on an elastic seal which has been stuck on said upper frame over such a side surface of said upper frame as is provided with a filling port for filling the developer into said developer accommodating portion provided in said upper frame and a side crossing with said side surface, wherein said filling port is provided to permit the developer to be filled when said process cartridge is first manufactured;

(i) a developing roller mounting step of mounting said developing roller to said lower frame member;

(j) a photosensitive drum mounting step of mounting said photosensitive drum to said lower frame member by inserting said photosensitive drum into said lower frame member and mounting said supporting member to an outside of said lower frame member at said one and other longitudinal ends;

(k) a developer filling step of refilling the developer into said developer accommodating portion in said upper frame; and (l) a frame coupling process of connecting an upper frame into which the developer has been refilled with a lower frame member having said blade elastic member on the backside of said developing blade, said magnetic seal, said developing roller and said photosensitive drum which have been remounted.

7. A remanufacturing method according to claim 6, wherein said opening edge seal, said another frame seal and said another elastic seal are made of sponge or elastomer.

8. A remanufacturing method according to claim 7, wherein said opening edge seal sticking step is carried out prior to said frame seal sticking step and said elastic seal sticking step, or said frame seal sticking step is carried out prior to said opening edge seal sticking step and said elastic seal sticking step, or said frame seal sticking step and said elastic seal sticking step are carried out prior to said opening edge seal sticking step.

9. A remanufacturing method according to claim 8, wherein in said elastic seal sticking step, a part of said another elastic seal is stuck so as not to be overlaid on said elastic seal having been stuck.

10. A remanufacturing method according to claim 9, wherein said magnetic seal is stuck on an inner surface of a side wall of said lower frame member in said magnetic seal sticking step.

11. A remanufacturing method according to claim 10, wherein developing blade includes an elastic rubber and a metal plate supporting said elastic rubber, and in said elastic member sticking step, said blade elastic member is stuck on said elastic rubber such that it is contacted to a longitudinally extending end surface of said metal plate, and is contacted to a side surface thereof which is opposite from a side surface having said sealing member stuck on said lower frame member such that one surface is contacted to said developing blade and said developing roller.

12. A remanufacturing method according to claim 5 or 6, wherein in said frame separating step, a claw provided on the upper frame is disengaged from a locking portion provided in said lower frame member, or a screw fastening said upper frame and said lower frame member is removed, to separate said process cartridge in the upper frame and said lower frame member.

13. A remanufacturing method according to claim 5 or 6, wherein in said frame coupling process, said upper frame and said lower frame member are coupled entirely or partly by screws.

14. A remanufacturing method according to claim 5 or 6, wherein in said developer filling step, the developer is refilled through said supply opening for supplying the developer to said developing roller from said developer accommodating portion provided in said upper frame.

15. A remanufacturing method according to claim 5 or 6, wherein a cleaning blade dismounting step is carried out before or after said photosensitive drum dismounting step, and a cleaning blade mounting step is carried out before or after said photosensitive drum mounting step.

16. A remanufacturing method according to claim 5 or 6, wherein said photosensitive drum is a new electrophotographic photosensitive drum, said developing roller is a new developing roller, or said cleaning blade is a new cleaning blade.

17. A remanufacturing method according to claim 16, wherein said developing roller is a developing roller removed from a lower frame member dismounted from another process cartridge.

18. A remanufacturing method according to claim 17, wherein said developing roller is a developing roller dismounted from a lower frame member dismounted from another process cartridge.

19. A remanufacturing method according to claim 18, wherein said cleaning blade is a cleaning blade dismounted from a lower frame member of another process cartridge.

20. A remanufacturing method according to claim 5 or 6, wherein said upper frame and/or said lower frame member are those of another or other process cartridges.

21. A remanufacturing method according to claim 5 or 6, further comprising a tape sticking step of sticking, after said frame coupling process, a removable tape over an outer surface of said lower frame member, an outer surface of a drum shutter for covering a portion through which said photosensitive drum is exposed from said lower frame member, and an outer surface of said upper frame.

22. A remanufacturing method according to claim 21, wherein in said tape sticking step, said removable tape is stuck at such two positions as to trisect said lower frame member, said drum shutter and said upper frame in the longitudinal direction.

23. A remanufacturing method according to claim 22, wherein the tape used in said tape sticking step comprises polyester film as a base material.

24. A remanufacturing method according to claim 22, wherein in said tape sticking step, said tape is stuck with tension applied thereto.

25. A remanufacturing method according to claim 5, wherein said opening edge seal, said another frame seal and said another elastic seal are made of sponge or elastomer.

26. A remanufacturing method according to claim 25, wherein said opening edge seal sticking step is carried out prior to said frame seal sticking step and said elastic seal sticking step, or said frame seal sticking step is carried out prior to said opening edge seal sticking step and said elastic seal sticking step, or said frame seal sticking step and said elastic seal sticking step are carried out prior to said opening edge seal sticking step.

27. A remanufacturing method according to claim 26, wherein in said elastic seal sticking step, a part of said another elastic seal is stuck so as not to be overlaid on said elastic seal having been stuck.

28. A remanufacturing method according to claim 27, wherein a magnetic seal is stuck on an inner surface of a side wall of said lower frame member in a magnetic seal sticking step.

29. A remanufacturing method according to claim 28, wherein said developing blade includes an elastic rubber and a metal plate supporting said elastic rubber, and in an elastic member sticking step, a blade elastic member is stuck on said elastic rubber such that it is contacted to a longitudinally extending end surface of said metal plate, and is contacted to a side surface thereof which is opposite from a side surface having a sealing member stuck on said lower frame member such that one surface is contacted to said developing blade and said developing roller.

* * * * *

UNITED STATES PATENT AND TRADEMARK OFFICE

CERTIFICATE OF CORRECTION

PATENT NO. : 6,721,520 B2
DATED : April 13, 2004
INVENTOR(S) : Akira Higeta et al.

It is certified that error appears in the above-identified patent and that said Letters Patent is hereby corrected as shown below:

Column 2,
Line 17, “end” should read -- ends --
Line 32, “end;” should read -- ends; --.

Column 7,
Line 9, “Heater 17b” should read -- heater 7b --.

Column 8,
Line 39, “means IO,” should read -- means 10, --.

Column 9,
Lines 48 and 50, “above described” should read -- above-described --.

Column 10,
Lines 44 and 49, “above described” should read -- above-described --.

Column 12,
Line 32, “above described” should read -- above-described --.

Column 13,
Line 24, “of” should be deleted.

Column 14,
Line 39, “plurality” should read -- plurality --.

Column 17,
Lines 9 and 11, “above described” should read -- above-described --.
Line 24, “double-side” should read -- double-sided --.

Column 18,
Line 35, “above described” should read -- above-described --.

Column 19,
Line 58, “not” should read -- no --.

Column 20,
Line 9, “above described” should read -- above-described --.

UNITED STATES PATENT AND TRADEMARK OFFICE

CERTIFICATE OF CORRECTION

PATENT NO. : 6,721,520 B2
DATED : April 13, 2004
INVENTOR(S) : Akira Higeta et al.

It is certified that error appears in the above-identified patent and that said Letters Patent is hereby corrected as shown below:

Column 21,
Line 43, “recesses” should read -- recesses or grooves --.
Line 57, “positioned. ¶” should read -- positioned. ¶ --.
-- Also referring to Figure 15, the other lengthwise end of the magnetic roll 12c, that is, the end which is not supported by the bearing member 16, is supported in the recess of the developer roller flange 12k. The external diameter of this lengthwise end of the magnetic roll 12c is rendered slightly smaller than the internal diameter of the recess. Thus, on the development roller flange 12k side of the bottom frame 15, the magnetic roll 12c is supported in the recess, with the presence of some play, resting on the bottom side of the wall of the recess because of its own weight, or being kept in contact with the portion of the recess wall, corresponding to the position of the blade supporting metallic plate 12e found of magnetic metallic plate such as zinc plated steel plate, by the magnetic force of the magnetic roll 12c. Providing some play between the development roller flange 12k and magnetic roll 12c reduces the friction between the magnetic roll 12c, and the wall of the recess of the development roller flange 12k, on which the magnetic roll 12c rotationally slides, reducing thereby the torque necessary to driving the process cartridge B. --.

Column 22,
Line 6, “tap” should read -- tape --.

Column 23,
Line 16, “S2” (second occurrence) should read -- S3 --.
Line 42, “to” should be deleted.
Line 56, “above described” should read -- above-described --.

Column 24,
Line 60, “14t” should read -- 14q --.

Column 26,
Line 31, “5d” should read -- 5d, --.

Column 27,
Line 17, “above described” should read -- above-described --.
Line 27, “reduce.” should read -- decrease. --.

UNITED STATES PATENT AND TRADEMARK OFFICE

CERTIFICATE OF CORRECTION

PATENT NO. : 6,721,520 B2
DATED : April 13, 2004
INVENTOR(S) : Akira Higeta et al.

It is certified that error appears in the above-identified patent and that said Letters Patent is hereby corrected as shown below:

Column 29,
Line 60, “taped” should read -- tape --.

Column 30,
Line 37, “a” should be deleted.
Line 39, “above” should read -- above- --.
Line 41, “above described” should read -- above-described --.
Line 43, “S3” should read -- S3, -- and “S4” should read -- S5, --.
Line 44, “S5” should read -- S5, --.
Line 46, “S6” should read -- S6, -- and “S7” should read -- S7, --.
Line 64, “S2” should read -- S2, --.
Line 65, “S3” should read --S3,-- and “S4” should read -- S4, --.

Column 31,
Line 9, “S5” should read -- S5, --.
Line 26, “double-side” should read -- double-sided --.

Column 32,
Lines 3, 13 and 22, “above described” should read -- above-described --.
Line 39, “detailed.” should read -- detail. --.
Line 64, “details” should read -- detail, --.

Column 33,
Line 62, “above” should read -- above- --.

Column 34,
Line 20, “an” should read -- a --.
Line 28, “above described” should read -- above-described --.

Column 35,
Line 42, “15*w*comes” should read --15w comes --.

Column 36,
Line 22, “tape” should read --tapes--.

UNITED STATES PATENT AND TRADEMARK OFFICE

CERTIFICATE OF CORRECTION

PATENT NO. : 6,721,520 B2
DATED : April 13, 2004
INVENTOR(S) : Akira Higeta et al.

It is certified that error appears in the above-identified patent and that said Letters Patent is hereby corrected as shown below:

Column 37,
Line 14, “necessary” should read -- necessarily --.
Lines 30, 41 and 52, “above described” should read -- above-described --.

Column 38,
Lines 11, 18 and 29, “above described” should read -- above-described --.
Line 48, “groups’” should read -- groups --.
Line 55, “has” should read -- had --.
Line 59, “includes” should read -- include --.

Column 41,
Line 36, “the” should read -- a --.

Signed and Sealed this

Fourteenth Day of September, 2004

JON W. DUDAS
*Director of the United States Patent and Trademark Office*